US005585690A

United States Patent [19]

Misono

[11] Patent Number: 5,585,690

[45] Date of Patent: Dec. 17, 1996

[54] CATHODE RAY TUBE AND DEFLECTION ABERRATION CORRECTING METHOD OF THE SAME

[75] Inventor: Masayoshi Misono, Chiba-ken, Japan

[73] Assignee: Hitachi, Ltd., Tokyo, Japan

[21] Appl. No.: 181,587

[22] Filed: Jan. 13, 1994

[51] Int. Cl.[6] ..... H01J 29/50

[52] U.S. Cl. ..... 313/413; 313/414

[58] Field of Search ..... 313/413, 414

[56] References Cited

U.S. PATENT DOCUMENTS

| | | | |
|---|---|---|---|
| 4,374,341 | 2/1983 | Say | 313/414 |
| 4,701,678 | 10/1987 | Blacker et al. | 315/382 |
| 4,710,672 | 12/1987 | Van Tol | 313/413 |
| 4,766,344 | 8/1988 | Say | 313/414 |
| 5,066,887 | 11/1991 | New | 313/414 |
| 5,285,130 | 2/1994 | Takayama | 313/414 |
| 5,384,512 | 1/1995 | Kamohara et al. | 313/414 |
| 5,386,178 | 1/1995 | Son et al. | 315/15 |

FOREIGN PATENT DOCUMENTS

| | | |
|---|---|---|
| 0109717 | 10/1976 | European Pat. Off. . |
| 2303374 | 5/1984 | France . |
| 1514235 | 6/1978 | United Kingdom . |

*Primary Examiner*—Alvin E. Oberley
*Assistant Examiner*—Lawrence O. Richardson
*Attorney, Agent, or Firm*—Antonelli, Terry, Stout & Kraus

[57] ABSTRACT

A cathode ray tube which is equipped with an electron gun having a construction capable of not only improving the focusing characteristics for the entire region of a screen and for the total current range of an electron beam without any supply of a dynamic focusing voltage to achieve a satisfactory resolution but also reducing the Moire phenomena in a low current range. Also disclosed is a method of correcting the deflection aberration of the cathode ray tube. A deflection aberration according to the deflection of the electron beam is corrected by establishing a fixed inhomogeneous electric field, which has its equipotential lines narrowed in interval the more for the longer distance from the axis of symmetry of an electric field.

36 Claims, 54 Drawing Sheets

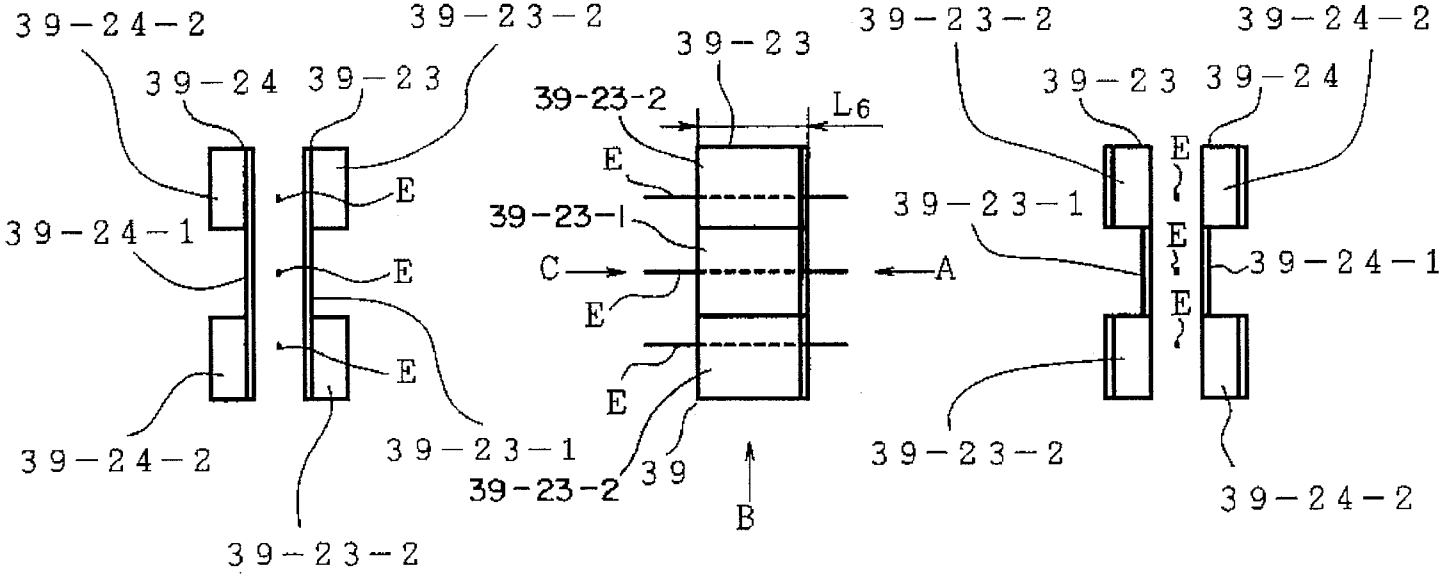
FIG. 49A FIG. 49B
FIG. 49D
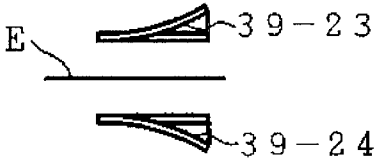
FIG. 49C

CATHODE RAY TUBE AND DEFLECTION ABERRATION CORRECTING METHOD OF THE SAME

FIELD OF THE INVENTION

The present invention relates to a cathode ray tube and, more particularly, to both a cathode ray tube, which is equipped with an electron gun capable of improving focusing characteristics over the entire region of the fluorescent face and over the entire current range of an electron beam to achieve a satisfactory resolution, and a deflection aberration correcting method of the cathode ray tube.

DESCRIPTION OF THE PRIOR ART

In a cathode ray tube comprising an electron gun having a plurality of electrodes, a deflector and a fluorescent face (i.e., a screen having a fluorescent film, as will be called the "fluorescent films" or the "screen"), the following technique is known in the prior art as means for forming a satisfactory reproduced image on not only the central but also the peripheral portions of the fluorescent face.

According to one technique, on the bottom of a shield cup of an electron gun using three electron beams arrayed in-line, there is disposed two upper and lower parallel flat electrodes which are arranged in parallel with the in-line across the paths of the three electron beams and directed toward a main lens (as disclosed in Japanese Patent Publication No. 52586/1992).

In an electron gun using three electron beams arrayed in-line, the electron beams are shaped before they enter a deflecting magnetic field, by arranging two upper and lower parallel flat electrodes in parallel with the in-line across the paths of the three electron beams and by directing them from the opposed portions of the main lens toward the fluorescent face as disclosed in U.S. Pat. No. 4,086,513 and Japanese Patent Publication No. 7345/1985).

An electrostatic quadrupole lens is formed between some of the electrodes of an electron gun so that its intensity may be dynamically changed according to the deflection of an electron beam to homogenize the image all over the screen (as disclosed in Japanese Patent Laid-Open No. 61766/1976).

An astigmatic lens is disposed in the region of electrodes (e.g., second and third electrodes) constituting a converging lens (as disclosed in Japanese Patent Laid-Open No. 18866/1978).

The first and second electrodes of an in-line three-beam electron gun have their electron beam apertures vertically elongated to have their individual shapes made different and to make the aspect ratio of the center electron gun smaller than those of the side electron guns (as disclosed in Japanese Patent Laid-Open No. 64368/1976).

A rotationally asymmetric lens is formed of the slit which is formed at the cathode side of a third electrode of an in-line arrayed electron gun, so that the electron beam may impinge upon the fluorescent face through at least one rotationally asymmetric lens in which the slit is made deeper in the axial direction of the electron gun for the center beam than for the side beams (as disclosed in Japanese Patent Laid-Open No. 81736/1985).

The focusing characteristics required of the cathode ray tube are the satisfactory resolution over the entire region of the screen and over the entire current region of the electron beam, no Moire in a low current region, and the uniform resolution over the entire screen for the entire current region. It requires a high grade technique to design an electron gun capable of satisfying such characteristics at the same time.

In order to give the aforementioned several characteristics to the cathode ray tube, according to our investigations, it has been found indispensable to provide an electron gun which has a combination of an astigmatic lens and a main lens having a large aperture.

In the prior art described above, however, in order to achieve a satisfactory resolution over the entire screen by using electrodes for establishing the astigmatic lens and the rotationally asymmetric lens in the electron gun, it is necessary to apply a dynamic focusing voltage to the focusing electrode of the electron gun. No consideration is taken into the achievement of a reproduced image having a satisfactory resolution over the entire region of the screen by correcting the deflection aberration by the inhomogeneous electric field fixed in the deflecting magnetic field.

FIG. 83 is a side elevation showing the entirety of an electron gun of the type for applying a focusing voltage to electrodes G3 and G5, and an anode voltage only to an electrode G6 in accordance with an electron gun for a cathode ray tube, and FIG. 84 is a partial section showing an essential portion of the same. The electron gun is equipped, as viewed from the side of a cathode K, with a first electrode 1 (G1), a second electrode 2 (G2), a third electrode 3 (G3), a fourth electrode 4 (G4), a fifth electrode (G5) and a sixth electrode 6 (G6). Incidentally, the fifth electrode 5 (G5) is composed of two electrodes 51 and 52.

In these Figures, all the influences to be exerted upon the electron beam by the electric field in accordance with the lengths of the individual electrodes and the apertures of the electron beam transmitting holes are different. For example, the electron beam transmitting hole of the first electrode 1 close to the cathode K is shaped to exert influences upon the spot shape of the electron beam in a low current range, and the electron beam transmitting hole of the second electrode 2 is shaped to exert influences upon the spot shape of the electron beam from a low current range to a high current range.

Moreover, in the electron gun in which an anode voltage is supplied to the sixth electrode 6 to establish a main lens between the fifth electrode 5 and the sixth electrode 6, the electron beam transmitting holes of the fifth electrode 5 and the sixth electrode forming the main lens are shaped to exert high influences upon the electron beam spot shape in a high current range but lower influences upon the electron beam spot shape in a low current range than in the aforementioned high current range.

Moreover, the length of the fourth electrode 4 of the aforementioned electron gun in the axial direction exerts influences upon the magnitude of the optimum focusing voltage and serious influences upon the difference between the individual optimum focusing voltages for low and high currents, respectively but the length of the fifth electrode 5 in the axial direction exerts far lower influences than those of the fourth electrode 4.

In order to optimize the individual characteristics values of the electron beam, therefore, it is necessary to optimize the structures of the electrodes which act most effectively upon the individual characteristics.

In case, on the other hand, the shadow mask pitch in a direction perpendicular to the electron beam scanning direction of the cathode ray tube is reduced or the density of the electron beam scanning lines is increased so as to increase the resolution in the direction perpendicular to the electron beam scanning direction, an optical interference occurs especially in a low current range of the electron beam between the electron beam and the shadow mask. Hence, it is necessary to minimize the Moire contrast. However, the prior art has failed to solve the aforementioned various problems.

SUMMARY OF THE INVENTION

An object of the present invention is to solve the problems of the prior art described above and to provide both a cathode ray tube equipped with an electron gun having a construction capable of improving the focusing characteristics over the entire region of the screen and over the entire current range of an electron beam without supplying any dynamic focusing voltage, to achieve a satisfactory resolution and to reduce the Moire in a low current range, and a deflection aberration correcting method of the same.

For example, in FIGS. 85A and 85B presenting schematic sections showing an essential portion for comparing the structures of the electron gun in dependence upon how to apply a focusing voltage, FIG. 85A shows a fixed focusing voltage system, and FIG. 85B shows a dynamic focusing voltage system.

The electrode construction of the fixed focusing voltage type electron gun of FIG. 85A is identical to that shown in FIGS. 83 and 84, and the portions having the same operations are designated at the same reference numerals.

In the fixed focusing voltage type electron gun of FIG. 85A, the electrodes 51 and 52 constituting the fifth electrode 5 are fed with a focusing voltage $V_{*1}$ at the common potential.

In the dynamic focusing voltage type electron gun of FIG. 85B, on the other hand, the two electrodes 51 and 52 constituting the fifth electrode 5 (G5) are fed with different focusing potentials. Of these, one electrode 52 is fed with a dynamic focusing electrode $dV_f$. Moreover, this dynamic focusing voltage type electron gun has its portion penetrating into another electrode, as indicated at 43, and has a more complicated structure than that of the electron gun shown in FIG. 85A. Thus, the dynamic focusing voltage type electron gun has disadvantages of a higher cost of the parts and a complicated assembly of an electron gun.

FIGS. 86A and 86B are explanatory diagrams plotting the focusing potentials to be supplied to the electron gun shown in FIGS. 85A and 85B. FIG. 86A is a diagram illustrating the focusing voltage waveform of the fixed focusing voltage type electron gun, and FIG. 86B is a diagram illustrating the waveform of the focusing voltage waveform of the dynamic focusing voltage type electron gun.

FIG. 86B shows a fixed focusing voltage $Vf_1$, and a voltage comprising another fixed focusing voltage $Vf_{20}$ and a dynamic focusing voltage $Vf_2$ superposed upon $Vf_{20}$. Thus, the dynamic focusing voltage type electron gun shown in FIG. 85B is required to have two dynamic focusing voltage feeding pins at the stem of the cathode ray tube, and more care than that of the fixed focusing voltage type electron gun of FIG. 86A are required for the insulation from other stem pins. This makes it necessary to provide a special structure for the socket for its assembly into a TV set, and there arises a problem that a longer time is required for adjusting the focusing voltages of not only the two fixed focusing power sources but also the dynamic focusing voltage generator and for adjusting the TV set on the assembly line.

Another object of the present invention is to solve the aforementioned problems of the prior art and to provide both a cathode ray tube equipped with an electron gun having a construction capable of improving the focusing characteristics over the entire region of the screen and over the entire current range of an electron beam with the dynamic focusing voltage, to achieve a satisfactory resolution, and a deflection aberration correcting method of the same.

Still another object of the present invention is to provide both a cathode ray tube for reducing a deterioration in the focusing characteristics due to the space charge repulsion of an electron beam acting between the fluorescent face of the cathode ray tube and the main focusing lens of an electron gun, and a deflection aberration correcting method of the same.

Since the electron beam in the cathode ray tube has its maximum deflection angle (as will be shortly referred to as the "deflection angle" or "deflection") substantially within a certain range, the distance between the fluorescent face and the main focusing lens of the electron gun becomes the larger for the larger size of the fluorescent face thereby to increase the deterioration in the focusing characteristics due to the spatial charge repulsion of the electron beam acting in that region.

Therefore, reduction of the deterioration in the focusing characteristics due to the space charge repulsion provides an electron beam as thin as that in a small-sized fluorescent face, so that resolution of the large-size cathode ray tube is improved.

A further object of the present invention is to provide an electron gun capable of improving the aforementioned focusing characteristics and shortening the total length of a cathode ray tube, a cathode ray tube equipped with that electron gun, and a deflection aberration correcting method of the cathode ray tube.

A further object of the present invention is to provide an electron gun free from any deterioration in uniformity of an image over the entire screen even if a cathode ray tube has its deflection angle widened, a cathode ray tube equipped with that electron gun, and a deflection aberration correcting method of the cathode ray tube.

If the deflection angle is widened, the total length of the cathode ray tube can be shortened. The existing TV set has its depthwise size determined by the total length of the cathode ray tube, and its shorter depth is the more desirable if it is thought as a kind of furniture. Moreover, the shorter depth of the TV set is the more preferable for transportation efficiency in case a large number of TV sets are to be transported from their maker.

In the prior art described above, no consideration is taken into the suppression of the temperature rise due to the shortening of the axial length of the cathode ray tube at a portion of the neck of a cathode ray tube mounting an electron beam deflecting magnetic field generating structure.

In order to the above-specified objects, the present invention has structures, as defined in the appended Claims.

Specifically, according to the present invention, there is provided a cathode ray tube comprising an electron gun having a plurality of electrodes, a deflector and a fluorescent face, wherein the improvement resides in that a deflection aberration is corrected by forming a fixed inhomogeneous electric field in the deflecting magnetic field.

The correction of the deflection aberration is characterized by correcting the deflection aberration in accordance with the deflection by establishing a fixed inhomogeneous electric field having an astigmatism in the deflecting magnetic field.

Moreover, the aforementioned fixed inhomogeneous electric field is characterized by establishing an astigmatic inhomogeneous electric field, in which the electron beam is diverged or converged, and correcting the deflection aberration in accordance with the deflection in the scanning line direction of the electron beam or in a direction perpendicular to the scanning line.

Still moreover, the present invention is characterized in that the deflection aberration is corrected according to the deflection by establishing a fixed inhomogeneous electric field having a coma aberration in a deflecting magnetic field.

The aforementioned fixed inhomogeneous electric field is characterized by establishing an inhomogeneous electric field having a coma aberration for diverging or converging the electron beam and by correcting the deflection aberration in accordance with the deflection in the scanning line direction of the electron beam or in a direction perpendicular to the scanning line.

The following operations are achieved in the cathode ray tube of the present invention having the constructions, as defined in the Claims:

(1) In the cathode ray tube, generally speaking, the deflection aberration abruptly increase with the increase in the deflection. According to the present invention, the deflection aberration can be corrected by establishing such an inhomogeneous electric field in a deflecting magnetic field that the converging or diverging action of the electron beam is changed when the electron beam is deflected to have its orbit changed.

(2) FIG. 66 is an explanatory diagram plotting the relation between the amount of deflection (or the deflection angle) and the amount of deflection aberration, and FIG. 67 is an explanatory diagram plotting the relation between the amount of deflection and the amount of correction to deflection aberration.

As shown in FIG. 66, the deflection aberration increases with the increase in the deflection angle. According to the present invention, the deflection aberration increasing abruptly according to the deflection can be corrected by establishing such an inhomogeneous electric field in the deflecting magnetic field that the deflection aberration correction increases according to the correction of deflection, as shown in FIG. 67, when the electron beam is deflected to have its orbit changed.

(3) An electric field having an astigmatism is effective as one of such inhomogeneous electric fields in the deflecting magnetic field that the electron beam converging or diverging action is properly accelerated according to the deflection when the electron beam is deflected to have its orbit changed. The astigmatic electric field is established by the electric field having two orthogonal planes of symmetry.

The converging or diverging action of the electron beam is increased the more as the position comes the closer to the end of the plane of symmetry from the center.

If comparison is made between the statuses of the electron beam passing through the center of the electric field established by equipotential lines and the electron beam passing through a portion apart from the center of the electric field, the electron beam passing through the portion apart from the center of the electric field experiences more divergence than the electron beam passing through the center of the electric field, and the overall orbit comes closer to the end of the electric field.

Moreover, the change of the orbit is higher at the end of the electric field. This is because the interval of the equipotential lines becomes the narrower as the portion goes the farther from the center of the electric field.

In the cathode ray tube, generally speaking, the distance from the main lens of the electron gun to the fluorescent face is longer at the periphery of the fluorescent face than at the center of the fluorescent face so that an over-convergence occurs in the periphery of the fluorescent face if the electron beam is properly converged at the center of the fluorescent face when there is no converging or diverging action on the electron beam caused by the deflection field.

By establishing the fixed electric field in the deflecting magnetic field, according to the present invention, the diverging action by the electric field is increased the more with the increase in deflection so that the over-convergence of the electron beam in the periphery of the fluorescent face can be reduced to correct the deflection aberration, as shown in FIG. 67, according to the deflection.

In case the deflecting magnetic field also has the electron beam converging action, according to the present invention, the fixed electric field having a tendency of a higher intensity is established in the deflecting magnetic field. Thus, the increase in the diverging action by the electric field for the increased deflection can exceed the increase in the converging action by the deflecting magnetic field, to correct the deflection aberration including the over convergence phenomena of the electron beam in the periphery of the fluorescent face due to the physical structure of the cathode ray tube.

(4) FIG. 68 is an explanatory diagram showing a focusing of the electron beam on a fluorescent film 13. The reference letter 3 designates the third electrode; the numeral 4 the fourth electrode; the numeral 13 the fluorescent film; and numeral 38 a main lens.

FIG. 69 is an explanatory diagram showing a scanning line formed in a panel portion forming the fluorescent face (or screen) of the cathode ray tube. Reference numeral 14 designates a panel portion, and numeral 60 designates a scanning focus.

The deflection of the cathode ray tube is frequently executed by a method of scanning an electron beam linearly, as shown in FIG. 69. The liner scanning loci are called the "scanning lines".

The deflecting magnetic fields frequently differ between a direction (X—X) of the scanning lines and a direction (Y—Y) perpendicular to the scanning lines. Moreover, the electron beam is often focused differently in the scanning direction and in the direction perpendicular to the scanning direction by the action of at least one of the aforementioned plurality of electron gun electrodes, prior to the great influences of the action of the fixed inhomogeneous electric field to be established in the deflecting magnetic field.

Moreover, whether the deflection aberration correction in the scanning line direction or the deflection aberration correction in the direction perpendicular to the scanning line direction is attached more importance to depends upon the application of the cathode ray tube. The technical means for coping with the directions of the deflection aberration with respect to the scanning lines for providing types of correction for the aberration and the amount of correction for the aberration, respectively, of correction are not always identical and vary in cost. The present invention can be applied to those different means for coping with the problems.

(5) Of the electron beam passing through the center of the electric field established by the equipotential lines on one plane of symmetry of the astigmatic electric field having the converging action and the electron beam passing through a portion apart from the center of the electric field, the latter electron beam acquires a higher convergence than the former electron beam, as it progresses in the electric field, and its overall orbit comes closer to the center of the electric field. Moreover, the change of the orbit is the greater at the side closer to the electric field. This is because the interval of the equipotential lines becomes the narrower as they are the farther from the center of the electric field.

In case the deflection aberration has an action to diverge the electron beam, the deflection aberration can be corrected, as shown in FIG. 67, according to the deflection by establishing such a fixed electric field in the deflecting magnetic field that the converging action by the electric field can be increased with the deflection to reduce the over-convergence of the electron beam in the periphery of the fluorescent face.

The technical means for coping with the directions of the deflection aberration with respect to the scanning lines for providing types of correction for the aberration and the amount of correction for the aberration, respectively, of correction are not always identical and vary in cost. The present invention can be applied to those different means for coping with the problems.

(6) In the color cathode ray tube having three electron beams arrayed in-line in the horizontal direction, the vertical deflecting magnetic field is exemplified by a barrel-shaped magnetic field distribution whereas the horizontal deflecting magnetic field is exemplified by a pin-cushion shaped magnetic field distribution, as shown in FIG. 74, so as simplify the circuit for controlling the convergence of the three electron beams at a point on the fluorescent face.

Of the three electron beams arrayed in-line, the two side electron beams receive the different amounts of deflection aberration from the vertical deflecting magnetic field in dependence upon the magnitude of the vertical deflecting magnetic field and the position of the horizontal deflection. For example, assume that an electron beam is emitted from the righthand side gun of the in-line type gun when the cathode ray tube is viewed from its fluorescent face side. A magnetic field distribution of the deflecting magnetic field passed by the electron beam deflected leftward on the fluorescent face with respect to the cathode ray tube axis is different from that passed by the electron beam deflected rightward on the fluorescence face with respect to the cathode ray tube axis, and the amounts of deflection aberration with two beams receive are different from each other. The image qualities produced by one side gun differ between the righthand and lefthand corners on the fluorescent face.

In order to suppress this, the converging or diverging action has to be different according to whether the side electron beam is deflected leftward or rightward with respect the cathode ray tube axis.

In the present invention, it is effective to form in the deflecting magnetic field the electric field having only one plane of symmetry, that is, the fixed electric field having the coma aberration.

On the plane of symmetry of the coma aberration electric field having the diverging action, of the electron beam passing through the center of the electric field established by the equipotential lines and the electron beam passing through the portion apart from the center of the electric field, the electron beam passing apart from the center of the electric field takes a larger divergence, as it progresses in the electric field, than the electron beam passing through the center of the electric field and has its entire orbit brought closer to the end of the electric field. Moreover, the change of the orbit is the greater at the side close to the end of the electric field. This is because the interval of the equipotential lines becomes the narrower with an increasing distance from the center of the electric field.

Next, assume the intervals of the equipotentials to become gradually narrower compared with the above case.

The electron beam passing through a portion apart from the center of the electric field also has a larger divergence, as it progresses in the electric field, than the electron beam passing through the center of the electric field and has its entire orbit brought closer to the end of the electric field. Moreover, the change of the orbit is also the greater at the side close to the end of the electric field, but the changing rate of the electron beam orbit is lower than that of the orbit in the above case. This is because the degree of narrowing the interval of the equipotential lines with an increasing distance from the center of the electric field is smaller in this case.

As a result, the deflection aberration can be corrected, as shown in FIG. 67, by establishing such a fixed electric field in the deflecting magnetic field that the diverging action by the electric field is increased, and differs with the deflection direction.

For the electron beam on the plane of symmetry in case the deflecting magnetic field has the electron beam diverging action and in case the deflection aberration becomes different according to the direction of deflection, a fixed electric field having a tendency, as shown in FIG. 3, is established in the deflecting magnetic field so that the converging action by the electric field can be increased with the increase in the deflection differently according to the direction of deflection, to correct the deflection aberration, as shown in FIG. 67.

(7) In order to improve the homogeneity of the resolution all over the fluorescent face by forming a fixed inhomogeneous electric field in the deflecting magnetic field, the orbit of the electron beam has to be so deflected as to pass through the regions of different electric field intensities in this electric field. Hence, the aforementioned inhomogeneous electric field must be related with the deflecting magnetic field at each position.

At the same time, the effect of correcting the deflection aberration also depends upon the intensity of the fixed inhomogeneous electric field to be established in the deflecting magnetic field. The electric field is established by the potential difference between at least two electrodes having different potentials. The electric field intensity is not unique because it is determined by the combination of the structures, positions and potential differences of the aforementioned at least two electrodes having different potentials and is subjected to restrictions such as the practical diameter of the electron beam passing through the aforementioned electric field and the aforementioned practical potential difference.

This electric field is established by the difference between at least two potentials, and the electrode for correcting the deflecting aberration in accordance with the aforementioned deflection, that is, the electrode for establishing the aforementioned inhomogeneous electric field will be called the "deflection aberration correcting electrode." This deflection aberration correcting electrode may be provided in plurality and has its number unlimited, or its action may be borne by a portion of another electrode.

As well known in the art, the magnetic flux density necessary for the deflection depends upon the voltage of the fluorescent face and can be normalized by dividing it by the square root of the voltage of the fluorescent face. If this value is used, the orbit of the electron beam in the aforementioned inhomogeneous electric field can be clarified to improve the accuracy of setting the electric field thereby to make a proper deflection aberration correction possible.

The necessary magnetic flux density also depends upon the intensity of the aforementioned inhomogeneous electric field so that it may be the less for the higher intensity of the electric field. The intensity of the inhomogeneous electric field also depends upon the positional relation to and potential difference from an adjoining electrode of different potential and upon the structure itself of the deflection aberration correcting electrode for establishing the inhomogeneous electric field. The electric field is intensified the more as the positional relation to that adjoining electrode of different potential comes the closer, but the distance cannot be reduced to zero.

The electric field can be intensified by increasing the potential difference from the adjoining electrode of different potential. However, a drastic increase in the electric field results in that the electron beam is so seriously distorted by the influences of the inhomogeneous electric field even if it follows an orbit receiving no deflection, namely, impinges upon the center of the fluorescent face of the cathode ray tube, that the degradation of the resolution at the center of the fluorescent face cannot be ignored. Hence, the potential difference from the adjoining electrode of different potential is restricted to the practically maximum value of about the difference between the potential of the fluorescent face and the focus potential if the breakdown characteristics with the electrode of different potential are considered.

It is expected that the convergence or divergence of the electron beam may occur even with a slight change of the orbit if the gap between the deflection aberration correcting electrodes for establishing the aforementioned inhomogeneous electric field is narrowed. If the diameter of the electron beam is considered, however, the gap between the inhomogeneous electric field establishing electrodes is practically limited to about 0.5 mm. With these being considered, according to the present invention, in case the maximum deflection angle of the cathode ray tube is 100 degrees or more, an effect can be exhibited if the aforementioned normalized magnetic flux density is set to 0.007 millitesla per the root of 1 V of the fluorescent face voltage.

The aforementioned distance is the longest in case the electrode at the fluorescent face side penetrates in the axial direction of the cathode ray tube.

(8) If the maximum deflection angle of the cathode ray tube is determined, the maximum of the magnetic flux density normalized by the root of the fluorescent face voltage is substantially determined. There is a method of setting the position, in which the aforementioned fixed inhomogeneous electric field is established in the deflecting magnetic field, in a region having a predetermined level or more of the maximum magnetic flux density. This method can simplify the measurement of the magnetic flux density far better than the case of setting with the absolute value of the magnetic flux density. In short, it is sufficient and practically useful to make a comparison with the maximum magnetic flux density. Here, the maximum of the magnetic flux density varies with the shape of the aforementioned magnetic material to cause an error, which raises no practical problem.

In case the maximum deflection angle of the cathode ray tube is 100 degrees or more, according to the present invention, an effect can be exhibited within a range of no practical problem if the level of the magnetic flux density is set to 25% or more of the maximum magnetic flux density at the end portion of the aforementioned inhomogeneous electric field establishing electrode on the side of the fluorescent face considering the restrictions upon the electrodes and the electric field relations, as described in the foregoing operation (7).

(9) The magnetic flux density corresponds closely to the position from the magnetic material making up the core of the coil for establishing the deflecting magnetic field, because it depends upon the magnetic permeability of the magnetic path. One of the methods of indicating the region of the necessary magnetic flux density is the distance between the aforementioned inhomogeneous electric field establishing electrode and the aforementioned magnetic material. This method is practically useful because it can omit the measurement of the magnetic flux density if the core of the coil for establishing the deflecting magnetic field is located. Here, the distribution of the magnetic flux density raises an error but no practical problem because it changes with the shape of the magnetic material.

In case the maximum deflection angle of the cathode ray tube is 100 degrees or more, according to the present invention, an effect can be exhibited within a range of no practical problem if the distance from the end of the magnetic material on the side of the fluorescent face to the end portion of the inhomogeneous electric field establishing electrode on the side of the fluorescent face is within 40 mm considering the restrictions upon the electrodes and the electric field relations, as described in the foregoing operation (7).

The aforementioned distance is the longest in case the aforementioned deflection aberration correcting electrode on the side of the fluorescent face penetrates in the axial direction of the cathode ray tube. (10) Likewise, according to the present invention, in case the maximum deflection angle of the cathode ray tube is 100 degrees or less, an effect can be exhibited if the normalized magnetic flux density corresponding to the foregoing operation (7) is set to 0.004 millitesla per the root of 1 V of the fluorescent face voltage. The magnetic flux density of 20% or more corresponding to the operation (8) is effective within a practically troubleproof range. The distance of 35 mm or less corresponding to the operation (9) is effective within a practically troubleproof range.

(11) In the cathode ray tube, the aforementioned inhomogeneous electric field cannot have its intensity freely increased if considerations are taken into the entire structure of the cathode ray tube and the structure and making and using feasibilities of the electron gun employed.

If the using feasibility is considered, according to the present invention, the electron beam has to be properly thick in that region so that it may be effective even in the electric field having a relatively low intensity. In the cathode ray tube, generally speaking, the electron beam takes the largest diameter in the vicinity of the main lens. Hence, the position of the deflection aberration correcting electrode for establishing the aforementioned inhomogeneous electric field is restricted by the distance from the main lens.

Moreover, if the deflection aberration correcting electrode is disposed extremely close to the cathode side far from the main lens portion, the astigmatism will be offset by the converging action of the main lens and a problem arises that the electron beam partially impinges upon some electrodes of the electron gun.

Here will be considered the conditions of using the cathode ray tube having a maximum deflection angle of 85 degrees or less, a single electron beam or a convergence of the electron beam by the magnetic field. In the present invention, the distance between the end portion of the aforementioned inhomogeneous electric field establishing electrode and the end of the anode of the electron gun of the cathode ray tube facing the main lens is effective, if it is five times or less as many as the aperture diameter of the anode of the electron gun facing the focus electrode as taken in the direction perpendicular to the scanning lines, or shorter than 180 mm, when the inhomogeneous electric field establishing electrode extends toward the fluorescent face from the anode of the electron gun facing the main lens and the above distance is three times or less as many as the same aperture diameter or shorter than 180 mm when the inhomogeneous electric field establishing electrode extends toward the cathode. The aforementioned distance is the shortest in case the electrode on the side of the fluorescent face penetrates in the axial direction of the cathode ray tube.

(12) In order to make the present invention effective in the aforementioned inhomogeneous electric field region, it is necessary that the magnetic flux density of the deflecting magnetic field be at a necessary value. The aforementioned deflection aberration correcting electrode may be made of a non-magnetic material. If, however, at least a portion of the deflection aberration correcting electrode is made of a magnetic material, it acts as means for enhancing the magnetic flux density of the electric field region other than the mechanism for establishing the deflecting magnetic field so that the correction of the deflection aberration is further improved.

(13) In the present invention, the deflection aberration correcting electrode is structurally required to be arranged close to the electron beam path. One means for this requirement is exemplified by providing the aperture structure enveloping a portion of the path of the electron beam. As described in the operation (3), the astigmatic electric field has two planes of symmetry, whereas the coma aberration electric field has one plane of symmetry.

The above-specified two kinds of aberration electric fields can be established by the structure of the aforementioned aperture. Generally speaking, the electrode parts of the electron gun of the cathode ray tube are manufactured by pressing metal sheets. In recent years, the focusing characteristics of the cathode ray tube have been remarkably improved to require high precision for the electrode parts, and the aforementioned deflection aberration correcting electrode is likewise required to have the high precision. In the case of mass production, the deflection aberration correcting electrode can be manufactured in high working precision at a reasonable cost by making it of pressed integral parts having the aperture.

In the deflection of the cathode ray tube, the scanning lines are frequently formed, as described above. In the cathode ray tube of the scanning type deflection, the fluorescent face is frequently shaped to have a generally rectangular contour, and the scanning is generally effected substantially in parallel with the sides of the rectangle. In order to facilitate assembly of the cathode ray tube into an image display device, the vacuum enclosure to be formed with the fluorescent face is also contoured to have a generally rectangular shape matching the fluorescent face.

In the present invention, therefore, the aforementioned two kinds of aberration electric fields are convenient for forming an image if they have structures corresponding to the scanning lines and the shape of the fluorescent face. The aberration electric field may be in two directions, i.e., in the same direction as the scanning lines and in a perpendicular direction to the scanning lines and also depends upon the operating conditions of the cathode ray tube so that it cannot be uniquely determined.

(14) In the present invention, the diameter of the aforementioned aperture is closely related to the intensity of the electric field to be established and the orbit of the electron beam at the corresponding portion and reduces the effect if it is extremely large. The image display device has its depth restricted, if it uses the cathode ray tube, by the axial length of the cathode ray tube so that it cannot be freely shortened.

One means for meeting that restriction is to increase the maximum deflection angle of the cathode ray tube. The maximum deflection angle practiced at present is 114 degrees for the cathode ray tube of a single electron beam and a similar value for the cathode ray tube of in-line three electron beams. The maximum deflection angle has a tendency to increase in the future, but its increase raises the maximum magnetic flux density of the deflecting magnetic field so that the maximum deflection angle is practically restricted by the diameter of the neck portion of the cathode ray tube. The neck portion is usable if its external diameter is about 40 mm at the maximum because it economizes the electric power for establishing the deflecting magnetic field and the material for the mechanical portion for establishing the deflecting magnetic field.

Generally speaking, the maximum diameter of the electrodes of the electron gun has to be smaller than the internal diameter of the neck portion of the cathode ray tube, and the thickness of the neck portion has to be at least several millimeters for the mechanical strength, the insulation and the prevention of leakage of X-rays. In the present invention, considering the restrictions on the electrodes and the electric field, as described in the foregoing operation (7), the optimum diameter of the throat of the aperture of the electrode for correcting the deflection aberration by establishing the inhomogeneous electric field in the deflecting magnetic field, as taken in the scanning line direction or in the perpendicular direction to the scanning lines, can be 1.5 times or less as large as that of the portion facing the focus electrode of the anode of the electron gun, as taken in the direction perpendicular to the scanning lines, that is, 0.5 to 30 mm. Then, the characteristic effects can be exhibited with an excellent cost merit.

(15) In the present invention, the inhomogeneous electric field can also be established by the electrode structure in which the electrodes are opposed to each other across the path of the electron beam.

FIGS. 70A to 70E are explanatory diagrams showing examples of the construction of the deflection aberration correcting electrode. FIG. 70A shows a partial section of a cylindrical electrode; FIG. 70B shows a front elevation of the cylindrical electrode; FIG. 70C shows a side elevation of parallel flat electrodes; FIG. 70D shows a front elevation of the parallel flat electrodes; and FIG. 70E shows a top plan view of the parallel flat electrodes.

FIG. 71 is a diagram showing the arrangement of the cylindrical electrode and the parallel flat electrodes (i.e., the deflection aberration correcting electrode) for establishing an inhomogeneous electric field.

In order to establish the inhomogeneous electric field, for example, a cylindrical electrode 67, as shown in FIGS. 70A and 70B, and two parallel flat electrodes 68, as shown in FIGS. 70C–70E, are arranged and fed with potentials, as shown in FIG. 71. Then, the inhomogeneous electric field is established between the parallel flat electrodes 68.

These parallel flat electrodes 68 constitute the deflection aberration correcting electrode. Thus, a more optimum deflection aberration correction can be achieved in the combination of the application of the cathode ray tube and the characteristics of the remaining electrodes of the electron gun by forming partially non-parallel or partially notched portions in the opposed portions of the parallel flat electrodes 68.

Especially in case the cathode ray tube is produced with many kinds but in small quantities, it raises the production cost to prepare expensive press molds. The parallel flat electrodes can be easily manufactured by pressing and folding a flat material with an inferior precision than the shaping method in which integrated aperture parts are pressed. Thus, no expensive press mold is required to produce the parts at a reasonable cost even with many kinds but in small quantities.

In the present invention, the optimum size range of the aforementioned opposed portions of the electrode is substantially equal to the diameter of the aperture, as described in the operation (14), but the distance of zero between the two electrodes is not included because of the opposed structure. In the cathode ray tube for the deflection of the scanning line type, moreover, the direction of opposition may conveniently correspond like the operation (14) to the scanning line direction or the perpendicular direction. (16) In case the aforementioned deflection aberration correcting electrode for establishing the fixed inhomogeneous electric field increase its diverging action to correct the deflection aberration in accordance with the increase in the deflection, its potential has to be held at a higher level than those of the adjoining electrodes.

This necessity is achieved in the present invention by equalizing the potential of the aforementioned electrode to that of the fluorescent face of the cathode ray tube. In this case, the fluorescent face and the anode of the electron gun need not be at the same potential.

A more intense fixed inhomogeneous electric field than the potential difference between the aforementioned electrode and the anode of the electron gun can be established by setting the electrode at a higher potential than that of the anode of the electron gun.

One means for establishing the potential difference between the fluorescent face and the anode of the electron gun is exemplified in the present invention by dividing the potential of the fluorescent face in the cathode ray tube by a voltage dividing resistor.

The accuracy of the correction of the deflection aberration can be improved better if the electron gun potential different from the fluorescent face potential can be adjusted from the outside of the cathode ray tube. (17) In case the deflection aberration correcting electrode for establishing the fixed inhomogeneous electric field increases its diverging action to correct the deflection aberration in accordance with the increase in the deflection, its potential has to be held at a higher potential than those of the adjoining electrodes.

This necessity is achieved in the present invention by setting the potential of the aforementioned electrode at the same potential as that of the anode of the electron gun.

The electric field thus established is enabled to reach the vicinity of the electrode by suitably setting the position and structure of the deflection aberration correcting electrode so that it can correct the deflection aberration in accordance with the deflection if combined with the action of a suitable deflecting magnetic field.

The aforementioned adjoining electrodes of different potentials in the present invention are mating ones for establishing the electric field through an aperture other than the electron beam transmitting hole. The electric field to leak through the aperture other than the electron beam transmitting hole also promotes the effect that the deflection aberration correcting electrode increases its diverging action to correct the deflection aberration in accordance with the increase in the deflection.

(18) In the present invention, even if the fixed potential of the deflection aberration correcting element is different from the individual potentials of the fluorescent face of the cathode ray tube and the anode of the electron gun, the deflection aberration can be corrected according to the increase in the deflection.

In case the deflection aberration correction for increasing the electron beam diverging action is necessary, for example, the deflection aberration correction can be accomplished according to the increase in the deflection by applying the potential between the fluorescent face potential and the anode potential.

In case the deflection aberration correction for increasing the electron beam converging action is necessary, it can be accomplished by arranging an electrode of a lower potential than that of the anode of the electron gun within or in the vicinity of the anode to increase the converging action in accordance with the increase in the deflection. In the present invention, the potential lower than the anode potential does not need any dedicated power source because it is generated by dividing another potential in the cathode ray tube by a resistor, as has been described in the operation (17).

In the present invention, the process conditions such as the spot knocking for manufacturing the cathode ray tube are simplified by making a structure in which a lower potential than the anode potential is supplied from the outside of the cathode ray tube.

In the present invention, no dedicated power source is required because the potential lower than the anode potential is that of the focus electrode of the electron gun.

(19) In the present invention, in case the cathode ray tube is used in an image display device by generating the potential of the focus electrode of the electron gun by dividing another potential in the cathode ray tube by a resistor, as has been described in the operation (17), the device can dispense with the power source for the focus voltage so that the cost can be reduced.

(20) In case the fixed inhomogeneous electric field is established in the deflecting magnetic filed to correct the deflection aberration, as has been described in the operation (11), it is desired from practical purposes to exhibit the effect even it has a relatively low intensity. For this, the electron beam is required to have a proper diameter in that region.

Generally speaking, the electron beam takes a large diameter in the vicinity of the main lens in the cathode ray tube. The position of the deflection aberration correcting electrode is restricted by the distance from the main lens. The position of the deflection aberration correcting electrode is restricted by the distance from the deflecting magnetic field, as has been described in the operations (7) to (10). Hence, the position of the main lens is restricted by the distance from the deflecting magnetic field.

In the cathode ray tube such as an in-line type color picture tube or a color display tube, the deflecting magnetic field of the electron beam is generally made non-uniform for simplifying the convergence adjustment. Since, in this case, the main lens is positioned as far as possible from the deflecting magnetic field establishing portion so as to suppress the distortion of the electron beam by the deflecting magnetic field, the deflecting magnetic field establishing portion is usually set closer to the fluorescent face than the main lens of the electron gun.

(21) In the present invention, when the fixed inhomogeneous electric field is established in the deflecting magnetic field to correct the deflection aberration, the approach of the deflecting magnetic field establishing portion to the main lens is made possible by establishing that inhomogeneous electric field allowing for the distortion of the electron beam due to the aforementioned non-uniform deflecting magnetic field.

In the present invention, in case the maximum deflection angle of the cathode ray tube is 100 degrees or more, the optimum distance between the end portion of the magnetic material making up the core of the coil for establishing the deflecting magnetic field on the side apart from the fluorescent face and the face of the electron gun anode facing the focus electrode is within 60 mm.

(22) On the other hand, the length between the cathode of the electric gun and the main lens is desirably longer so that the beam spot diameter on the fluorescent face may be reduced by reducing the magnification of the image of the electron gun.

Thus, the cathode ray tube having an excellent resolution corresponding to those two actions necessarily has its axial length increased.

According to the present invention, however, by bringing the position of the main focus lens close to the fluorescent face with the length from the cathode of the electron gun to the main lens being unchanged, the image magnification of the electron gun can be further reduced to reduce the spot diameter of the electron beam on the fluorescent face and to shorten the axial length.

(23) Since the time period for the electron beams to experience the repulsion of the space charge is shortened as the position of the main lens comes closer to the fluorescent face, the beam spot diameter on the fluorescent face can be further reduced.

(24) In order to execute the contents similar to those of the operations (21) to (23), according to the present invention, the optimum distance between the deflecting magnetic field and the main lens in case the maximum deflection angle of the cathode ray tube is 100 degrees or more is such that the portion of the electron gun anode facing the main lens is contained in the magnetic field having 25% or more of the maximum magnetic flux density of the magnetic field for deflections in the scanning line direction or in the perpendicular direction.

(25) In order to execute the contents similar to those of the operations (21) to (24) more accurately, according to the present invention, the optimum distance between the deflecting magnetic field and the main lens in case the maximum deflection angle of the cathode ray tube is 100 degrees or more is such that it contains a portion having the quotient obtained by dividing the value B by the root of the value E being 0.004 millitesla or more per anode voltage of 1 V if the voltage at the fluorescent face of the cathode ray tube is at E V and if the magnetic flux density of the magnetic field of the aforementioned deflecting magnetic field for deflections in the scanning line direction or in the perpendicular direction at the portion of the electron gun anode facing the main lens is at B tesla.

(26) The optimum distance between the deflecting magnetic field and the main lens of the electron gun in the present invention in case the contents are similar to those of the operations (21) to (25) and in case the maximum deflection angle of the cathode ray tube is 85 degrees or more and less than 100 degrees is such that the portion corresponding to the operations (21) to (23) is 40 mm or less, the portion corresponding to the operation (24) is 15% or more, and the portion corresponding to the operation (25) is 0.003 millitesla or more.

(27) The optimum distance between the deflecting magnetic field and the main lens of the electron gun in the present invention in case the contents are similar to those of the operations (21) to (25) and in case the maximum deflection angle of the cathode ray tube is less than 85 degrees is such that the portion corresponding to the operations (21) to (23) is 170 mm or less, the portion corresponding to the operation (24) is 5% or more, and the portion corresponding to the operation (25) is 0.0005 millitesla or more.

(28) As seen from the operations (21) to (27), according to the present invention, the optimum distance between the deflecting magnetic field and the main lens of the electron gun can be shortened unlike the prior art. The optimum positional relationship in the present invention between the neck portion of the cathode ray tube and the main lens of the electron gun is located such that the face of the electron gun anode facing the main lens is within 15 mm toward the side opposite the fluorescent face from the end portion of the neck portion at the fluorescent face side.

In the prior art, the position of the main lens of the electron gun is apart from the deflecting magnetic field so that the feed of the potential to the electron gun anode is carried out from the inner wall of the neck portion of the cathode ray tube.

In the present invention, the position of the main lens of the electron gun need not be apart from the deflecting magnetic field but can be close to the fluorescent face so that the potential can be fed to the electron gun anode from other than the inner wall of the neck portion of the cathode ray tube.

Since a high electric field is established in a narrow space in the cathode ray tube, stabilization of the voltage withstanding characteristics is one of the important techniques for stabilizing the qualities. The maximum electric field intensity is located in the vicinity of the main lens of the electron gun. The electric field in the neighborhood further depends upon either a graphite film, which is applied to the inner wall of the neck portion of the cathode ray tube for feeding the potential to the electron gun, or a foreign substance residing in the cathode ray tube and caught by the inner wall of the neck portion.

In the present invention, the main lens of the electron gun can be set in a position closer to the fluorescent face than the neck portion to stabilize the voltage withstanding characteristics drastically.

(29) In the cathode ray tube, the cathode acting as a source for emitting the electron beam is frequently heated for operations by an electric heater. This heater has its heat transferred through the neck portion of the cathode ray tube to raise the temperature of the deflecting magnetic field establishing mechanism. This mechanism is troubled, if overheated, by an insufficient insulation because it is partially made of an organic material.

Since the main lens of the electron gun need not be positioned apart from the deflecting magnetic field but can be disposed close to the fluorescent face, according to the present invention, the distance between the heater and the mechanism will be shortened to overheat the mechanism.

Usually, this mechanism has its usable maximum temperature limited to about 110° C. by the properties of the material used. The heat transfer from the neck portion must be limited because it is usually designed to expect the room temperature of 40° C. and its self-heating contribution.

In order to avoid the aforementioned overheat, the power of the heater has to be reduced. In order to keep the temperature within that range, it is important in the present invention to set the optimum power consumption of the heater to 3 Watts or less for one cathode.

(30) Since the electron beam spot does not receive the influences of the deflecting magnetic field while it is positioned at the center of the fluorescent face, no countermeasure is required against the distortion due to the deflecting magnetic field. As a result, the lens action of the electron gun is the rotationally symmetric so that the electron beam spot diameter on the fluorescent face can be further reduced.

(31) According to the present invention, by establishing the fixed inhomogeneous electric field in the deflecting magnetic field to correct the deflection aberration and by feeding some electrodes of the electric gun with the dynamic voltage according to the deflection, the proper electron beam focusing action can be more achieved all over the area of the fluorescent face to establish the characteristics of high resolution all over the area of the fluorescent face. It is further possible to drop the dynamic voltage necessary.

(32) In the present invention, the fixed inhomogeneous electric field is established in the deflecting magnetic field to correct the deflection aberration. In addition, at least one of the electric fields to be established by a plurality of electrostatic lenses composed of a plurality of electrodes constituting the electron gun is made of the rotationally asymmetric electric field, to form an electrostatic lens for shaping the electron beam spot in a high current region at the central portion of the screen of the fluorescent face into a generally circular or rectangular form and for having such focusing characteristics that the proper focusing voltage acting in the electron beam scanning direction is higher than the proper focusing voltage acting in the direction perpendicular to the scanning direction; and an electrostatic lens for fitting the scanning direction diameter and the perpendicular diameter of the electron beam spot in the low current region at the central portion of the fluorescent face to the shadow mask pitch and the scanning line density in the scanning direction and in the perpendicular direction and for having such focusing characteristics that the proper focusing voltage acting in the scanning direction is higher than the proper focusing voltage acting in the perpendicular direction. The lens by those rotationally asymmetric electric field provides the satisfactory focusing characteristics having no Moire in the electron beam over the entire region on the screen of the fluorescent face and over the entire current range.

(33) Incidentally, the "rotationally asymmetric" used in the present invention means anything other than that which is expressed by loci of points located at an equal distance from the center of rotation, such as a circle. For example, the "rotationally asymmetric" beam spot is a non-circular beam spot.

(34) In the present invention, as described in the operation (28), the fixed inhomogeneous electric field is established in the deflecting magnetic field to correct the deflection aberration so that the main lens of the electron gun can be used closer to the deflecting magnetic field used in the cathode ray tube than the prior art.

Since the deflecting magnetic field also penetrates into the main lens of the electron gun, the electrode closer to the fluorescent face than the main lens has to be given a structure in which it is freed from the impingement of the electron beam. The optimum design of the present invention in the case of the electron gun having a plurality of electrodes and using the in-line arrayed three electron beams is such a single hole shared among the three electron beams as has no partition for the three electron beams in the shield cup to pass therethrough. At the same time, in case the electrode for establishing the fixed inhomogeneous electric field in the deflecting magnetic field to correct the deflection aberration is disposed closer to the fluorescent face than the hole which is formed in the bottom of the shield cup to transmit the electron beam therethrough to equalize the potential of the shield cup and the anode of the electron gun to that of the electrode for establishing the fixed inhomogeneous electric field in the deflecting magnetic field to correct the deflection aberration, an electric field penetration between the converging electrodes or the adjoining electrodes of different potentials for establishing the electric field can be promoted to improve the homogeneity of the resolution over the entire region of the fluorescent face.

(35) In case the in-line arrayed, three electron beams are used as the electron gun having a plurality of electrodes, it is important for the same reason for the operation (34) to enlarge the aperture diameter of the main lens of the electron gun.

In order to establish the fixed inhomogeneous electric field in the deflecting magnetic field thereby to correct the deflection aberration, according to the present invention, the aperture diameter, as taken in a direction perpendicular to the in-line, of the portion of the electron gun anode facing the main lens can be set to 0.5 times or more as large as that of the narrowest one of the plurality of apertures, through which the adjoining ones of the in-line arrayed three electron beams will pass, to promote the electric field penetration between the converging electrodes, that is, the adjoining electrodes having different potentials for establishing the electric fields thereby to improve the homogeneity of the resolution over the entire region of the fluorescent face.

(36) In case the in-line three electron beams are used as the electron gun having a plurality of electrodes, the optimum design of the present invention for further promoting the electric field penetration is made for the same reason as that of the operation (34) such that the structure of the aperture of the main lens of the electron gun contains an electric field shared among the three electron beams.

(37) In the present invention, in order that the in-line arrayed three electron beams may be used as the electron gun having a plurality of electrodes to establish the fixed inhomogeneous electric field in the deflecting magnetic field thereby to correct the deflection aberration, the portion of the fixed inhomogeneous electric field establishing electrode corresponding to the center one of the three electron beams and the portions of the same corresponding to the side electron beams can be given different structures to adjust the balance in the resolution among the three electron beams on the fluorescent face.

Moreover, the portions of the fixed inhomogeneous electric field establishing electrode, as correspond to the side ones of the three electron beams, can be given different structures between the side of the center electron beam in the in-line direction and in the opposite side to reduce the coma aberration due to the deflecting magnetic field.

Although the effects of the individual techniques of the present invention have been described hereinbefore, two or more of them can be combined in the cathode ray tube to improve the homogeneity of resolution over the entire region of the fluorescent face and the resolution for the cathode current range at the center of the fluorescent face and to shorten the axial length of the cathode ray tube.

By using the cathode ray tube described above, moreover, it is further possible to provide an image display device which can improve the resolution over the entire region of the fluorescent face and the resolution for the cathode current range at the center of the fluorescent face and which has a shorter depth.

Next, here will be described the mechanism for improving the focusing characteristics and resolution of the cathode ray tube by using the electron gun according to the present invention.

FIG. 72 is a schematic diagram for explaining the section of a shadow mask type color cathode ray tube equipped with the in-line electron gun. In FIG. 72, reference numeral 7 designates a neck; numeral 8 a funnel; numeral 9 an electron gun mounted in the neck 7; numeral 10 an electron beam; numeral 11 a deflection yoke; numeral 12 a shadow mask; numeral 13 a fluorescent film forming the fluorescent face; and numeral 14 a panel for screen).

In the cathode ray tube of this kind, as shown in FIG. 72, the electron beam 10 emitted from the electron gun 9 is guided to pass through the shadow mask 12 while being deflected horizontally and vertically by the deflection yoke 11, to fluoresce the fluorescent film 13. This fluorescing pattern is observed as an image from the side of the panel 14.

FIG. 73 is an explanatory diagram showing an electron beam spot in case the periphery of a screen is caused to fluoresce with an electron beam spot having a circular shape at the central portion of the screen.

In FIG. 73, the reference numeral 14 designates the screen; numeral 15 a beam spot at the central portion of the screen; numeral 16 beam spots at the ends of the horizontal direction (i.e., X—X direction) of the screen; numeral 17 a halo; numeral 18 beam spots at the ends of the vertical direction (i.e., Y—Y direction) of the screen; and numeral 19 beam spots at the ends of the diagonal directions (i.e., corner portions) of the screen.

Moreover, FIG. 74 is an explanatory diagram showing a distribution of the deflecting magnetic field of a cathode ray tube. Letter H indicates the distribution of the horizontally deflecting magnetic field, and letter V indicates the distribution of the vertically deflecting magnetic field.

In order to simplify the convergence adjustment, the color cathode ray tube of recent years uses the pin cushion type non-uniform magnetic field distribution as the horizontally deflecting magnetic field H and the barrel type non-uniform magnetic field distribution as the vertically deflecting magnetic field V, as shown in FIG. 74.

The shape of the light emitting spot by the electron beam 10 is not circular in the peripheral portion of the screen partly because of that magnetic field distribution, partly because the electron beam 10 has different orbit's at the central portion and in the periphery of the fluorescent face (or the screen), and partly because the electron beam 10 impinges upon the peripheral portion of the screen obliquely with respect to the fluorescent film 13.

As shown in FIG. 73, the beam spots 16 at the horizontal ends are horizontally elongated and have the haloes 17, although the central spot 15 is circular. As a result, the beam spots 16 at the horizontal ends are enlarged and are made ambiguous at their contours by the haloes 17 so that the resolution is deteriorated to degrade the picture quality seriously.

In case, moreover, the electron beam 10 has a low current, its vertical diameter excessively reduced to cause an optical interference with the vertical pitch of the shadow mask 12 so that the Moire phenomena are exhibited to degrade the picture quality.

On the other hand, the spots 18 at the vertical ends of the screen are attended by the haloes 17 to degrade the picture quality as the electron beam 10 is converged upward and downward (i.e., in the vertical directions) to have a vertically shrunk shape by the vertically deflecting magnetic field.

The electron beam spots 19 at the corner portions of the screen are horizontally elongated like the aforementioned spots 16 and vertically shrunk like the aforementioned spots 18. In addition, the electron beam 10 is rotated to establish the haloes 17 and to increase the diameter of the light emitting spots themselves so that the picture quality is seriously degraded.

FIG. 75 is a schematic diagram showing an electronic optical system of the electron gun for explaining a deformation of the electron beam spot. The aforementioned system is replaced by an optical system so as to facilitate the understanding.

In FIG. 75, the upper half presents a section of the screen, as taken in the vertical (Y—Y) direction, and the lower half presents a section of the screen, as S taken in the horizontal (X—X) direction.

Reference numerals 20 and 21 designate pre-focus lenses; numeral 22 a pre-stage main lens; and numeral 23 a main lens. These lenses constitute the electronic optical system corresponding to the electron gun of FIG. 72. Moreover, numeral 24 designates a lens established by the vertically deflecting magnetic field, and numeral 25 designates an equivalent lens which includes a lens established by the horizontally deflecting magnetic field and a lens for apparently extending the electron beam in the horizontal directions by the deflections as a result that the electron beam obliquely impinges upon the fluorescent film 13.

First of all, an electron beam 27 emitted from a cathode K and appearing in the vertical section of the screen establishes a crossover P at a distance $l_2$ from the cathode K between the pre-focus lenses 20 and 21 and is then converged toward the fluorescent film 13 by the pre-stage main lens 22 and the main lens 23.

The electron beam passes through an orbit 28 at the central portion of the screen, in which the deflection is zero, and impinges upon the fluorescent film 13. At the peripheral portion of the screen, on the contrary, the electron beam is vertically shrunk through an orbit 29 by the action of the lens 24 caused by the vertically deflecting magnetic field to form a vertically shrunk beam spot. Because of the spherical aberration of the main lens 23, moreover, the part of the electron beam is focused, as indicated by an orbit 30, before it reaches the fluorescent film 13. This premature focusing forms the haloes 17 of the beam spot 18 at the vertical ends of the screen and the haloes 17 of the beam spots 19 at the corner portions, as shown in FIG. 73.

On the other hand, an electron beam 31 emitted from the cathode K and appearing in the horizontal section of the screen is converged like the aforementioned electron beam 27 in the vertical direction by the pre-focus lenses 20 and 21, the pre-stage main lens 22 and the main lens 23 so that it passes through an orbit 32 at the central portion of the screen, in which the deflecting magnetic field has a zero action, and impinges upon the fluorescent film 13.

Even in the region having a deflecting magnetic field, the electron beam is diverged into a horizontally elongated spot shape along an orbit 33 by the diverging action of the lens 25 established by the horizontally deflecting magnetic field but without any halo in the horizontal directions.

However, even at the horizontal end portions 16 of FIG. 73 in which no vertically deflecting action is established because the distance between the main lens 23 and the fluorescent film 13 is larger than that at the central portion of the screen, part of the electron beam is focused in the vertical section before it reaches the fluorescent film 13, so that the haloes 17.

If the spot of the electron beam of the electron beam is shaped circular at the central portion of the screen in the rotationally symmetric lens system which is constructed to make the lens system of the electron gun common to the horizontal direction and the vertical direction, the spot shape of the electron beam is distorted in the peripheral portion of the screen to degrade the picture quality seriously.

FIG. 76 is an explanatory diagram showing means for suppressing degradation in the picture quality in the peripheral portion of the screen, as described in FIG. 75. The same reference numerals as those of FIG. 75 designate the same portions.

As shown in FIG. 76, the converging action of a main lens 23-1 in the vertical (Y—Y) section of the screen is made weaker than that of the main lens 23 in the horizontal (X—X) section. As a result, the orbit of the electron beam becomes an orbit as indicated at 29 even after having passed through the lens 24 established by the vertical deflecting magnetic field so that such an extreme vertical shrinkage as has been described with reference to FIG. 73 does not occur and haloes do not occur so easily. However, the orbit 28 at the central portion of the screen is shifted in the direction to increase the spot diameter of the electron beam.

FIG. 77 is a schematic diagram for explaining the electron beam spot shape on the fluorescent face 14 in case the lens system shown in FIG. 76 is used. The haloes are suppressed at the beam spots 16 of the horizontal ends. The beam scots 18 of the vertical ends and the beam spots 19 of the corner portions, i.e., the beam spots of the peripheral portions of the screen so that the resolutions at those portions are improved.

In view of the beam spot 15 at the central portion of the screen, however, the vertical spot diameter dY is larger than the horizontal spot diameter dX so that the vertical resolution drops.

Therefore, the object of improving the resolutions of the entire screen at the same time is not basically solved by making the rotationally asymmetric electric field system in which the converging effects of the main lens 23 are different between the vertical direction and the horizontal direction of the screen.

FIG. 78 is a schematic diagram showing an electronic optical system of the electron gun which has not the lens intensity of its main lens 23 made rotationally asymmetric but the lens intensity of its pre-focus lens 21 increased in a horizontal direction (X—X). The electron beam spot diameter of the fluorescent film 13, as taken in the horizontal direction, can be reduced by making the intensity of a horizontal pre-focus lens 21-1 for diverging the image of the crossover point P higher than that of the vertical pre-focus lens to increase the angle of incidence of the electron beam 31 into the pre-stage main lens 22 thereby to enlarge the diameter of the electron beam to pass through the main lens 23. However, the electron beam orbit in a vertical direction of the screen is similar to that shown in FIG. 75 so that it has no effect for suppressing the halo 28.

FIG. 79 is a schematic diagram showing the electronic optical system of an electron gun in which a halo suppressing effect is added to the construction of FIG. 77. The pre-stage main lens is given an increased lens intensity in the vertical (Y—Y), as indicated at 22-1, the vertical electron beam orbit of the main lens 23 comes close to the optical axis to form a focusing system having an increased focal depth so that the halo 28 becomes inconspicuous to improve the resolution.

FIG. 80 is a schematic diagram for explaining the spot shape of the electron beam on the screen 14 when the lens system having the construction shown in FIG. 79 is used. It is seen that an excellent resolution having no halo all over the screen is achieved, as indicated by the beam spots 15, 16, 18 and 19.

The description thus far made is directed to the electron beam spot shapes in case the electron beam has a relatively high current (i.e., in a high current range). In case of the electron beam has a low current (i.e., in a low current range), however, the orbit of the electron beam passes only near the axis of the focusing system so that the difference between the horizontal and vertical lens intensities of the lenses 21, 22 and 23 having large apertures exerts little influence. As indicated at 34, 35, 36 and 37 in FIG. 80, the beam spots are circular (at 34) at the central portion of the screen, horizontally elongated (at 35, 36) or obliquely elongated (at 37) in the peripheral portions of the screen to cause the Moire phenomena. Thus, the resolution drops as the transverse (or horizontal) diameters of the beam spots increase.

In order to solve this problem, it is necessary to deal with the lens which has a small aperture and which is so positioned that the influences of rotationally asymmetry of the lens intensity extend near the axis of the focusing system.

FIG. 81 is a schematic diagram showing the electron gun optical system for explaining the orbit of an electron beam for a low current. In this case, the distance $l_2$ from the cathode K to the crossover point P is shorter than the distance $l_1$ in FIG. 75.

FIG. 82 is a schematic diagram showing the optical system of the electron gun in case the lens intensity of a diverging lens in the pre-focus lens is increased in the vertical (Y—Y) direction of the screen. The distance $l_3$ to the crossover point P from the cathode K is made longer than the aforementioned distance $l_2$ by increasing the vertical intensity of the diverging lens composing the pre-focus lens 20.

As a result, the position for the electron beam 27 to enter the pre-focus lens 21, as taken in the vertical section, comes closer to the axis than that in the case of FIG. 81 so that the lens effects of the lenses 21, 22-1 and 23 are weakened to provide a focusing system having a larger focal depth in the direction vertical of the screen.

However, the influences at the individual lenses for the high current range and for the low current range are not completely independent so that the lens effect of the pre-focus lens 20-1, as taken in the vertical direction of FIG. 82, exerts influences upon the spot shape of the electron beam for the high current range. Thus, it is necessary to balance the entire system by making use of the characteristics of the individual lenses. Especially, the structure of the main lenses to be adopted and the picture qualities to be improved differ with applications of the cathode ray tube. Therefore, the positions of the rotationally asymmetric lenses and the intensities of the individual lenses are not uniquely determined.

In respect of the application of the ordinary cathode ray tube, as described above, a lens for establishing the rotationally asymmetric electric field in different portions for the high current range and for the low current range has to be provided for improving the resolution for the entire current range. Moreover, the rotationally asymmetry of each lens is limited in the change of the electric field intensity. In dependence upon the lens portion, moreover, the beam shape is extremely distorted to cause the drop of the resolution if the intensity of the rotationally asymmetric electric field is increased.

The means thus far described is a general one for suppressing the drop of the focusing characteristics due to the deformation of the spot of the electron beam. For this purpose, the actual electron gun is exemplified by one using the focusing voltage, as described hereinbefore, and one using the optical focusing voltage varying dynamically in accordance with the deflection angle on the screen of the cathode ray tube.

These two electron guns individually have merits and demerits. The electron gun using the fixed focusing voltage has a low cost and a simple power source circuit for feeding the focusing voltage so that its circuit cost is reasonable. Despite of these merits, however, the optimum focused states cannot be achieved at the individual positions on the screen of the cathode ray tube because of the astigmatic correction. As a result, the beam spots have larger diameters than optimum beam spots individually focused individually points.

On the other hand, the electron gun using the optimum focusing voltage varying dynamically in accordance with the deflection angle on the screen of the cathode ray tube can achieve excellent focusing characteristics at the individual points on the screen. Despite this merit, however, the structure of the electron gun and the power source circuit for feeding the focusing voltage are complicated, and it takes a long time to set the focusing voltage on the assembly line of the TV set or the display terminal, so that the production cost is raised.

The present invention contemplates to provide a crt using an electron gun which has the individual merits of the above-specified two structures while eliminating the demerits and which also has such a third merit of a small axial length as could not be achieved by the two structures.

BRIEF DESCRIPTION;OF THE DRAWINGS

Figure 5:
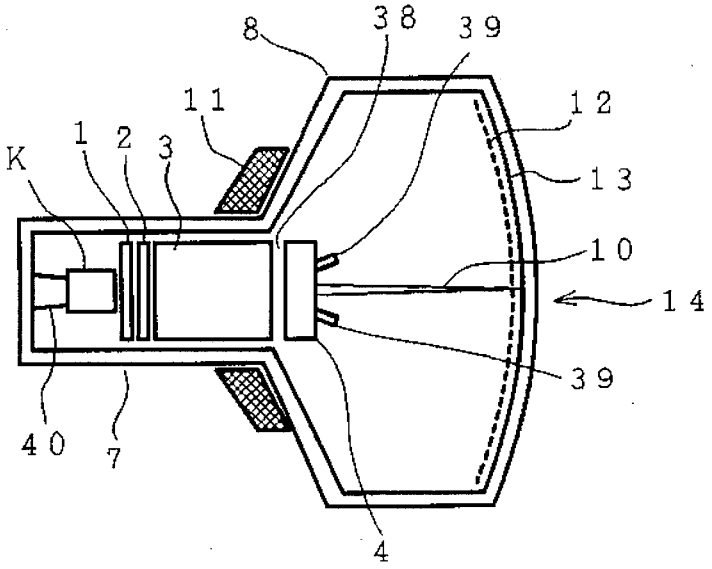
FIG. 5 is a schematic section for explaining a first embodiment of the cathode ray tube according to the present invention.
Figure 43A:
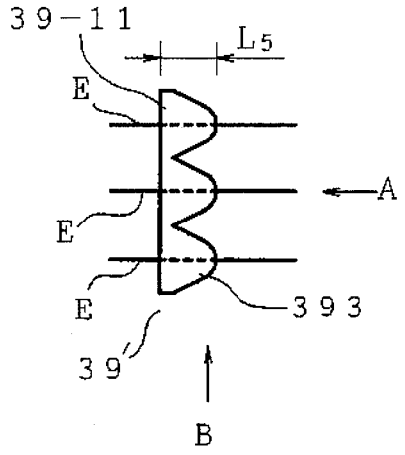
Figure 43B:
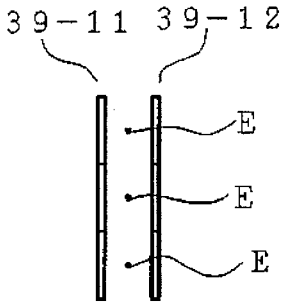
Figure 43C:
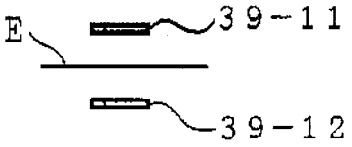
Figure 44A:
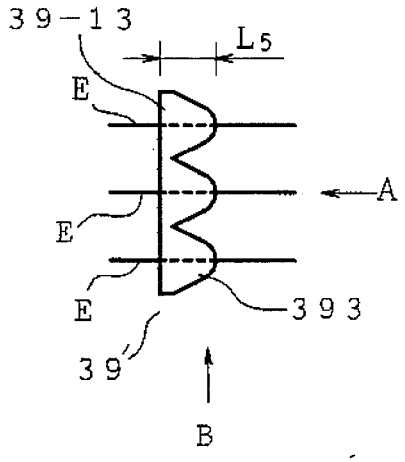
Figure 44B:
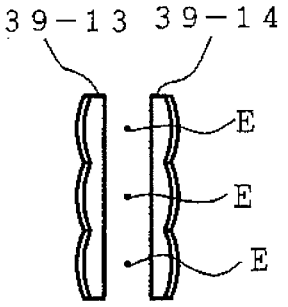
Figure 44C:
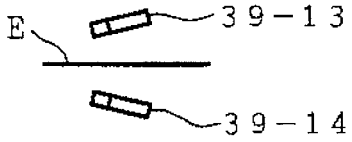
Figure 51:
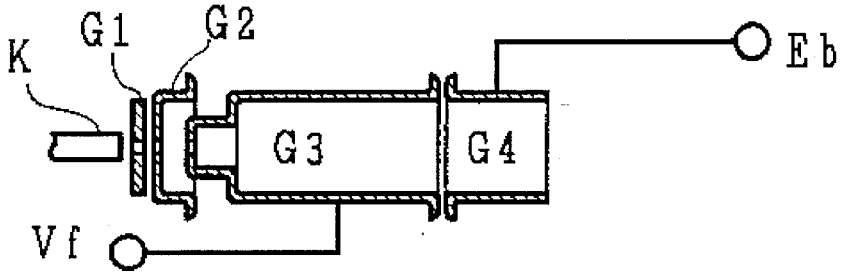
FIG. 51 PRIOR ART
Figure 52:
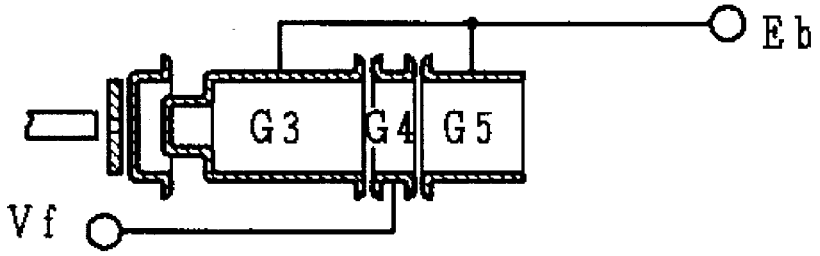
FIG. 52 PRIOR ART
Figure 53:
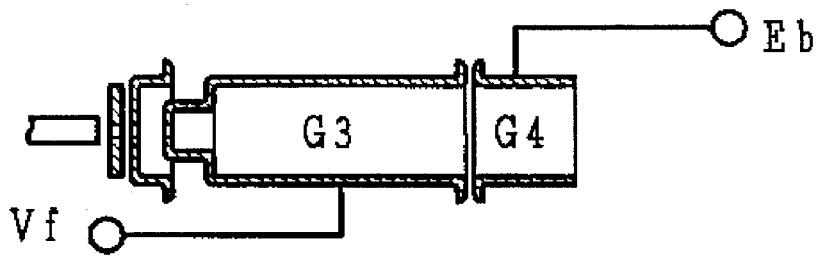
FIG. 53 PRIOR ART
Figure 54:
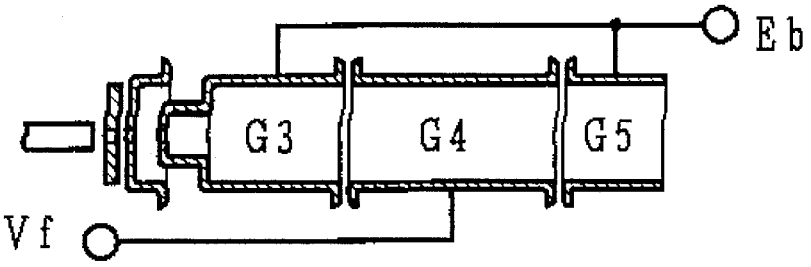
FIG. 54 PRIOR ART
Figure 56:
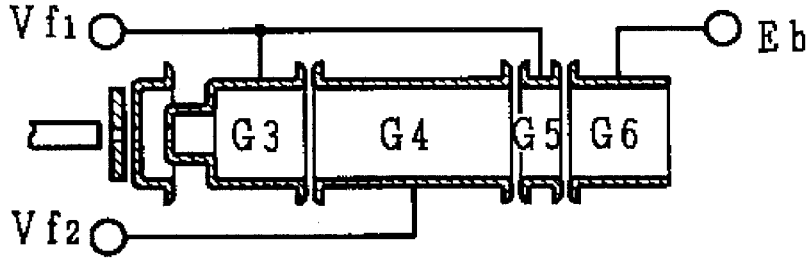
FIG. 56 PRIOR ART
Figure 57:
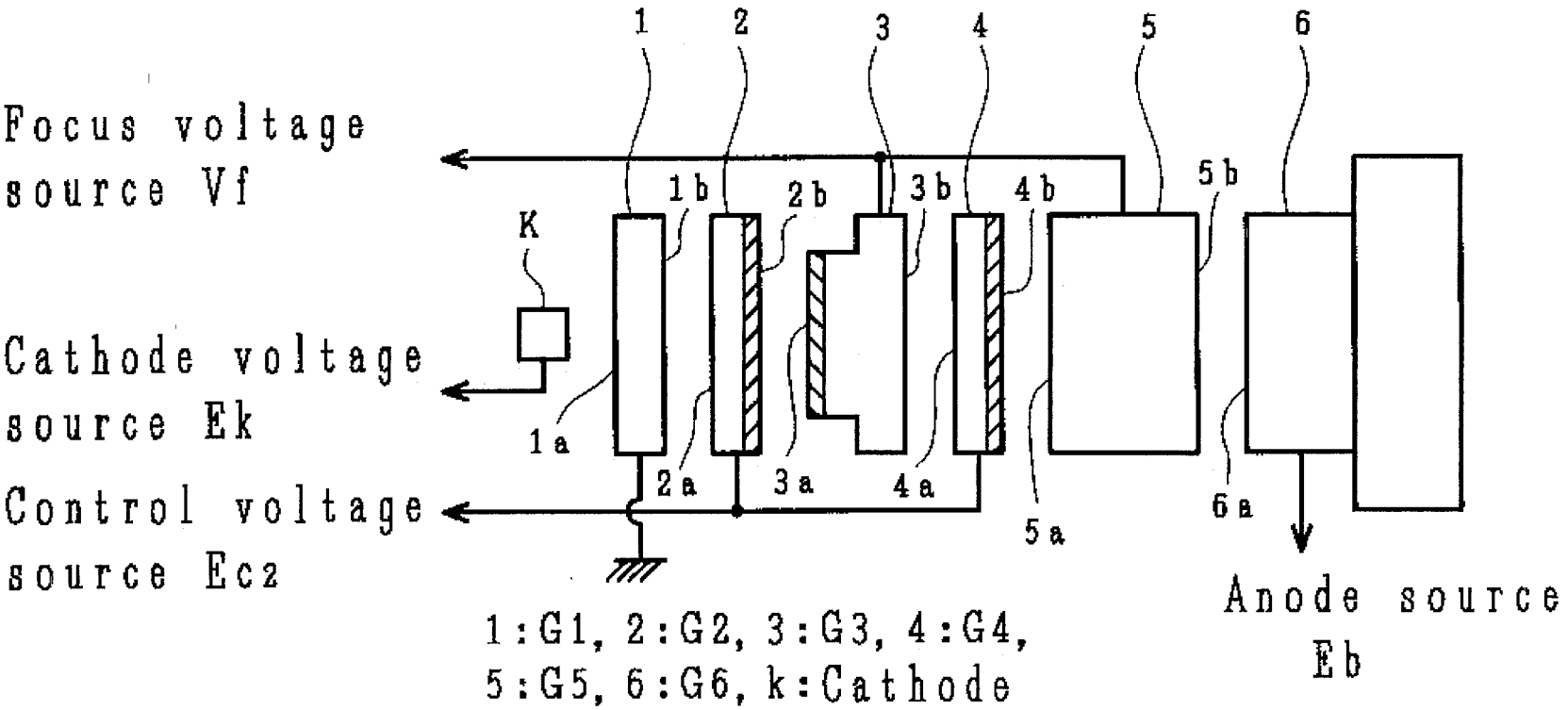
FIG. 57 PRIOR ART
Figure 58:
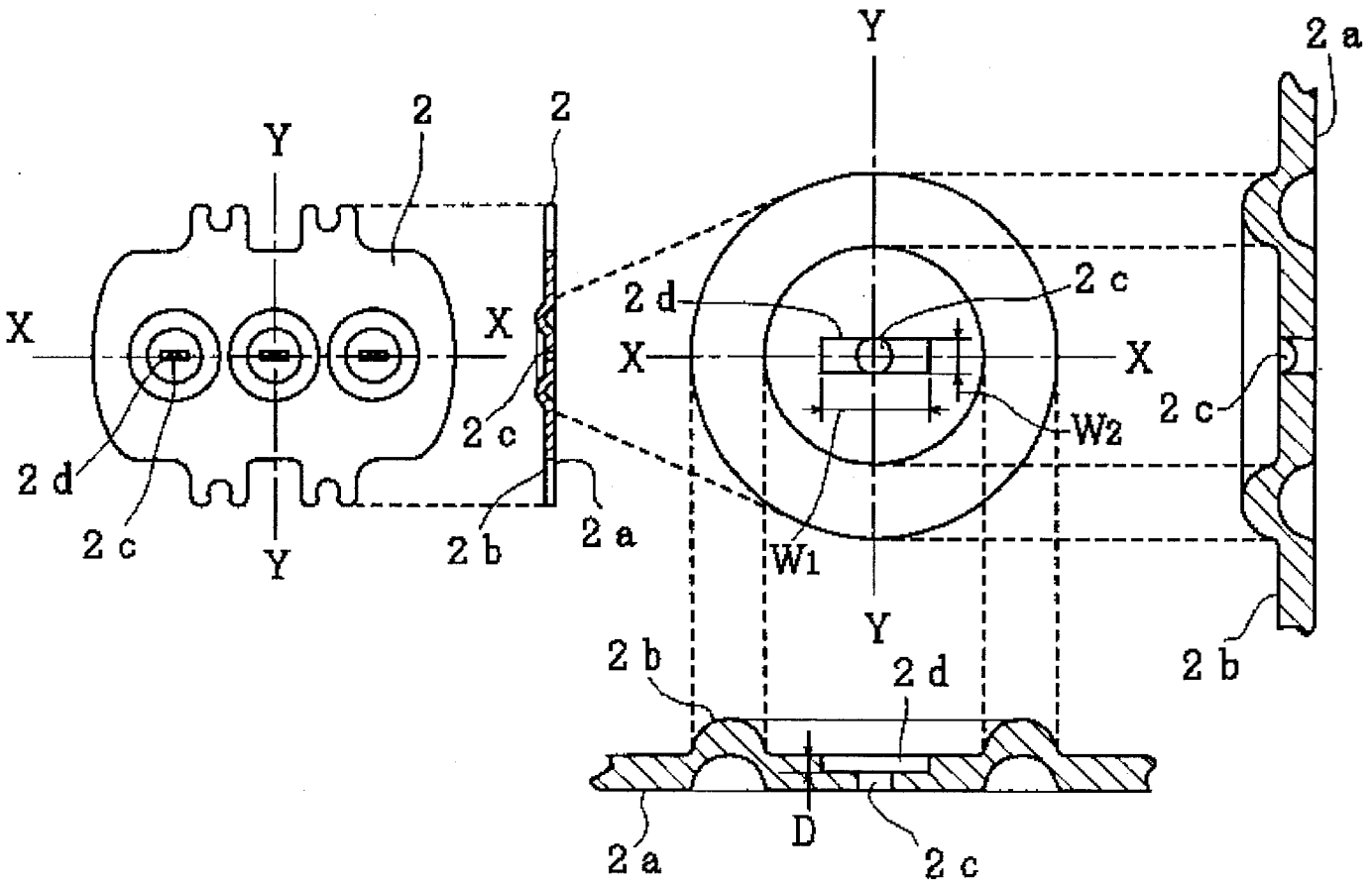
FIG. 58 PRIOR ART
Figure 59A:
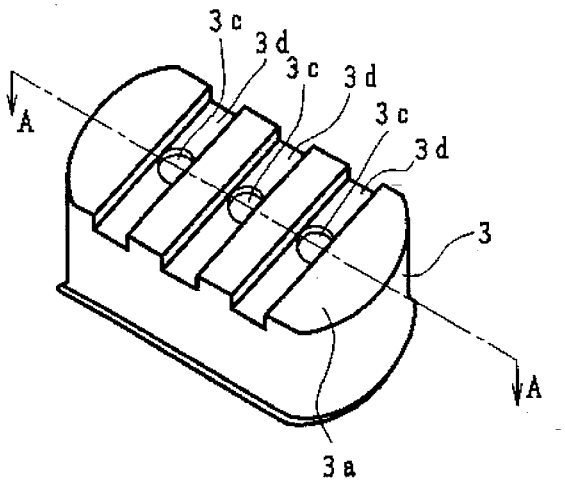
FIG. 59A PRIOR ART
Figure 59B:
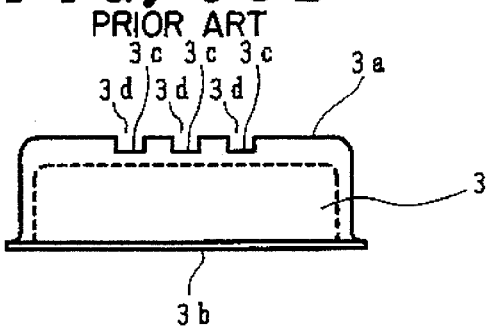
FIG. 59B PRIOR ART
Figure 60A:
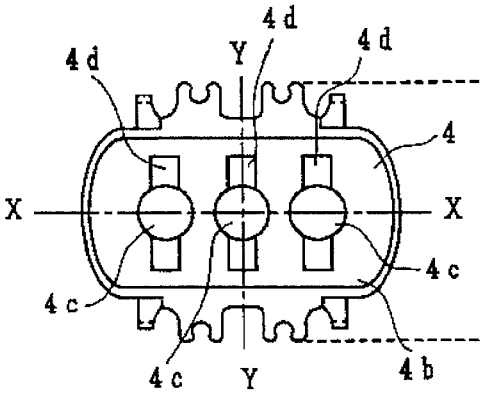
FIG. 60A PRIOR ART
Figure 60B:
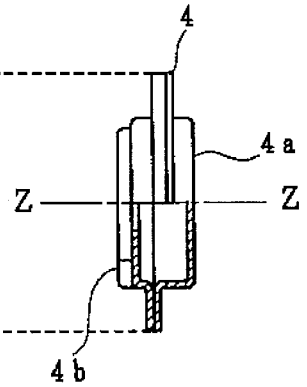
FIG. 60B PRIOR ART
Figure 61:
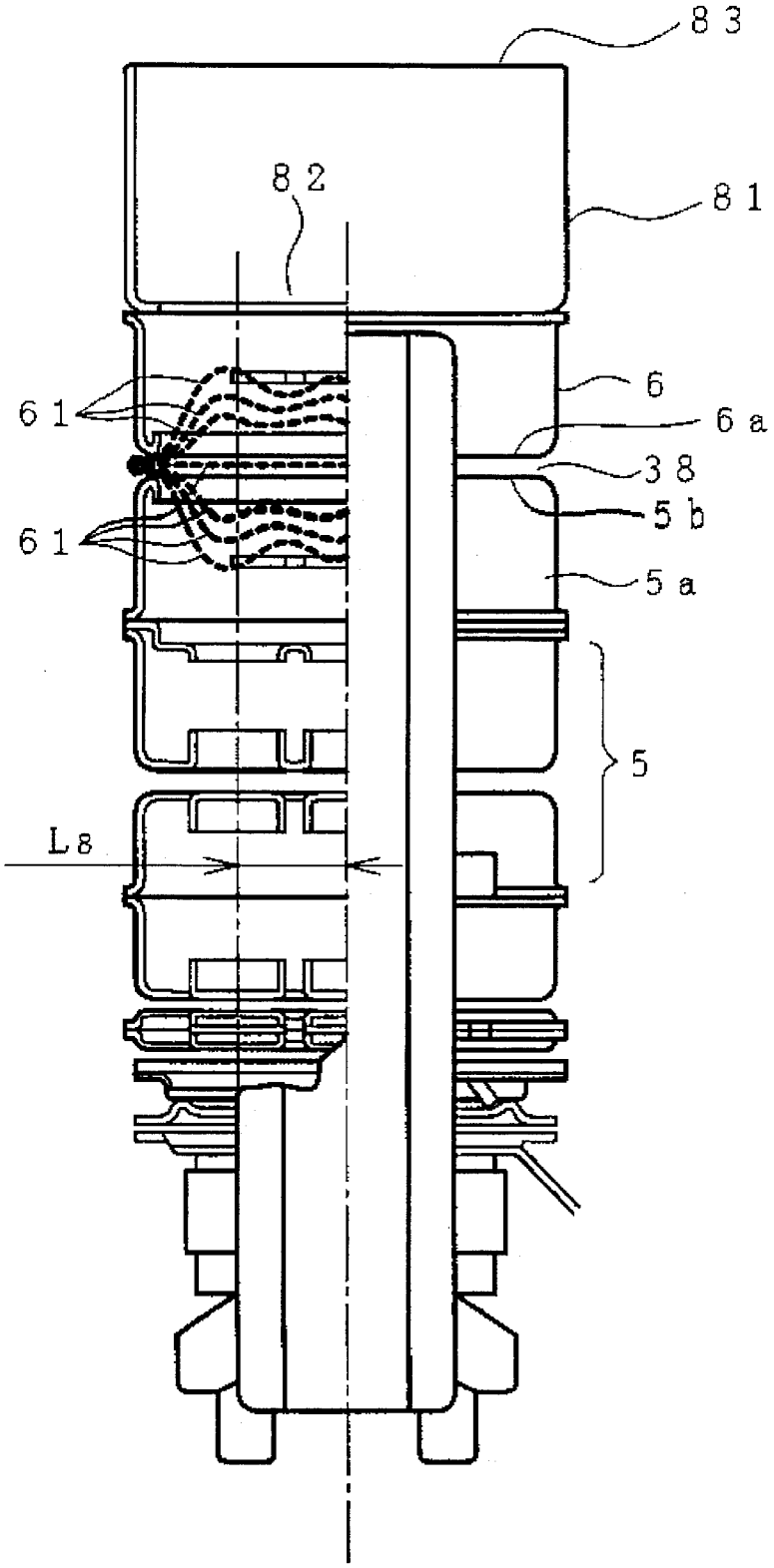
FIG. 61 PRIOR ART
Figure 62A:
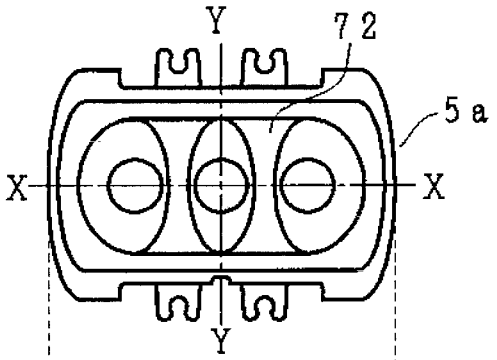
FIG. 62A PRIOR ART
Figure 62B:
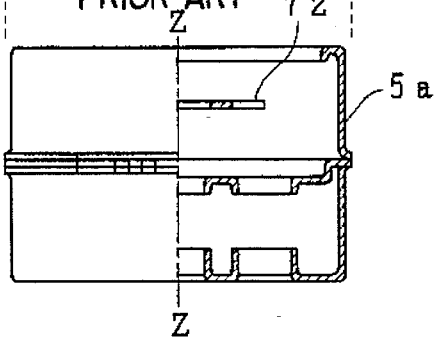
FIG. 62B PRIOR ART
Figure 63A:
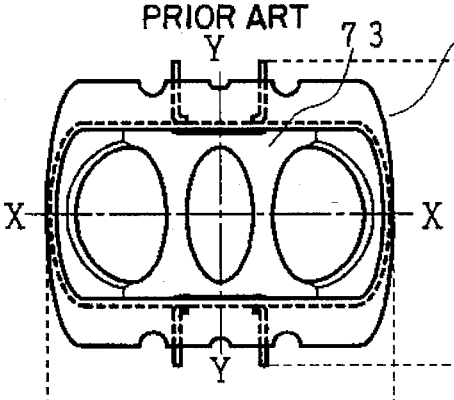
FIG. 63A PRIOR ART
Figure 63C:
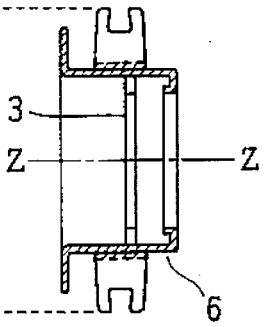
FIG. 63C PRIOR ART
Figure 63B:
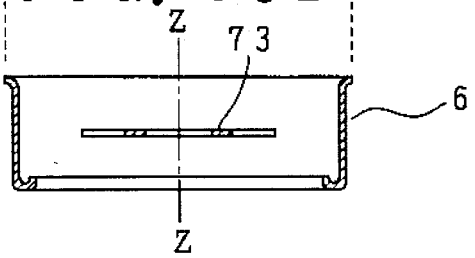
FIG. 63B PRIOR ART
Figure 64A:
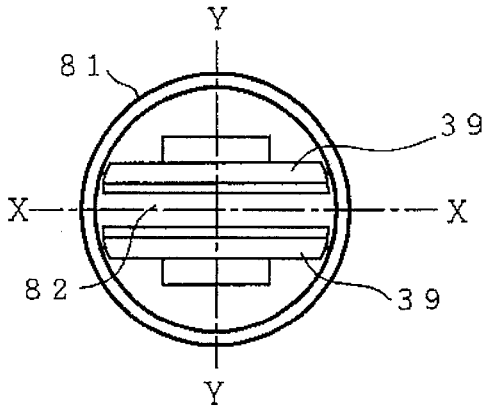
Figure 64B:
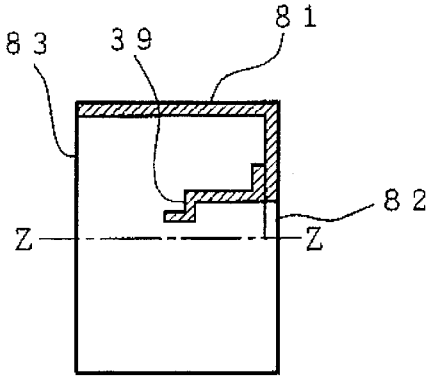
Figure 65A:
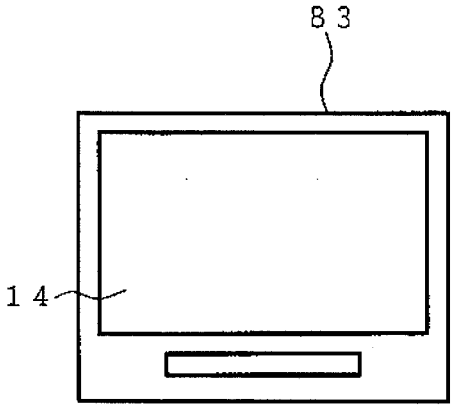
Figure 66:
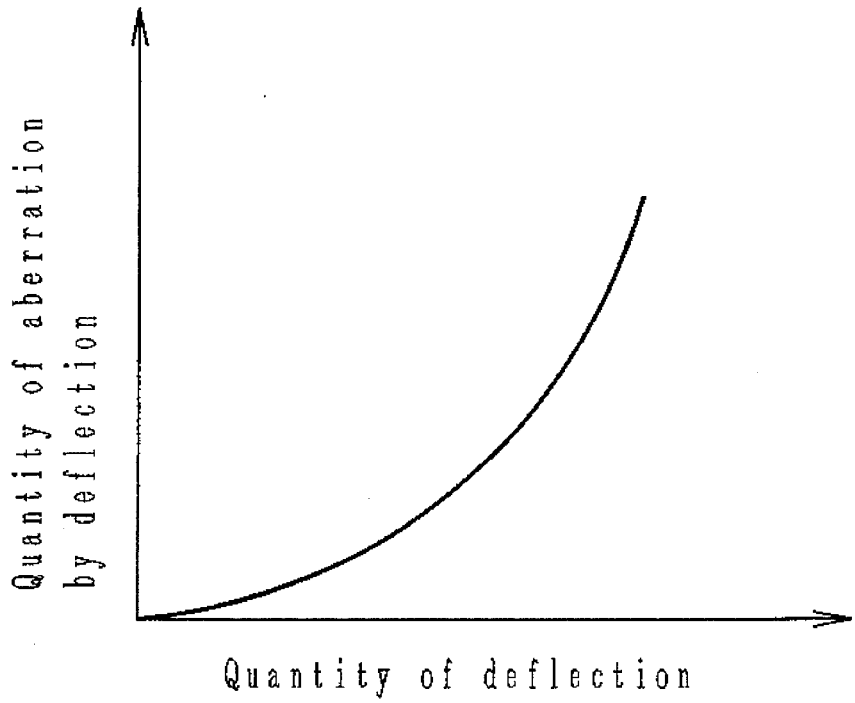
Figure 67:
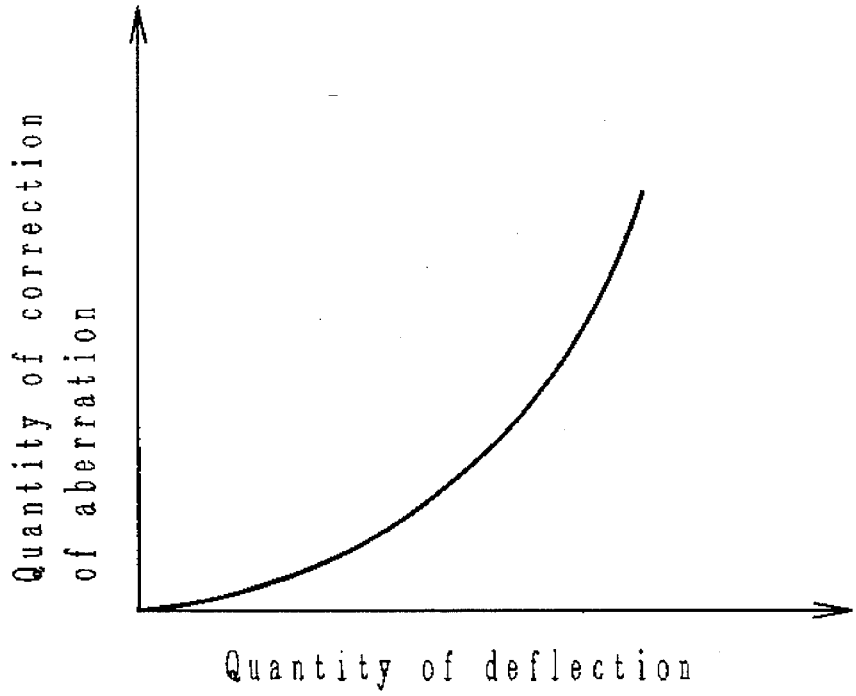
Figure 68:
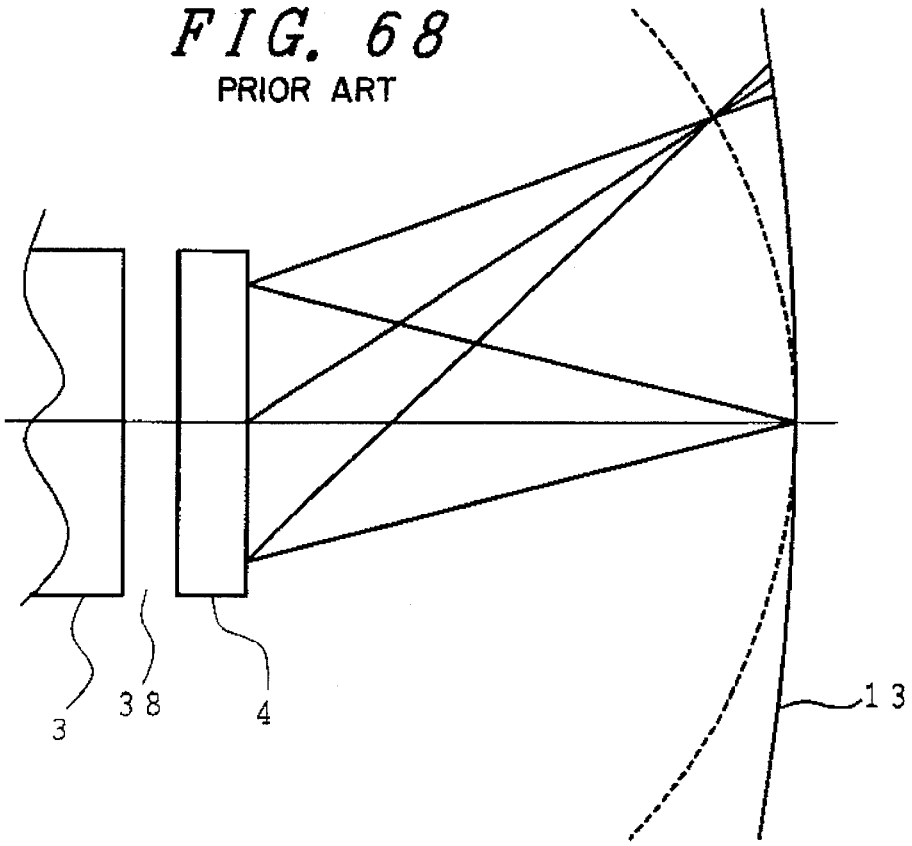
FIG. 68 PRIOR ART
Figure 69:
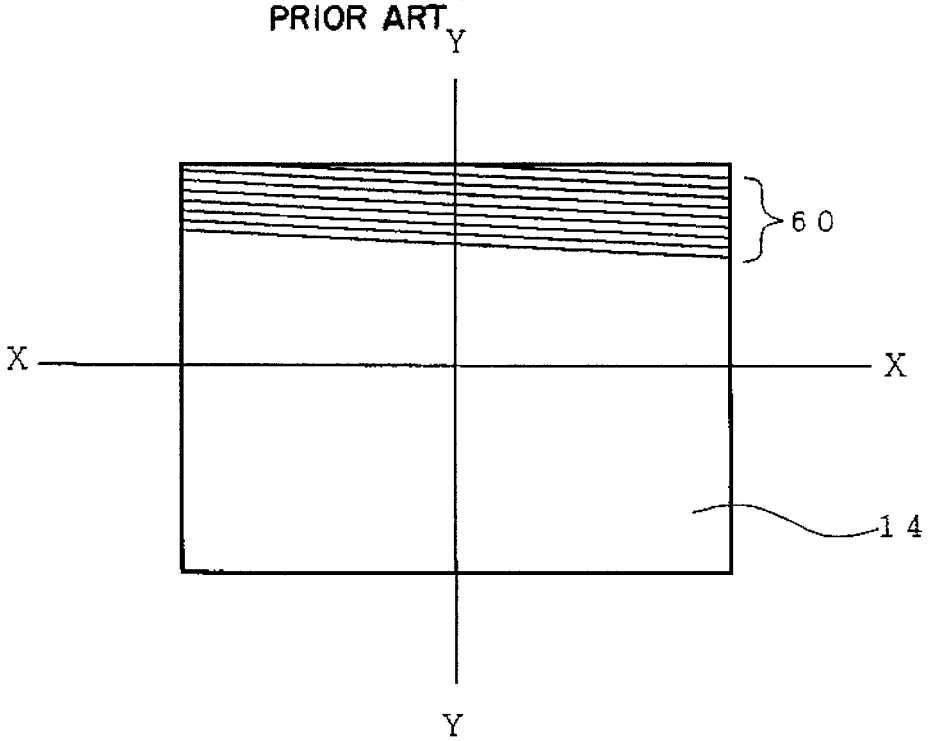
FIG. 69 PRIOR ART
Figure 70A:
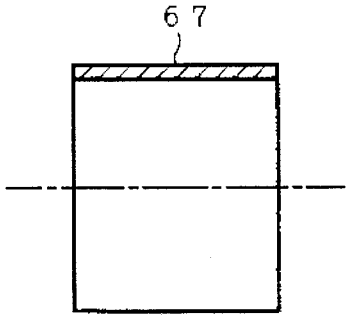
Figure 70B:
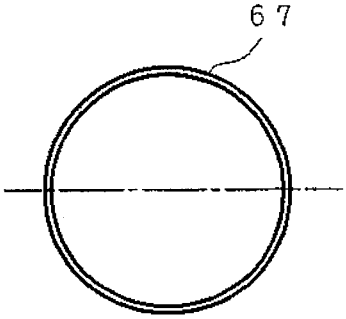
Figure 70E:
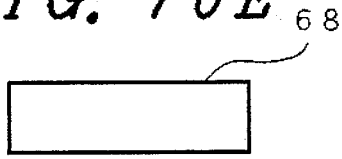
Figure 70C:
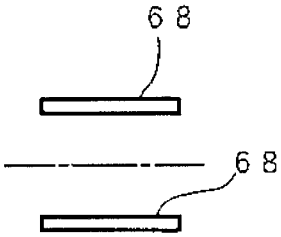
Figure 70D:
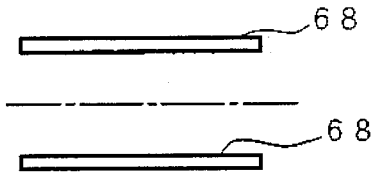
Figure 71:
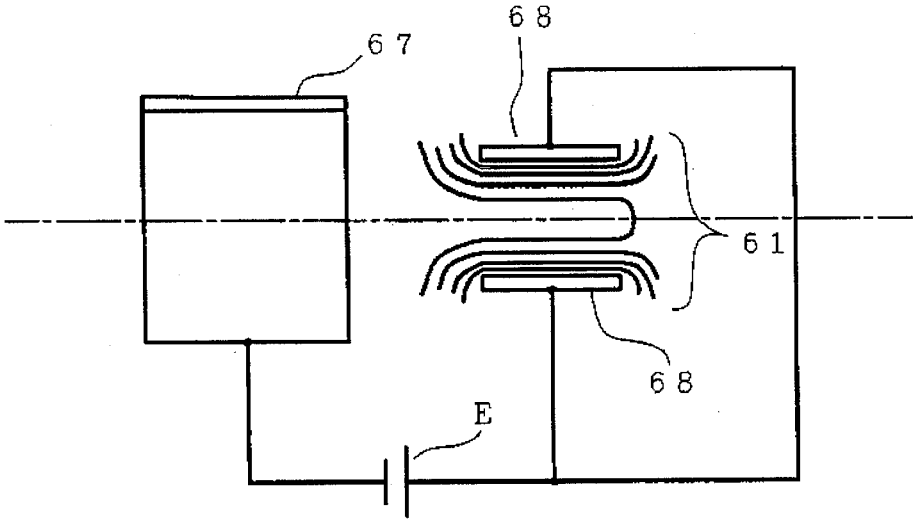
Figure 72:
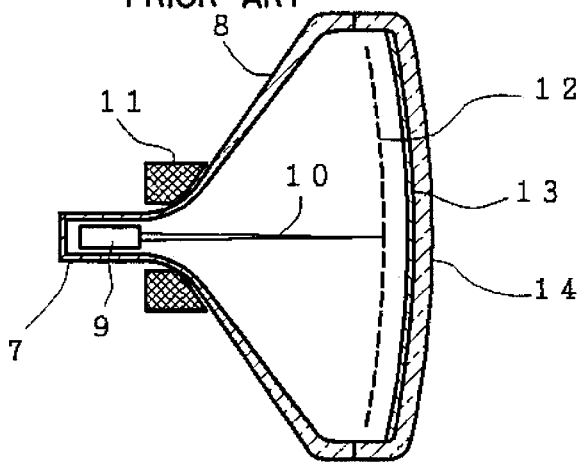
FIG. 72 PRIOR ART
Figure 73:
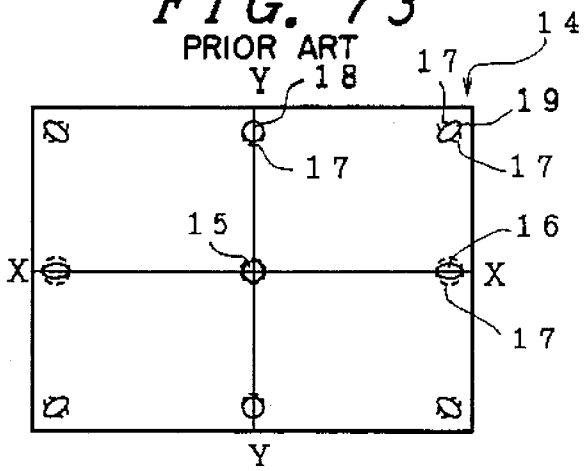
FIG. 73 PRIOR ART
Figure 74:
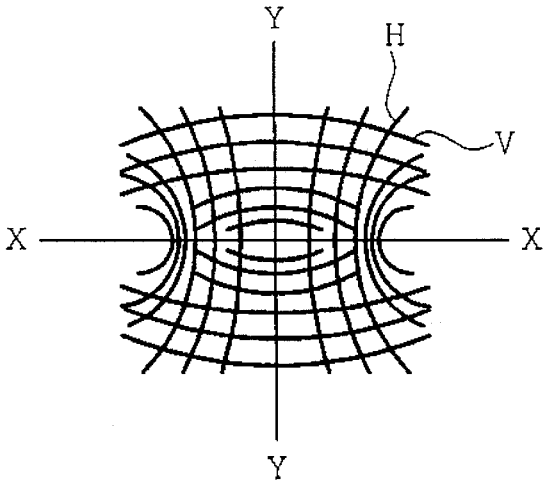
FIG. 74 PRIOR ART
Figure 75:
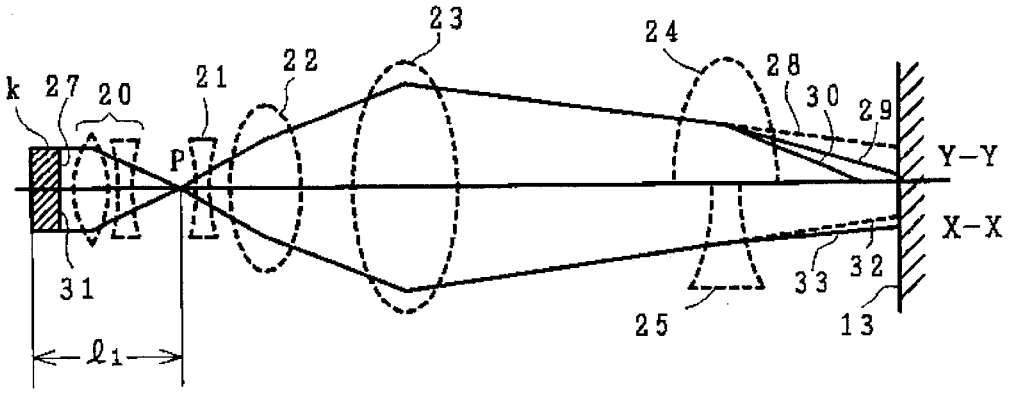
Figure 76:
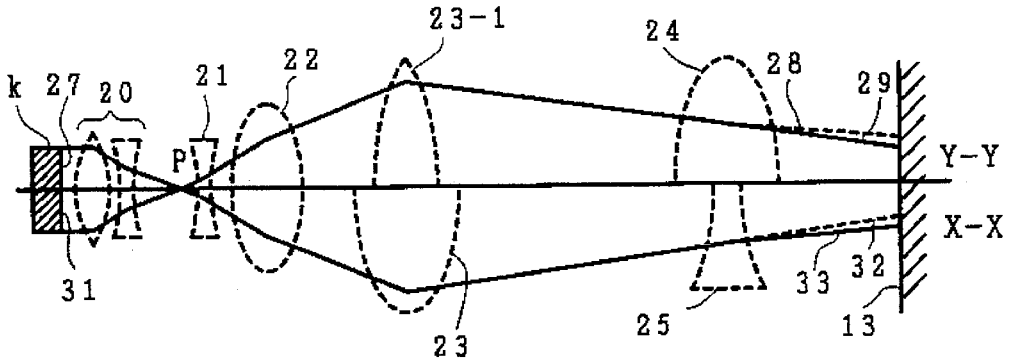
Figure 77:
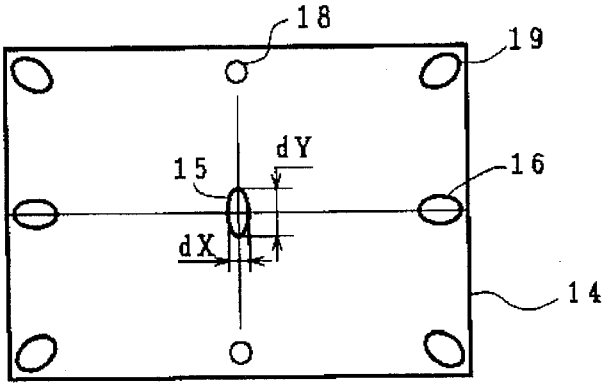
Figure 78:
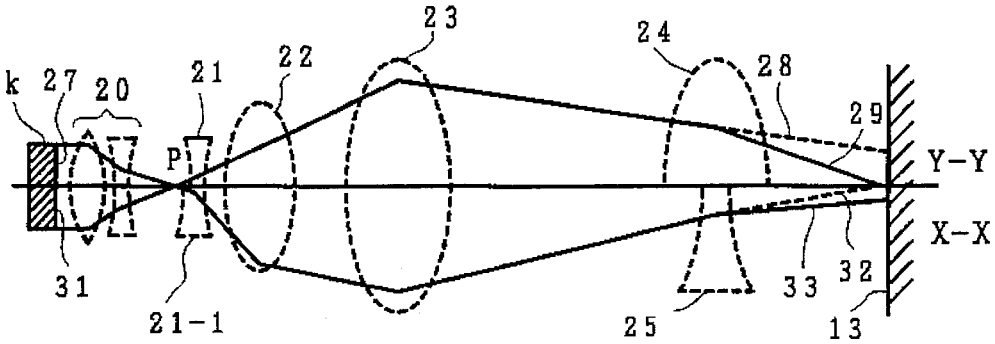
Figure 79:
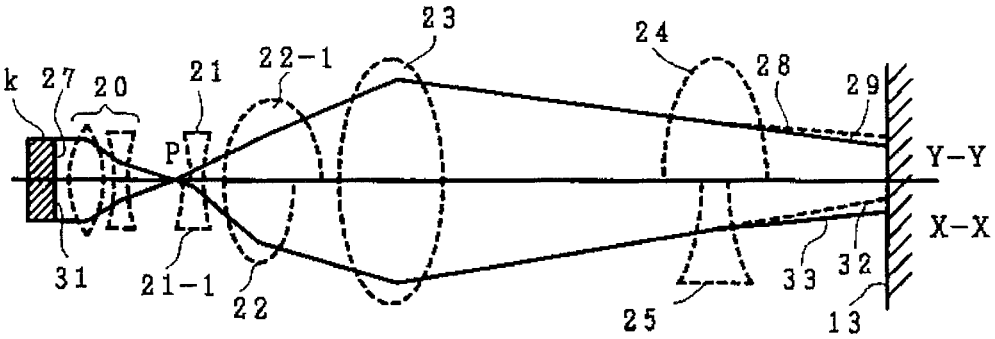
Figure 80:
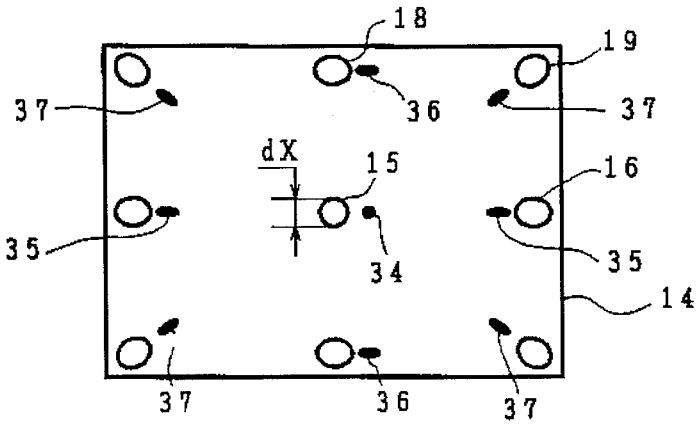
Figure 81:
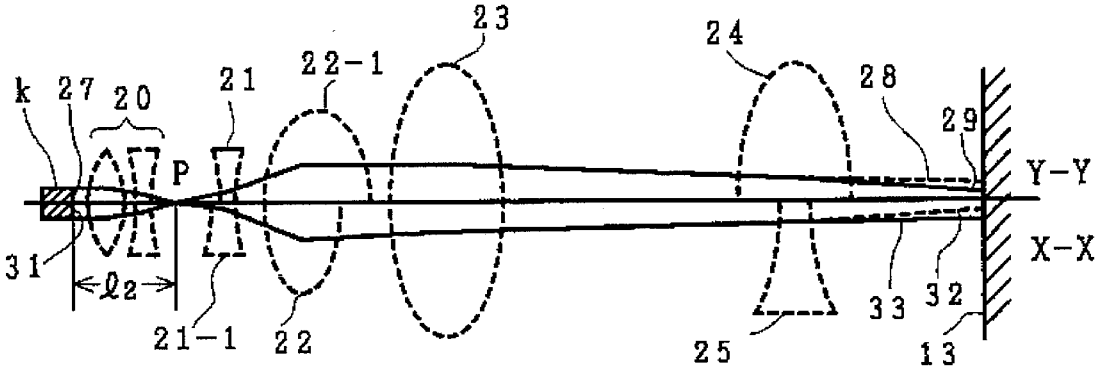
Figure 82:
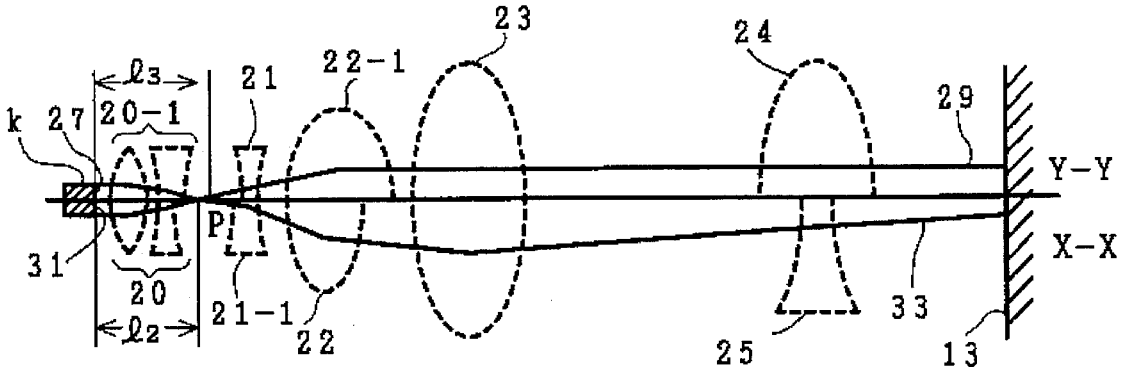
Figure 83:
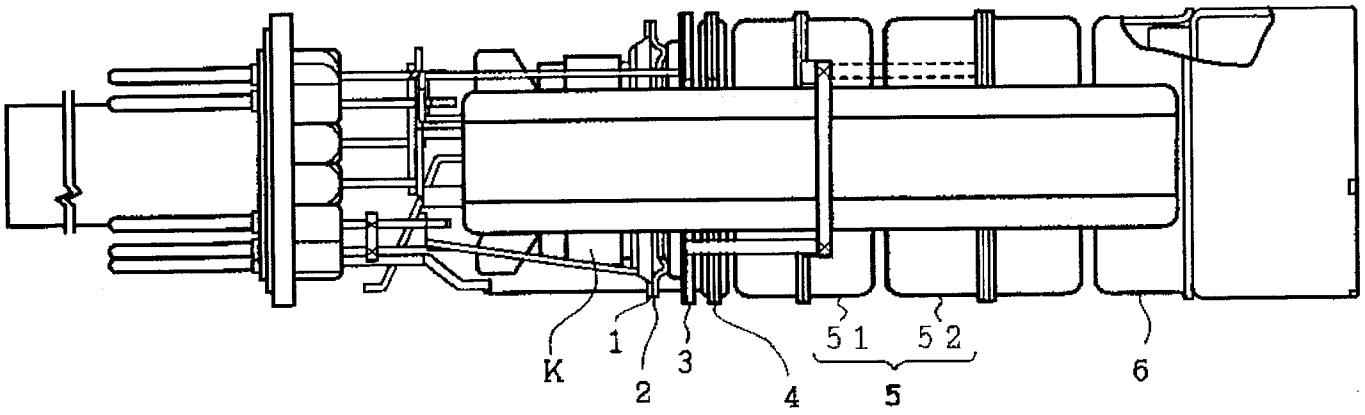
FIG. 83 PRIOR ART
Figure 84:
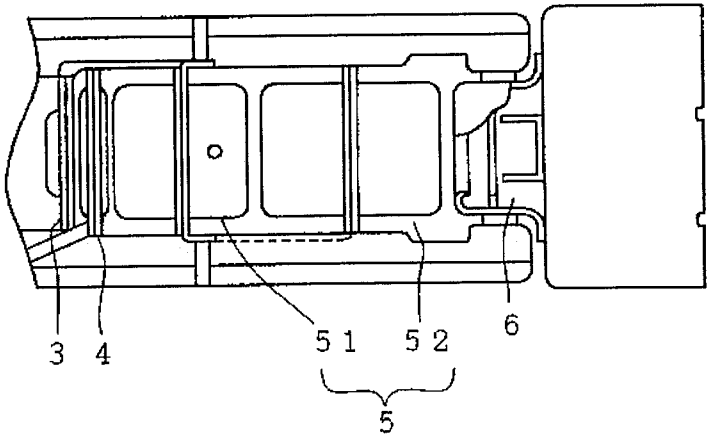
FIG. 84 PRIOR ART
Figure 85A:
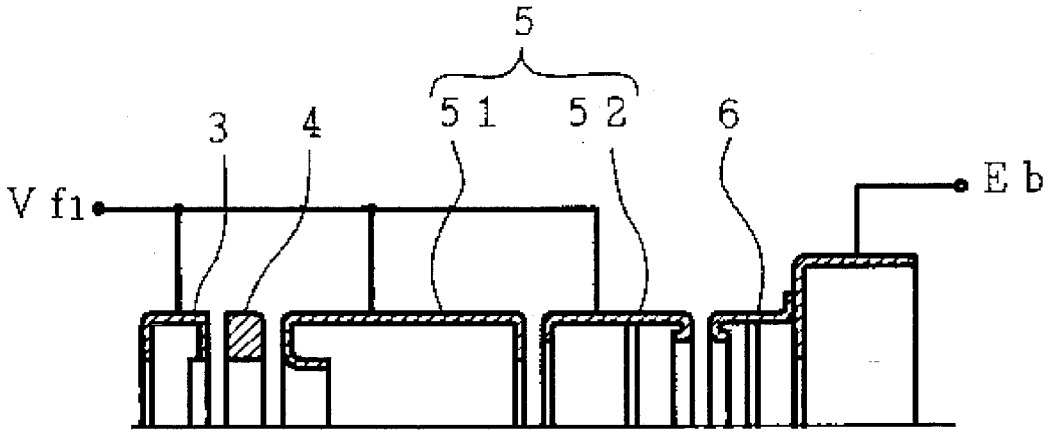
FIG. 85A PRIOR ART
Figure 85B:
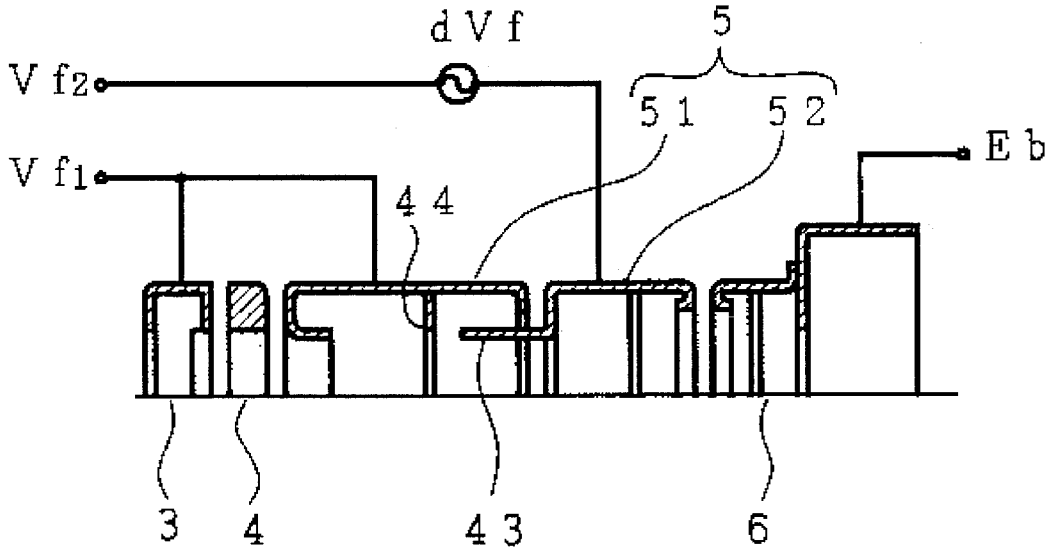
FIG. 85B PRIOR ART
Figure 86A:
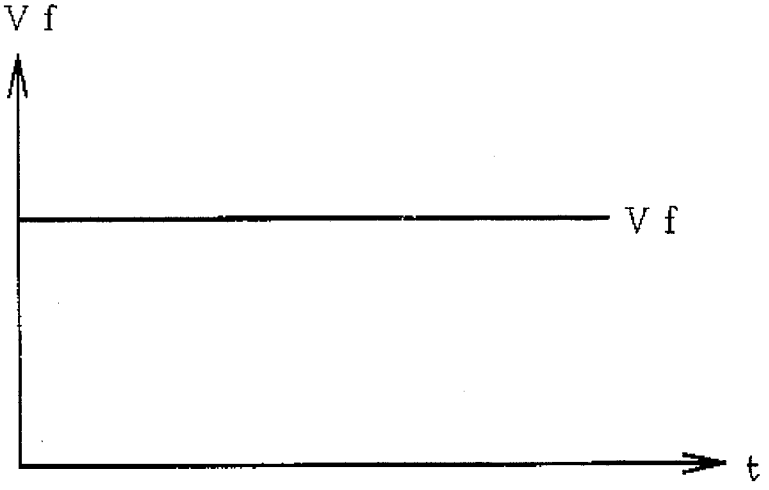
FIG. 86A PRIOR ART
Figure 86B:
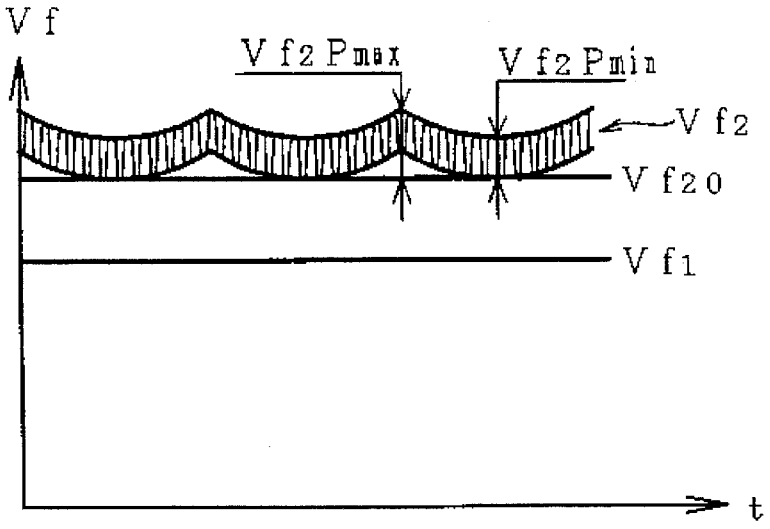
FIG. 86B PRIOR ART

FIGS. 43A–43C are explanatory diagrams showing examples of the structure in case the deflection aberration correcting electrode for establishing the inhomogeneous electric field fixed in the magnetic field of the deflection yoke and for correcting the deflection aberration of the electron beam in accordance with the deflection angle when the electron beam is to be deflected by the magnetic field of the deflection yoke is not connected with an anode but supplied with a lower potential than the anode potential;

FIGS. 44A–44C are explanatory diagrams showing examples of the structure in case the deflection aberration correcting electrode for establishing the inhomogeneous electric field fixed in the magnetic field of the deflection yoke and for correcting the deflection aberration of the electron beam in accordance with the deflection angle when the electron beam is to be deflected by the magnetic field of the deflection yoke is not connected with an anode but supplied with a lower potential than the anode potential;

FIGS. 45A–45D are explanatory diagrams showing examples of the structure in case the deflection aberration correcting electrode for establishing the inhomogeneous electric field fixed in the magnetic field of the deflection yoke and for correcting the deflection aberration of the electron beam in accordance with the deflection angle when the electron beam is to be deflected by the magnetic field of the deflection yoke is not connected with an anode but supplied with a lower potential than the anode potential;

FIGS. 46A–46D are explanatory diagrams showing examples of the structure in case the deflection aberration correcting electrode for establishing the inhomogeneous electric field fixed in the magnetic field of the deflection yoke and for correcting the deflection aberration of the electron beam in accordance with the deflection angle when the electron beam is to be deflected by the magnetic field of the deflection yoke is not connected with an anode but supplied with a lower potential than the anode potential;

FIGS. 47A–47D are explanatory diagrams showing examples of the structure in case the deflection aberration correcting electrode for establishing the inhomogeneous electric field fixed in the magnetic field of the deflection yoke and for correcting the deflection aberration of the electron beam in accordance with the deflection angle when the electron beam is to be deflected by the magnetic field of the deflection yoke is not connected with an anode but supplied with a lower potential than the anode potential;

FIGS. 48A–48D are explanatory diagrams showing examples of the structure in case the deflection aberration correcting electrode for establishing the inhomogeneous electric field fixed in the magnetic field of the deflection yoke and for correcting the deflection aberration of the electron beam in accordance with the deflection angle when the electron beam is to be deflected by the magnetic field of the deflection yoke is not connected with an anode but supplied with a lower potential than the anode potential;

FIGS. 49A–49D are explanatory diagrams showing examples of the structure in case the deflection aberration correcting electrode for establishing the inhomogeneous electric field fixed in the magnetic field of the deflection yoke and for correcting the deflection aberration of the electron beam in accordance with the deflection angle when the electron beam is to be deflected by the magnetic field of the deflection yoke is not connected with an anode but supplied with a lower potential than the anode potential;

FIGS. 50A–50D are explanatory diagrams showing examples of the structure in case the deflection aberration correcting electrode for establishing the inhomogeneous electric field fixed in the magnetic field of the deflection yoke and for correcting the deflection aberration of the electron beam in accordance with the deflection angle when the electron beam is to be deflected by the magnetic field of the deflection yoke is not connected with an anode but supplied with a lower potential than the anode potential;

FIG. 51 is a schematic section for explaining an example of the basic structure of the electron gun of the electrode construction according to the present invention;

FIG. 52 is a schematic section for explaining an example of the basic structure of the electron gun of the electrode construction according to the present invention;

FIG. 53 is a schematic section for explaining an example of the basic structure of the electron gun of the electrode construction according to the present invention;

FIG. 54 is a schematic section for explaining an example of the basic structure of the electron gun of the electrode construction according to the present invention;

FIG. 5 is a schematic section for explaining an example of the basic structure of the electron gun of the electrode construction according to the present invention;

FIG. 56 is a schematic section for explaining an example of the basic structure of the electron gun of the electrode construction according to the present invention;

FIG. 57 is a schematic diagram for explaining the construction of another electron gun according to the present invention;

FIG. 58 is an explanatory diagram showing the detailed construction of a second electrode of FIG. 57;

FIGS. 59A and 59B are explanatory diagrams showing the detailed construction of a third electrode of FIG. 57;

FIGS. 60A and 60B are explanatory diagrams showing the detailed construction of a fourth electrode of FIG. 57;

FIG. 61 is a section showing an essential portion for explaining the structure of an electron gun for the color cathode ray tube using three electron beams arrayed in-line, FIGS. 62A and 62B are diagrams showing the structure of one electrode composing the main lens of the electron gun;

FIGS. 63A–63C are diagrams showing the structure of the other electrode composing the main lens of the electron gun;

FIGS. 64A and 64B are explanatory diagrams showing another example of the deflection aberration correcting electrode in the cathode ray tube of the present invention;

FIGS. 65A–659 are explanatory diagrams for comparing the sizes of the example of the image display unit using the cathode ray tube according to the present invention and the image display unit using the cathode ray tube of the prior art;

FIG. 66 is an explanatory diagram plotting the relation between the amount of deflection and the amount of deflection aberration;

FIG. 67 is an explanatory diagram plotting the relation between the amount of deflection and the amount of deflection aberration;

FIG. 68 is an explanatory diagram showing a focusing status on the fluorescent film by the electron beam;

FIG. 69 is an explanatory diagram showing a scanning line formed in a panel portion forming the fluorescent face of the cathode ray tube;

FIGS. 70A–70E are explanatory diagrams showing an example of the construction of the deflection aberration correcting electrode for forming a fixed inhomogeneous electric field;

FIG. 71 is a diagram showing the arrangement of a cylindrical electrode and parallel flat electrodes for establishing a fixed inhomogeneous electric field;

FIG. 72 is a schematic diagram for explaining the section of a shadow mask type color cathode ray tube equipped with the in-line election gun;

FIG. 73 is an explanatory diagram showing an electron beam spot in case the periphery of a screen is caused to fluoresce with an electron beam spot having a circular shape at the central portion of the screen;

FIG. 74 is an explanatory diagram showing a distribution of the deflecting magnetic field of a cathode ray tube;

FIG. 75 is a schematic diagram showing an electronic optical system of the electron gun for explaining a deformation of the electron beam spot;

FIG. 76 is an explanatory diagram showing means for suppressing degradation in the picture quality in the peripheral port,on of the screen, as described in FIG. 75;

FIG. 77 is a schematic diagram for explaining the electron beams spot shape on the fluorescent face in case the lens system shown in FIG. 76 is used;

FIG. 78 iS a schematic diagram showing an electronic optical system of the electron gun which has not its main lens intensity made rotationally asymmetric but its pre-focus lens intensity increased in a horizontal direction (X—X);

FIG. 79 is a schematic diagram showing the electronic optical system of an electron gun in which a halo suppressing effect is added to the construction of FIG. 77;

FIG. 80 is a schematic diagram for explaining the spot shape of the electron beam on the screen when the lens system having the construction shown in FIG. 79 is used;

FIG. 81 is a schematic diagram showing the electron gun optical system for explaining the orbit of an electron beam for a low current;

FIG. 82 is a schematic diagram showing the optical system of the electron gun in case the lens intensity at the side of a diverging lens in the pre-focus lens is increased in a vertical (Y—Y) direction of the screen;

FIG. 83 is a side elevation for explaining the whole structure of the electron gun for the cathode ray tube;

FIG. 84 is a partial section showing an essential portion of the electron beam shown in FIG. 83;

FIGS. 85A and 85B are schematic sections showing an essential portion for comparing the structures of the electron gun in dependence upon how to apply a focusing voltage; and FIGS. 86A and 86B are explanatory diagrams plotting the focusing potentials to be supplied to the electron gun shown in FIGS. 85A and 85B.

DESCRIPTION OF THE PREFERRED EMBODIMENTS

The present invention will be described in detail in the following in connection with its embodiments with reference to the accompanying drawings.

The cathode ray tube has its deflection aberration augmented abruptly as the deflection increases, as has been described with reference to FIG. 66.

The present invention contemplates to make a proper electron beam converging action possible to improve the homogeneity of resolution on a fluorescent face by establishing such an inhomogeneous electric field positioned in a deflecting magnetic field as will change the converging or diverging action of the electron beam when the electron beam is deflected to have its orbit changed.

The present invention also contemplates to correct the deflection aberration, which will be abruptly augmented according to the deflection, as shown in FIG. 66, to make the proper electron beam converging action possible all over the fluorescent face by forming such an inhomogeneous electric field positioned in the deflecting magnetic field as will has its deflection aberration correction accelerated according to the deflection, as has been described with reference to FIG. 67, when the electron beam is deflected to have its orbit changed. This makes it possible to improve the homogeneity of the resolution all over the fluorescent face.

An electric field having an astigmatism is effective as one of the inhomogeneous electric fields which are positioned in the deflecting magnetic field for accelerating the converging or diverging action of the electron beam properly according to the deflection when the deflected electron beam has its orbit changed.

The electric field having the astigmatism is formed of an electric field having two orthogonal planes of symmetry. The converging or diverging action is increased the more for the larger distance from the center to the end of the plane of symmetry.

Figure 1:
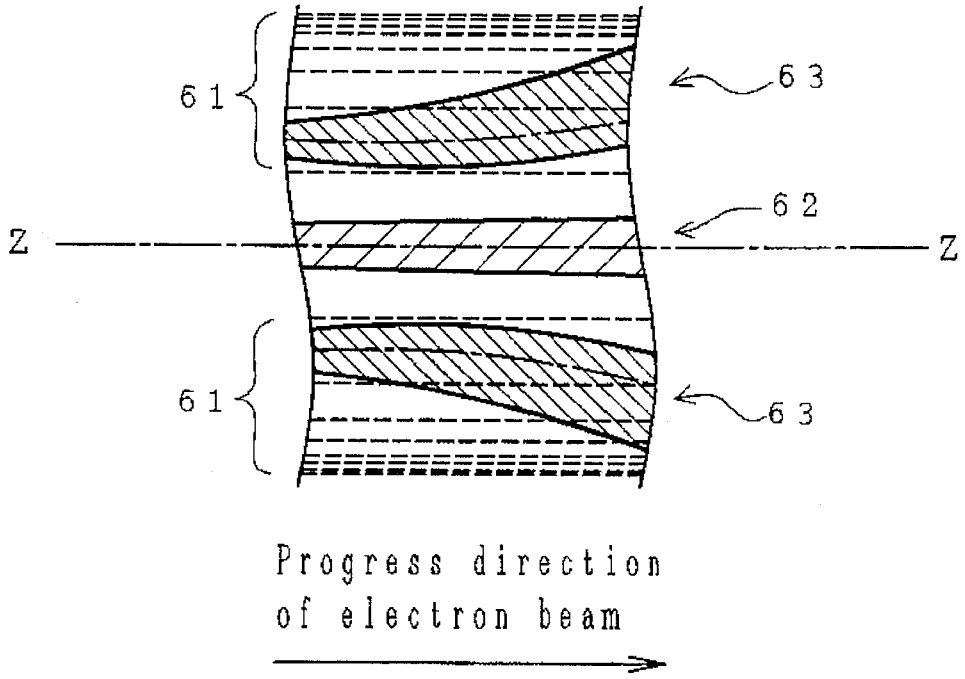
FIG. 1 is a schematic diagram showing a first embodiment of the deflection aberration correcting method of a cathode ray tube according to the present invention.

FIG. 1 is a schematic diagram showing a first embodiment of the deflection aberration correcting method of a cathode ray tube according to the present invention and shows an example of the distribution of the astigmatic electric field, in which the electron beam has the diverging action, on one plane of symmetry.

In FIG. 1, reference numeral 61 designates equipotential lines; numeral 62 designates an electron beam passing through the center of the electric field; and numeral 63 designates electron beam passing through portions apart from the center of the electric field. Thus, FIG. 1 illustrates the comparison between the statuses of the electron beam 62 passing through the center of the electric field established by the equipotential lines 61 and the electron beam 63 passing through the portion apart from the center of the electric field.

The electron beam 63 passing apart from the center of the electric field has the larger divergence to approach the end of the electric field in its entirety than the electron beam 62 passing through the center of the electric field as it flies the more in the electric field. Moreover, the change of the orbit is the greater at the closer position to the end of the electric field.

This is because the interval of the equipotential lines 61 becomes the narrower from the longer distance from the axis of symmetry Z—Z of the electric field. When such inhomogeneous electric field is established in the deflecting magnetic field so that the electron beam is deflected to have its orbit changed, the electron beam can have its diverging action accelerated according to the deflection to correct the deflection aberration in case the deflection aberration intensifies the convergence of the electron beam.

In the cathode ray tube, for example, the distance from the main lens of the electron lens to the fluorescent face is generally longer in the periphery of the fluorescent face than at the center of the fluorescent face, as shown in FIG. 68, an over-convergence occurs in the periphery of the fluorescent face if the electron beam is optimized in the convergence at the center of the fluorescent face even in case that no converging action is exerted on the electron beam of the deflecting magnetic field.

In the present embodiment, the diverging action is increased with the increase in the deflection by establishing the fixed electric field, as shown in FIG. 1, in the deflecting magnetic field, so that the deflection aberration correction can be accomplished, as shown in FIG. 67.

Figure 2:
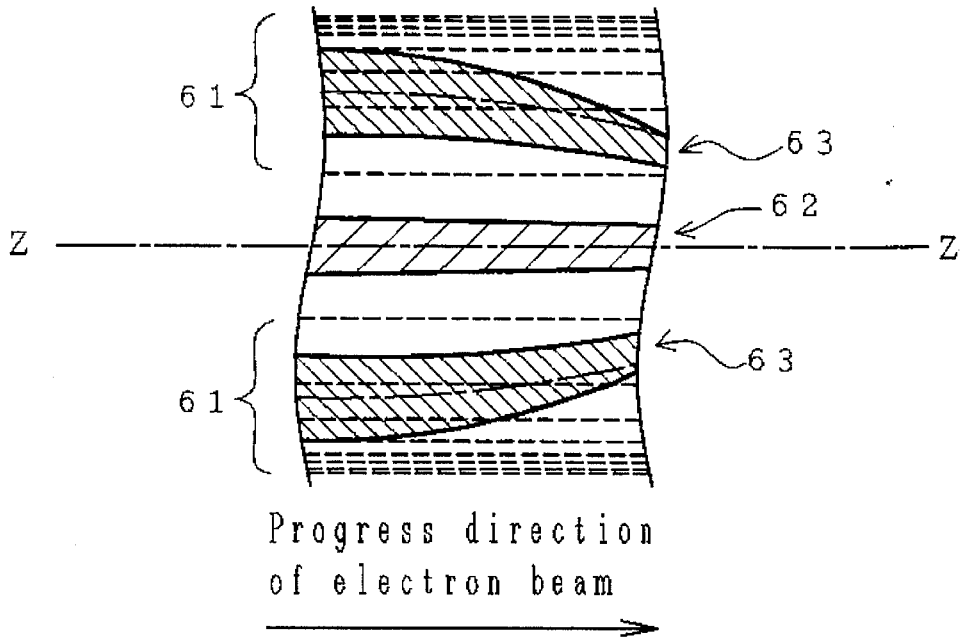
FIG. 2 is a schematic diagram showing a second embodiment of the deflection aberration correcting method of a cathode ray tube according to the present invention.

FIG. 2 is a schematic diagram showing a second embodiment of the deflection aberration correcting method of a cathode ray tube according to the present invention, and shows an example of the astigmatic electric field, in which the electron beam has the converging action, on one plane of symmetry.

In FIG. 2, there are compared the statuses of the electron beam 62 passing through the center of the electric field established by the equipotential lines 61 and the electron beam 63 passing through the portion apart from the center of the electric field.

The electron beam 63 passing apart from the center of the electric field acquires a larger convergence than that of the electron beam 62 passing through the center of the electric field, as it progresses in the electric field, and has its entire orbit brought toward the center of the electric field. Moreover, the changing force of the orbit is the larger at the closer side to the end of the electric field. This is because the interval of the equipotential lines 61 becomes the narrower as it leaves the axis of symmetry Z—Z of the electric field the more.

Thanks to the formation of such inhomogeneous electric field in the deflecting magnetic field, the electron beam is deflected to have its orbit changed. Then, the converging action of the electron beam can be accelerated according to the deflection to correct the deflection aberration correction of the case in which the deflection aberration enhances the divergence of the electron beam.

The deflection of the cathode ray tube is frequently effected by the method of scanning the electron beam linearly, as shown in FIG. 69. This linear scanning locus 60 is called the "scanning line." The deflecting magnetic field is frequently different in the direction of the scanning line and in the perpendicular direction.

Moreover, the electron beam is frequently different in the converging action between the direction of the scanning line and the perpendicular direction by the action of at least one of the aforementioned plurality of electron gun electrodes before it heavily receives the action of the fixed inhomogeneous electric field to be formed in the deflecting magnetic field.

Still moreover, the weighing is different depending upon the application of the cathode ray tube between the correction of deflection aberration in the direction of the scanning line and the correction of the deflection aberration in the direction perpendicular to the scanning line. In order to correct the deflection aberration to improve the homogeneity of the resolution all over the fluorescent face, therefore, the constitution of the fixed astigmatic electric field to be formed in the deflecting magnetic field is not uniquely determined. It is important for improving the characteristics of an image display device and for realizing a low price to clarify and cope with the characteristics to be corrected according to the individual situations in which the corresponding technical solution and the necessary cost are not always identical depending upon the direction of correction with respect to the direction of the scanning line and the method and amount of correction.

A third embodiment of the deflection aberration correcting method of the cathode ray tube according to the present invention is to establish the inhomogeneous electric field, as shown in FIGS. 1 and 2, in the deflecting magnetic field to effect the deflection aberration in the scanning line direction and in the perpendicular direction to the scanning line.

In the color cathode ray tube having three electron beams arrayed in-line in the horizontal direction, the vertical deflecting magnetic field is exemplified by a barrel-shaped magnetic field distribution whereas the horizontal deflecting magnetic field is exemplified by a pin-cushion shaped magnetic field distribution,1 as shown in FIG. 74, so as to simplify the circuit for controlling the convergence of the three electron beams at a point on the fluorescent face.

Of the three electron beams arrayed in-line, the two side electron beams receive the different amounts of deflection aberration from the vertical deflecting magnetic field in dependence upon the magnitude of the vertical deflecting magnetic field and the direction with respect to the horizontal deflection. For example, assume that an electron beam is emitted from the righthand side gun of the in-line type gun when the cathode ray tube is viewed from its fluorescent face side. A magnetic field distribution of the deflecting magnetic field passed by the electron beam deflected leftward on the fluorescent face with respect to the cathode ray tube axis is different from that passed by the electron beam deflected rightward on the fluorescent face with respect to the cathode ray tube axis, and the amounts of deflection aberration the two beams receive are different from each other. The image qualities produced by one side gun differ between the righthand and lefthand corners on the fluorescent face. For the deflection aberration correction of the side electron beams of this case, it is effective to form the coma aberration fixed electric field in the deflecting magnetic field. The electric field having the coma aberration has only one plane of symmetry.

Figure 3:
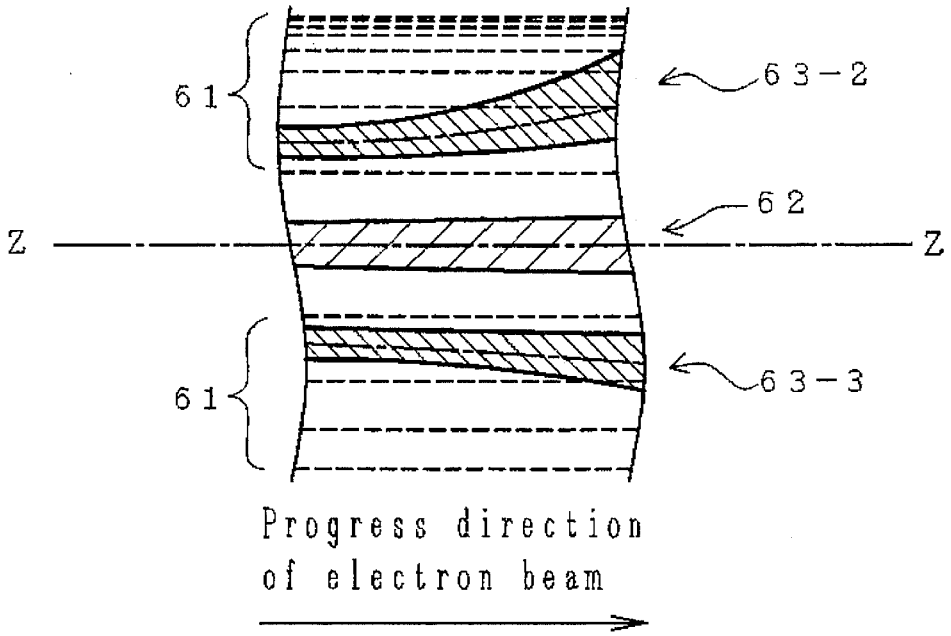
FIG. 3 is a schematic diagram showing a fourth embodiment of the deflection aberration correcting method of a cathode ray tube according to the present invention.

FIG. 3 is a schematic diagram showing a fourth embodiment of the deflection aberration correcting method of a cathode ray tube according to the present invention, and shows an example of the coma aberration electric field having the electron beam diverging action on the plane of symmetry.

In FIG. 3, the statuses are compared between the electron beam 62 passing through the center of the electric field established by the equipotential lines 61 and an electron beam 63-2 passing through the portion apart from the center of the electric field. This comparison reveals that the electron beam 63-2 passing apart from the center of the electric field takes a larger divergence, as it progresses in the electric field, than the electron beam 62 passing through the center of the electric field and has its entire orbit brought closer to the end of the electric field. Moreover, the change of the orbit is the greater at the side close to the end of the electric field. This is because the interval of the equipotential lines 61 becomes the narrower for the longer distance from the axis of symmetry Z—Z.

An electron beam 63-3 passing through a portion apart from the center of the electric field also has a larger divergence like the electron beam 63-2, as it progresses in the electric field, then the electron beam 62 and has its entire orbit brought closer to the end of the electric field. Moreover, the change of the orbit is also the greater at the side close to the end of the electric field, but the changing rate is lower than that of the electron beam 63-2.

This is because the interval of the equipotential lines 61 does not become so narrow even for the longer distance from the axis of symmetry Z—Z. When such inhomogeneous electric field is established in the deflecting magnetic field to deflect the electron beam while changing the orbit of the same, the acceleration of the diverging action of the electron beam is different depending upon the direction of deflection. Thus, the deflection aberration correction to be made is one of the case of the converging action in which the deflection aberrations are different depending upon the directions of deflection. As a matter of fact, the deflection aberration correction is not uniquely determined because it depends upon the structure of the cathode ray tube including the maximum deflection angle, the structure of a deflecting magnetic field generating unit to be combined, the electrode for establishing the inhomogeneous electric field, the electron gun structure except the inhomogeneous electric field establishing electrode, the driving conditions of the cathode ray tube, the application of the cathode ray tube and so on.

Figure 4:
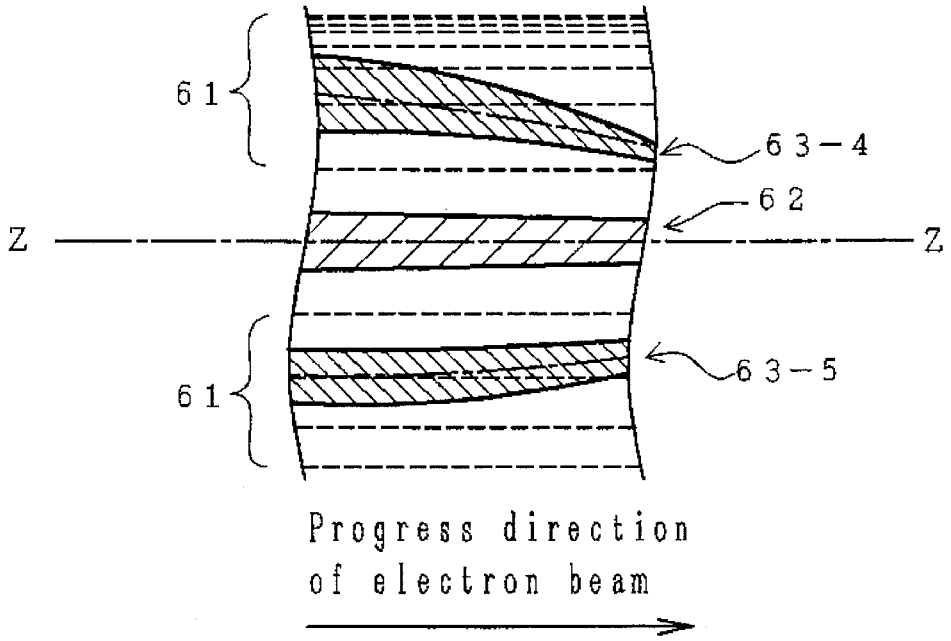
FIG. 4 is a schematic diagram showing a fifth embodiment of the deflection aberration correcting method of a cathode ray tube according to the present invention.

FIG. 4 is a schematic diagram showing a fifth embodiment of the deflection aberration correcting method of a cathode ray tube according to the present invention and shows an example of the coma aberration electric field having the electron beam converging action on the plane of symmetry. Here are compared the statuses between the electron beam 62 passing through the center of the electric field established by the equipotential lines 61 and electron beams 63-4 and 63-5 passing through portions apart from the center of the electric field.

The electron beam 63-4 receives a more convergence than the electron beam 62, as it progresses in the electric field, and has its entire orbit brought close to the center of the electric field. Moreover, the change of the orbit is greater at the side closer to the end of the electric field. This is because the interval of the equipotential lines 61 becomes the narrower at the larger distance from the axis of symmetry Z—Z of the electric field. The electron beam 63-5 passing through the portion apart from the center of the electric field also receives more convergence like the electron beam 63-4, as its progresses in the electric field, than the electron beam 62 and has its entire orbit brought closer to the center of the end of the electric field. Moreover, the change of the orbit is the higher at the closer side to the end of the electric field, but the changing rate is lower than that of the electron beam 63-4. This is because the interval of the equipotential lines 61 does not become so small even apart from the axis of symmetry Z—Z of the electric field.

When such inhomogeneous electric field is established in the deflecting magnetic field to deflect the electron beam and change the orbit, the acceleration of the converging action of the electron beam is different depending upon the direction of deflection. Thus, the deflection aberration correction is made for the diverging action in which the deflection aberrations are different depending upon the directions of deflection. As a matter of fact, the deflection aberration correction is not uniquely determined because it depends upon the structure of the cathode ray tube including the maximum deflection angle, the structure of a deflecting magnetic field generating unit to be combined, the electrode for establishing the inhomogeneous electric field, the electron gun structure except the inhomogeneous electric field establishing electrode, the driving conditions of the cathode ray tube, the application of the cathode ray tube and so on.

In the color cathode ray tube having three electron beams arrayed in-line in the horizontal direction, the vertical deflecting magnetic field is exemplified by a barrel-shaped magnetic field distribution whereas the horizontal deflecting magnetic field is exemplified by a pin-cushion shaped magnetic field distribution, as shown in FIG. 74, so as to simplify the circuit for controlling the convergence of the three electron beams at a point on the fluorescent face.

In this color cathode ray tube, the direction of the in-line array, i.e., the aforementioned horizontal direction is the scanning line direction. Of the three electron beams arrayed in-line, the two side electron beams receive the different amounts of deflection aberration from the vertical deflecting magnetic field in dependence upon the magnitude of the vertical deflecting magnetic field and the direction of the horizontal deflection with respect to the tube axis. For example, assume that an electron beam is emitted from the righthand side gun of the in-line type gun when the cathode ray tube is viewed from its fluorescent face side. A magnetic field distribution of the deflecting magnetic field passed by the electron beam deflected leftward on the fluorescent face with respect to the cathode ray tube axis is different from that passed by the electron beam deflected rightward on the fluorescent face with respect to the cathode ray tube axis, and the amounts of deflection aberration the two beams receive are different from each other. In another embodiment of the present invention, the coma aberration electric field, as shown in FIG. 3 or 4, is formed, as the inhomogeneous fixed electric field in the aforementioned scanning line direction in the deflecting magnetic field corresponding to the two side ones of the in-line arrayed three electron beams, to correct the deflection aberration. As a matter of fact, the deflection aberration correction is not uniquely determined because it depends upon the structure of the cathode ray tube including the maximum deflection angle, the structure of a deflecting magnetic field generating unit to be combined, the electrode for establishing the inhomogeneous electric field, the electron gun structure except the inhomogeneous electric field establishing electrode, the driving conditions of the cathode ray tube, the application of the cathode ray tube and so on.

FIG. 5 is a schematic section for explaining a first embodiment of the cathode ray tube according to the present invention. Reference numeral 1 designates a first electrode (G1) of the electron gun; numeral 2 designates a second electrode (G2); and numeral 3 designates a third electrode (G3) or a focusing electrode in this embodiment. Numeral 4 designates a fourth electrode (G4) or an anode in this embodiment. Numeral 7 designates a neck portion of the cathode ray tube for accommodating the electron gun; numeral 8 designates a funnel portion; and numeral 14 designates a panel portion. These three components are combined to construct a vacuum envelope of the cathode ray tube.

Moreover, reference numeral 10 designates an electron beam emitted from the electron gun. This electron beam 10 passes through an aperture of a shadow mask 12 and impinges upon a fluorescent film 13 formed on the inner face of the panel 14 to cause the fluorescent film 13 to fluoresce thereby to make a display on the screen of the cathode ray tube. Numeral 11 designates a deflection yoke for deflecting the electron beam 10. This deflection yoke 11 establishes a magnetic field in synchronism with a video signal for controlling the electron beam and controls the position of impingement of the electron beam 10 upon the fluorescent film 13.

Incidentally, reference numeral 38 designates a main lens of the electron gun. The electron beam 10 emitted from a cathode K is focused, after it has passed through the first electrode (G1) 1, the second electrode (G2) 2 and the third electrode (G3) 3, upon the fluorescent face 13 by the electric field of the main lens 38.

And, reference numeral 39 designates an electrode which is positioned in the magnetic field of the deflection yoke 11 for establishing an inhomogeneous electric field to correct the deflection aberration of the electron beam 10, when this electron beam 10 is to be deflected by the magnetic field of the deflection yoke 11, in accordance with the deflection angle.

In the present embodiment, the deflection aberration correcting electrode 39 is electrically connected with and mechanically fixed on the anode 4 and is composed of two portions in total, i.e., upper and lower ones, as taken in the vertical direction of the electron beam 10, to establish the inhomogeneous electric field acting to diverge the electron beam 10. Incidentally, numeral 40 designates leads for connecting the electrodes of the electron gun with the (not-shown) stem pins.

In FIG. 5, the gap between the two components of the deflection aberration correcting electrode 39 is made slightly larger on the side of the fluorescent film 13 than on the side of the anode 4. As a matter of fact, however, the degree of spread of the gap is not uniquely determined because it is determined by the combination of the mounted positions of the two components, the extending length toward the fluorescent film 13, the distribution of the deflecting magnetic field, the diameter of the electron beam passing between the two components, the maximum deflection angle of the cathode ray tube and so on.

In the present embodiment, as shown, the main lens 38 of the electron gun is shown, as located in a position closer to the fluorescent film 13 than the mounted position of the deflection yoke 11 within the deflecting magnetic field of the yoke 11, but the position of the main lens 38 should not be limited to the shown one if it is within the magnetic field region of the deflection yoke.

Figure 6:
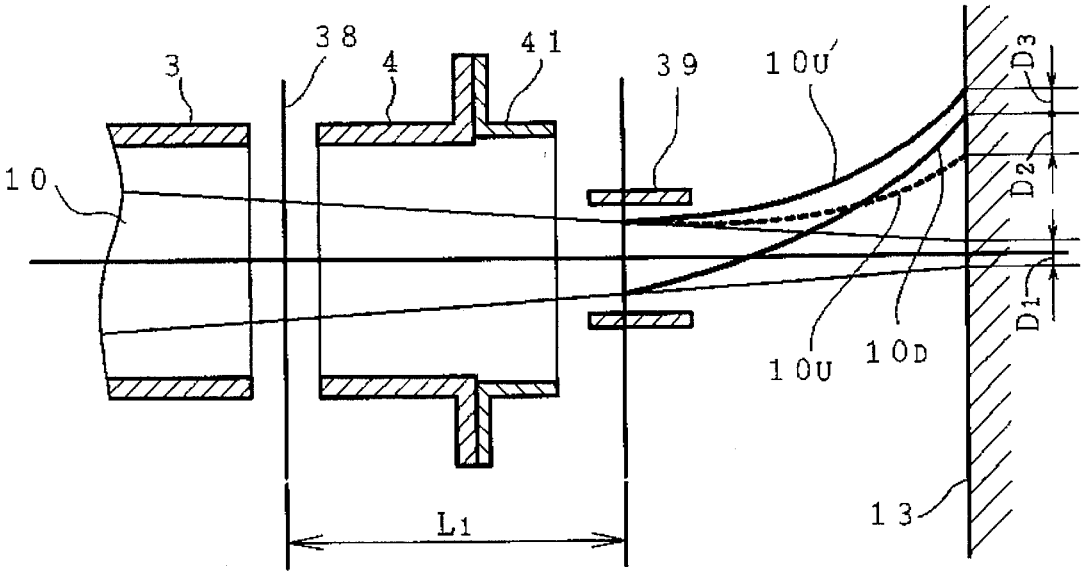
FIG. 6 is a schematic section showing an essential portion for explaining the operations of the cathode ray tube according to the present invention.

FIG. 6 is a schematic section showing an essential portion for explaining the operations of the cathode ray tube according to the present invention. FIG. 6 explains in detail one example of the action of the deflection aberration correcting electrode 39 which is positioned in the magnetic field of the deflection yoke 11 of FIG. 5 for establishing an inhomogeneous electric field to correct the deflection aberration of the electron beam 10, when this beam 10 is to be deflected by the magnetic field of the deflection yoke 11, in accordance with the deflection angle.

In this example, too, the inhomogeneous electric field acts to diverge the electron beam 10. The portions having the same functions as those of FIG. 5 are designated at the same reference numerals. Incidentally, the numeral 38 designates the main lens; numeral 41 designates a partial electrode forming part of the fourth electrode (G4) 4; and characters $L_1$ indicate the distance between the main lens 38 and the center of deflection.

Figure 7:
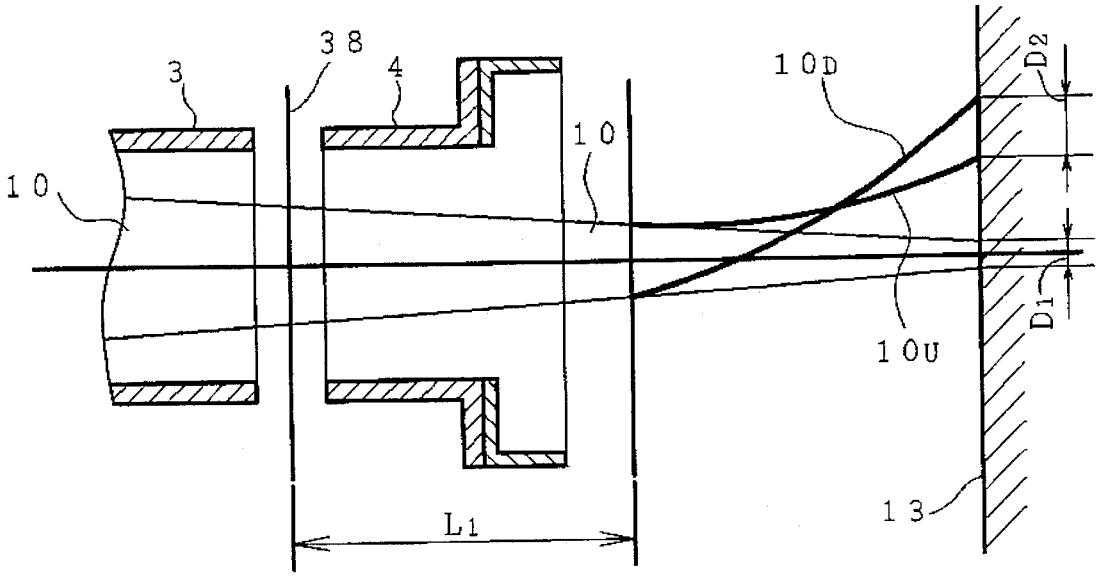
FIG. 7 PRIOR ART
FIG. 7 is a schematic section showing an essential portion similar to FIG. 6 but with a deflection aberration correcting electrode being omitted, for explaining the operations of the deflection aberration correcting electrode or an inhomogeneous electric field establishing electrode in the cathode ray tube according to the embodiment of the present invention, in comparison with the prior art.

On the other hand, FIG. 7 is a schematic section showing an essential portion similar to FIG. 6 but with a deflection aberration correcting electrode 39 being omitted, for explaining the operations of the deflection aberration correcting electrode 39 or an inhomogeneous electric field establishing electrode in the cathode ray tube according to the embodiment of the present invention, in comparison with the prior art.

In FIGS. 6 and 7, the electron beam 10 having passed through the third electrode (G3) 3 is converged by the main lens 38, which is formed between the third electrode (G3) 3 and the fourth electrode (G4) 4, and is allowed to proceed straight as it is, if it is not deflected (at the central portion of the screen) by the deflecting magnetic field established by the deflection yoke 11, until it is focused into a beam spot having a diameter of $D_1$ on the fluorescent film 13.

Here will be qualitatively described how the orbit of the electron beam 10 will change with (as shown in FIG. 6) and without (as shown in FIG. 7) the action of the deflection aberration correcting electrode 30, in case the electron beam 10 is deflected upward of the fluorescent film 13.

In FIG. 7, the lower one of the outer circumferential orbits of the electron beam 10 is not affected by the presence or absence of the deflection aberration correcting electrode 39 but proceeds, as indicated by $\mathbf{10}_D$. However, the upper outer circumferential orbit proceeds, as indicated by $\mathbf{10}_U$, because of no action of the deflection aberration correcting electrode 39, and crosses the lower outer circumferential orbit $\mathbf{10}_D$ before it reaches the fluorescent film 13. As a result, a spot having a diameter $D_2$, as shown in FIG. 7, is formed on the fluorescent film 13.

If the deflection aberration correcting electrode 39 acts, as shown in FIG. 6, on the contrary, the orbit portion of the electron beam, as located at the upper side, proceeds, as indicated by $\mathbf{10}_U'$, under the attracting force of the deflection aberration correcting electrode 39. On the other hand, the orbit portion of the electron beam, as located at the lower side, proceeds, as indicated by $\mathbf{10}_D$ in FIG. 7, because of little influence of the deflection aberration correcting electrode 39, and reaches the fluorescent film 13 without crossing the upper outer circumferential orbit $\mathbf{10}_U'$ before the arrival. As a result, a spot having a smaller diameter $D_3$ than the aforementioned one $D_2$ is formed on the fluorescent film 13. This is because the aforementioned inhomogeneous electric field is formed, as shown in FIG. 71.

The distribution of the beam spot of the diameter $D_3$ on the individual positions of the fluorescent film 13 can be optimized by combining the mounting positions of the two components of the deflection aberration correcting electrode 39, their extensions toward the fluorescent film 13, the distribution of the deflecting magnetic field, the diameter of the electron beam passing between the two components, the maximum deflection angle of the cathode ray tube and so on, so that a uniform resolution can be achieved all over the screen by reducing the difference from the beam spot diameter $D_1$ at the central portion of the screen.

As a result, according to the present embodiment, the focused status can be controlled in synchronism with the deflection angle on the fluorescent film (or screen) without supplying any potential dynamically to any of the electrodes of the electron gun in synchronism with the deflection angle of the electron beam, thus, it is possible to provide the cathode ray tube, which has a homogeneous display quality all over the screen, at a reasonable cost. As a matter of fact, these conditions are not uniquely determined because they depend upon the structure of the cathode ray tube including the maximum deflection angle, the structure of a deflecting magnetic field generating unit to be combined, the electrode for establishing the inhomogeneous electric field, the electron gun structure except the inhomogeneous electric field establishing electrode, the driving conditions of the cathode ray tube, the application of the cathode ray tube and so on.

In order to improve the homogeneity of resolution over the entirety of the fluorescent film by forming the fixed inhomogeneous electric field in the deflecting magnetic field, the electron beam has to be so deflected that its orbit may pass through regions having electric field intensities different with deflection angles. Thus, the aforementioned inhomogeneous electric field is restricted by the positional relation to the deflecting magnetic field.

Figure 8:
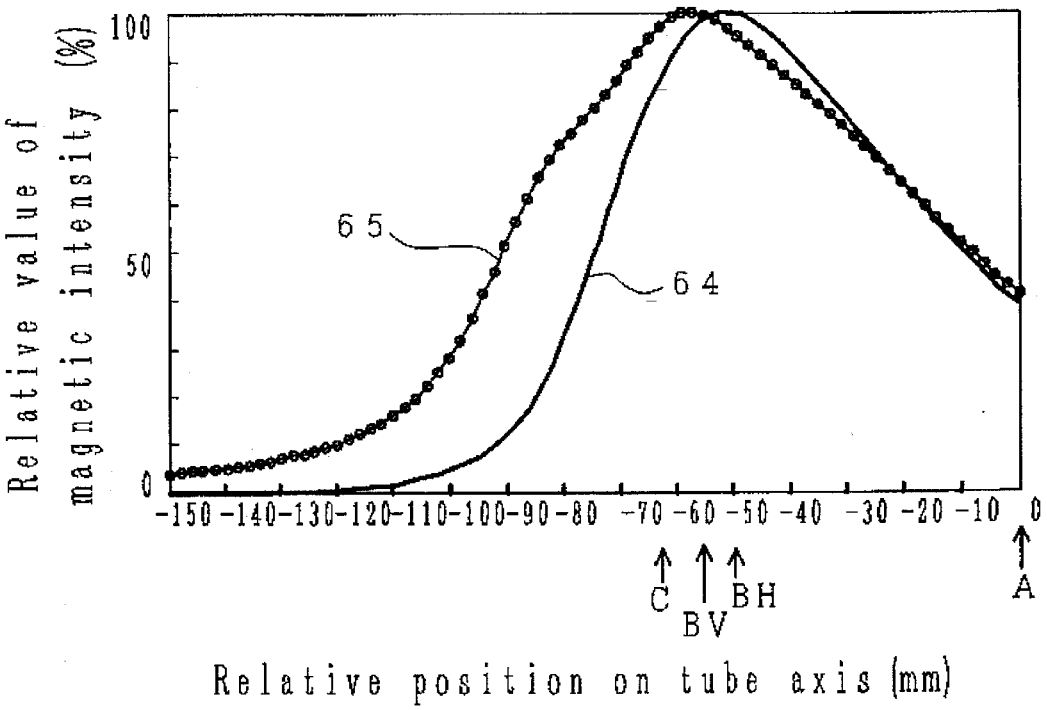
FIG. 8 is an explanatory diagram plotting an example of the distribution of a deflecting magnetic field, as taken on the axis, for a cathode ray tube having a deflection angle of 100 degrees or more.

FIG. 8 is an explanatory diagram plotting an example of the distribution of a deflecting magnetic field, as taken on the axis, for a cathode ray tube having a deflection angle of 100 degrees or more.

Figure 9:
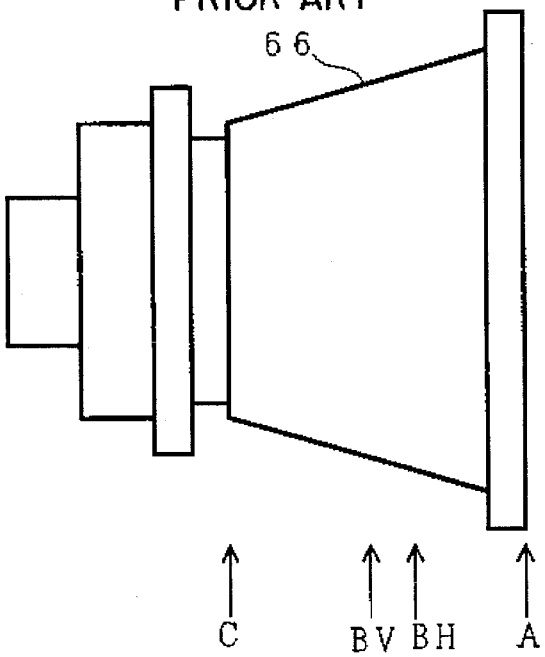
FIG. 9 PRIOR ART
FIG. 9 is an explanatory diagram corresponding to FIG. 8 and shows the positional relations of a deflecting magnetic field establishing mechanism.

Here in FIG. 8, the righthand side is located on the side closer to the fluorescent face, and the lefthand side is located on the side remote from the fluorescent face. On the other hand, FIG. 9 is an explanatory diagram corresponding to FIG. 8 and shows the positional relations of a deflecting magnetic field establishing mechanism. Letter A indicates a different position for measuring the magnetic field; letters BH indicate a position having the maximum magnetic flux density of the magnetic field distribution 64 for deflecting in the scanning line direction; letters BV indicate a position having the maximum magnetic flux density of the magnetic field distribution 65 for deflecting in the direction perpendicular to the scanning line; and letter C indicates an end portion of the magnetic material for making up the core of a coil for establishing the deflecting magnetic field, on the side remote from the fluorescent face of the cathode ray tube.

The aforementioned distance takes the maximum in case the electrodes on the side of the fluorescent face are complicated in the axial direction of the cathode ray tube.

Figure 10:
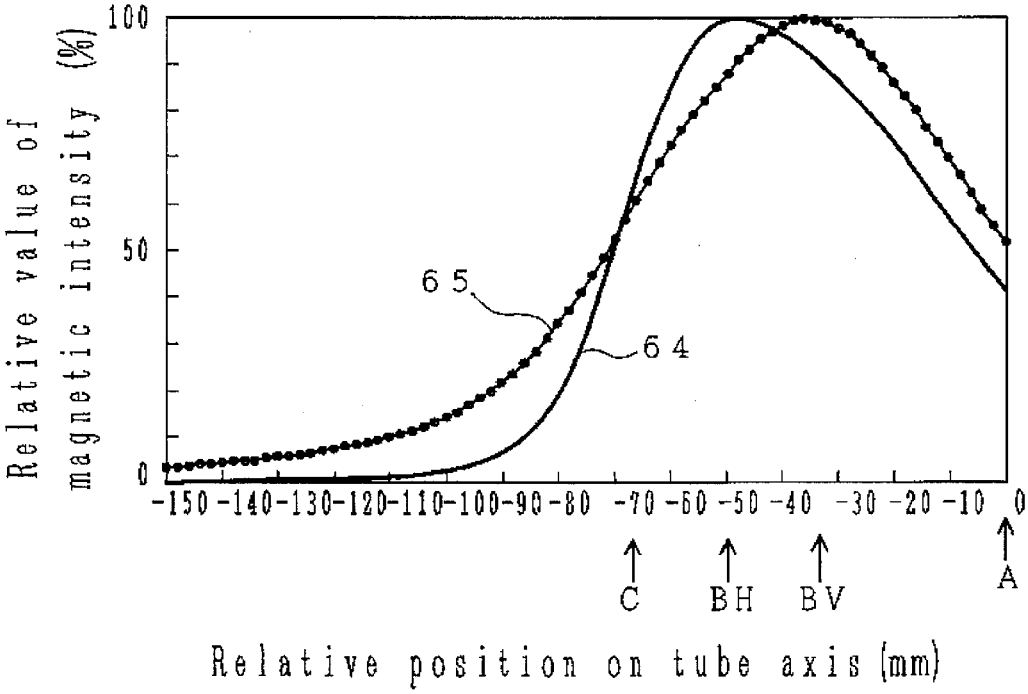
FIG. 10 is an explanatory diagram plotting an example of the distribution of a deflecting magnetic field, as taken on the axis, for a cathode ray tube having a deflection angle of 100 degrees or less.

FIG. 10 is an explanatory diagram plotting an example of the distribution of a deflecting magnetic field on the axis, for a cathode ray tube having a deflection angle of 100 degrees or less.

Figure 11:
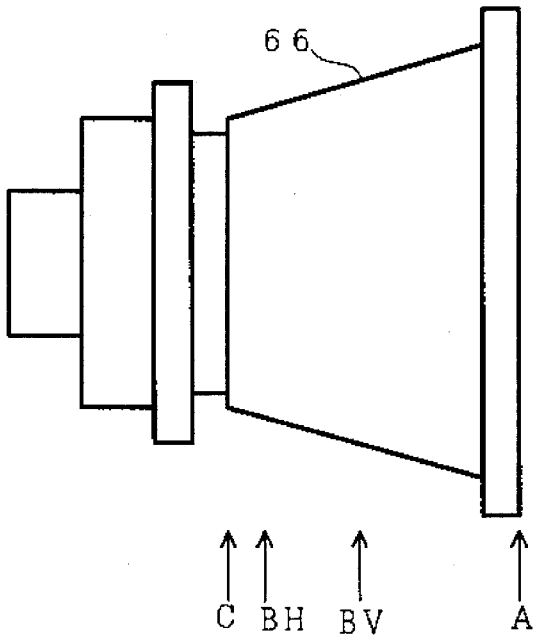
FIG. 11 PRIOR ART
FIG. 11 is an explanatory diagram corresponding to FIG. 10 and shows the positional relations of a deflecting magnetic field establishing mechanism.

Here in FIG. 10, the righthand side is located at the side closer to the fluorescent face, and the lefthand side is located on the side remote from the fluorescent face. On the other hand, FIG. 11 is an explanatory diagram corresponding to FIG. 10 and shows the positional relations of a deflecting magnetic field establishing mechanism. Letter A indicates a reference position for measuring the magnetic field; letters BH indicates a position having the maximum magnetic flux density of the magnetic field distribution 64 for deflecting in the scanning line direction; letters BV indicate a position having the maximum magnetic flux density of the magnetic field distribution 65 for deflecting in the direction perpendicular to the scanning line; and letter C indicates an end portion of the magnetic material for making up the core of a coil for establishing the deflecting magnetic field, on the side remote from the fluorescent face of the cathode ray tube.

Figure 12:
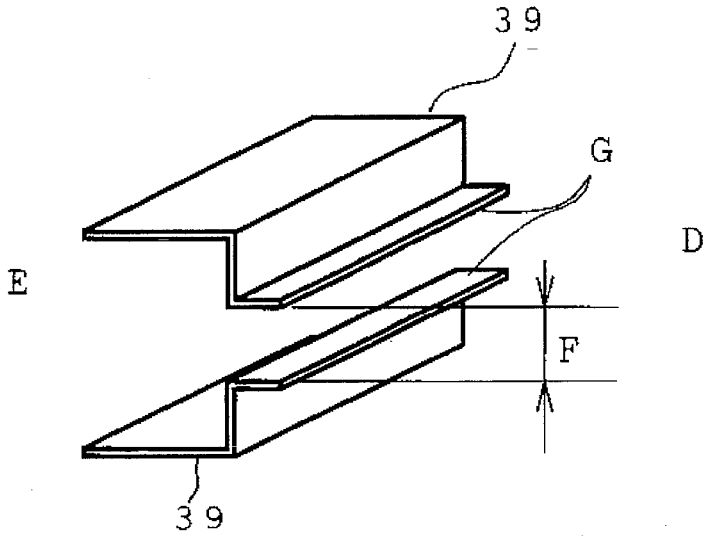
FIG. 12 is a perspective view showing an example of the structure of the deflection aberration correcting electrode for establishing an inhomogeneous electric field fixed in the deflecting magnetic field of the present invention.

FIG. 12 is a perspective view showing an example of the structure of the deflection aberration correcting electrode for establishing an inhomogeneous fixed electric field in the deflecting magnetic field of the present invention. The deflection aberration correcting electrode 39 of FIG. 12 is composed of two folded metal plates which are opposed in parallel to each other with a distance F therebetween. In FIG.

12, the portion D is positioned on the side close to the fluorescent face of the cathode ray tube whereas the portion E is positioned on the side close to the fluorescent face so that the center of the opposed portions may transmit the electron beam therethrough if there is established no deflecting magnetic field.

The deflection aberration correcting electrode 39 is disposed that the opposed portions G may be in parallel with the scanning line, and is actually welded together with the anode of the cathode ray tube in the color cathode ray tube having a neck external diameter of 29 mm, a maximum deflection angle of 108 degrees and a fluorescent face size of 59 cm.

A satisfactory result is obtained by combining the deflecting magnetic field of FIG. 8 with the cathode ray tube, by placing the D-side front end in FIG. 12 at a position of 108 mm in the Z-axis of FIG. 8 and by using an anode voltage of 30 KV. The magnetic flux density at the position, at which the D-side front end in FIG. 12 is set, is 0.0086 millitesla per root of the anode voltage of 1 V. This value is about 33% of the maximum magnetic flux density. The distance of the coil for establishing the deflecting magnetic field from the core end portion remote from the fluorescent face is about 30 mm. These conditions are not uniquely determined because they depend upon the structure of the cathode ray tube including the maximum deflection angle, the structure of a deflecting magnetic field generating unit to be combined. The electrodes for establishing the inhomogeneous electric field, the electron gun structure except the inhomogeneous electric field establishing electrode, the driving conditions of the cathode ray tube, the application of the cathode ray tube and so on.

On the other hand, the deflection aberration correcting electrode for establishing an inhomogeneous fixed electric field in the deflection aberration shown in FIG. 12 is used like before in the cathode ray tube and is welded together with the anode of the electron gun in a color cathode ray tube having a neck portion external diameter of 29 mm, a maximum deflection angle of 90 degrees and a fluorescent face size of 48 cm.

A satisfactory result is obtained by combining the deflecting magnetic field of FIG. 10 with the cathode ray tube, by placing the D-side front end in FIG. 12 at a position of 70 mm in the Z-axis of FIG. 10 and by using an anode voltage of 30 kV. The magnetic flux density at the position, at which the D-side front end in FIG. 12 is set, is 0.01 millitesla per root of the anode voltage of 1 V. This value is about 50% of the maximum magnetic flux density. The distance of the coil for establishing the deflecting magnetic field from the core end portion remote from the fluorescent face is about 13 mm. These conditions are not uniquely determined because they depend upon the structure of the cathode ray tube including the maximum deflection angle, the structure of a deflecting magnetic field generating unit to be combined, the electrodes for establishing the inhomogeneous electric field, the electron gun structure except the inhomogeneous electric field establishing electrodes, the driving conditions of the cathode ray tube, the application of the cathode ray tube and so on.

Figure 13:
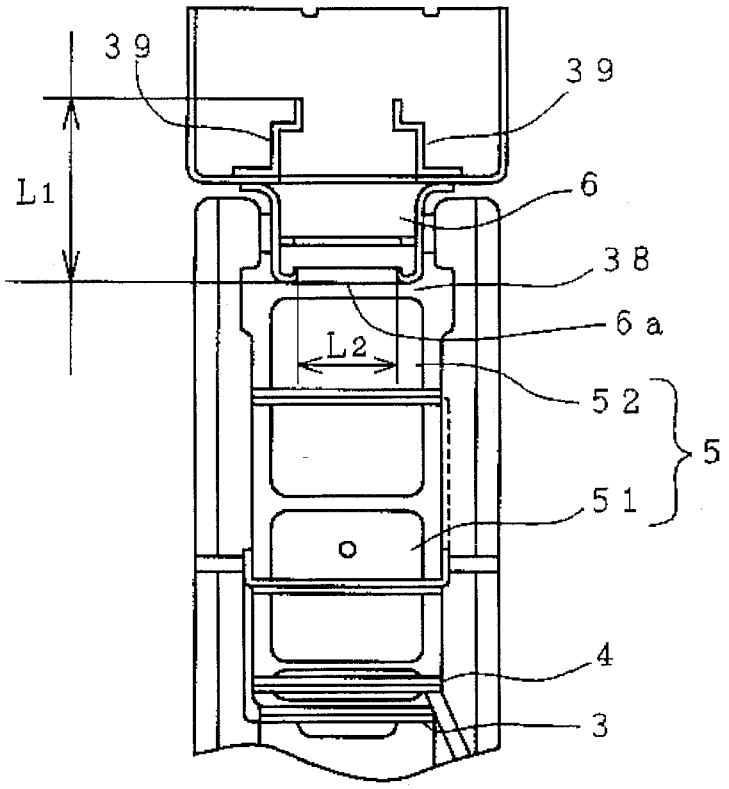
FIG. 13 is a section showing an essential portion of one example of an electron gun to be used in the cathode ray tube according to the present invention.

FIG. 13 is a section showing an essential portion of one example of an electron gun to be used in the cathode ray tube according to the present invention. Across the main lens 38, there are arranged in the cathode ray tube an anode 6, which is located close to the fluorescent face, and a focus electrode 5 which is located remote from the fluorescent face.

In FIG. 13, the deflect.on aberration correcting electrode 39 for establishing a fixed inhomogeneous electric field in the deflecting magnetic field is positioned closer to the fluorescent face than that end 6a of the anode 6 of the electron gun, which is opposed to the main lens 38.

Figure 14:
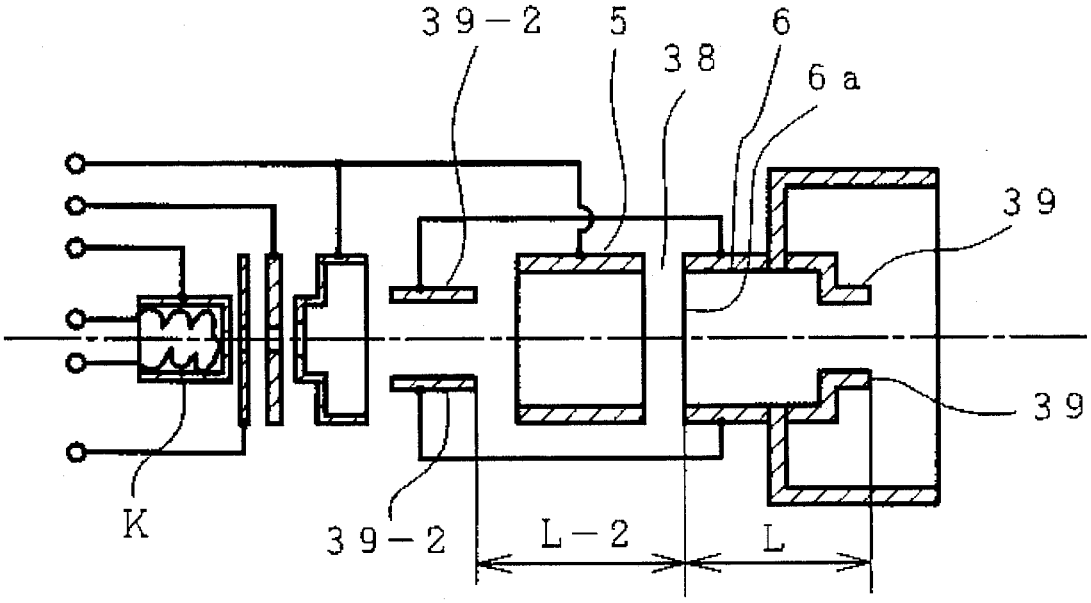
FIG. 14 is a schematic diagram for explaining one example of an electron gun structure used in the cathode ray tube of the present invention.

FIG. 14 is a section showing an essential portion of one example of an electron gun to be used in the cathode ray tube according to the present invention. Across the main lens 38, there are arranged in the cathode ray tube an anode 6, which is located close to the fluorescent face, and a focus electrode 5 which is located closer to the cathode K than the anode 6.

In FIG. 14, the deflection aberration correcting electrodes for establishing a fixed inhomogeneous electric field in the deflecting magnetic field is disposed at two positions 39 and 39-2. Of these, the deflection aberration correcting electrode 39-2 is positioned closer to the cathode than that end 6a of the anode 6 of the electron gun, which is opposed to the main lens 38.

Figure 15:
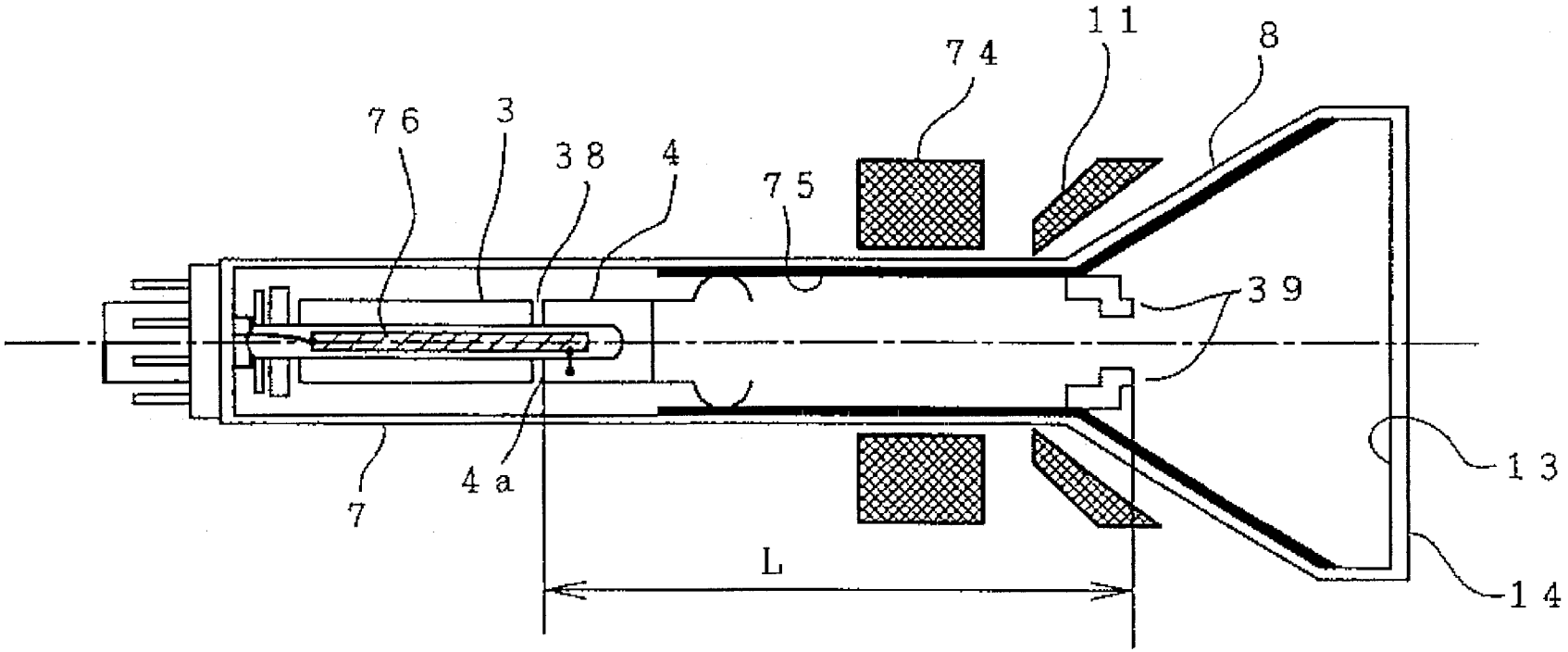
FIG. 15 is a schematic diagram for explaining one example of an electron gun structure used in the cathode ray tube of the present invention.

FIG. 15 is a section showing an essential portion of one example of an electron gun to be used in the cathode ray tube according to the present invention. The cathode ray tube is exemplified by a projection type cathode ray tube having a maximum deflection angle of 85 degrees or less.

In FIG. 15, an electromagnetically focusing coil 74 is disposed outside of the neck portion closer to the fluorescent face 13 than the anode 4. Moreover, a distance L from an end 4*a* of the anode 4 facing the main lens to the end portion of the deflection aberration correcting electrode 39, as located near the fluorescent face 13, for establishing the fixed inhomogeneous electric field in the deflecting magnetic field is about 180 mm. The end 4*a* of the anode 4 facing the main lens 38 is a cylinder having an aperture diameter of 30 mm.

In the construction of FIG. 15, the potential of the fluorescent film is divided by a resistive film 75 formed on the inner face of the neck portion and a resistor 76 to generate a voltage to be fed to the anode 4. The detailed conditions are not uniquely determined because they depend upon the structure of the cathode ray tube including the maximum deflection angle, the structure of a deflecting magnetic field generating unit to be combined, the electrode for establishing the inhomogeneous electric field, the electron gun structure except the inhomogeneous electric field establishing electrode, the driving conditions of the cathode ray tube, the application of the cathode ray tube and so on.

In the deflection aberration correcting electrode, as shown in FIG. 14, the distance from the end 6*a* of the anode 6 of the electron gun facing the main lens 38 to the cathode is 100 mm. The end 6*a* of the anode 6 facing the main lens 38 is a cylinder having an aperture diameter of 20 mm. These sizes are not uniquely different because they depend upon the structure of the cathode ray tube including the maximum deflection angle, the structure of a deflecting magnetic field generating unit to be combined, the electrode for establishing the inhomogeneous electric field, the electron gun structure except the inhomogeneous electric field establishing electrode, the driving conditions of the cathode ray tube, the application of the cathode ray tube and so on.

Figures 16A, 16B:
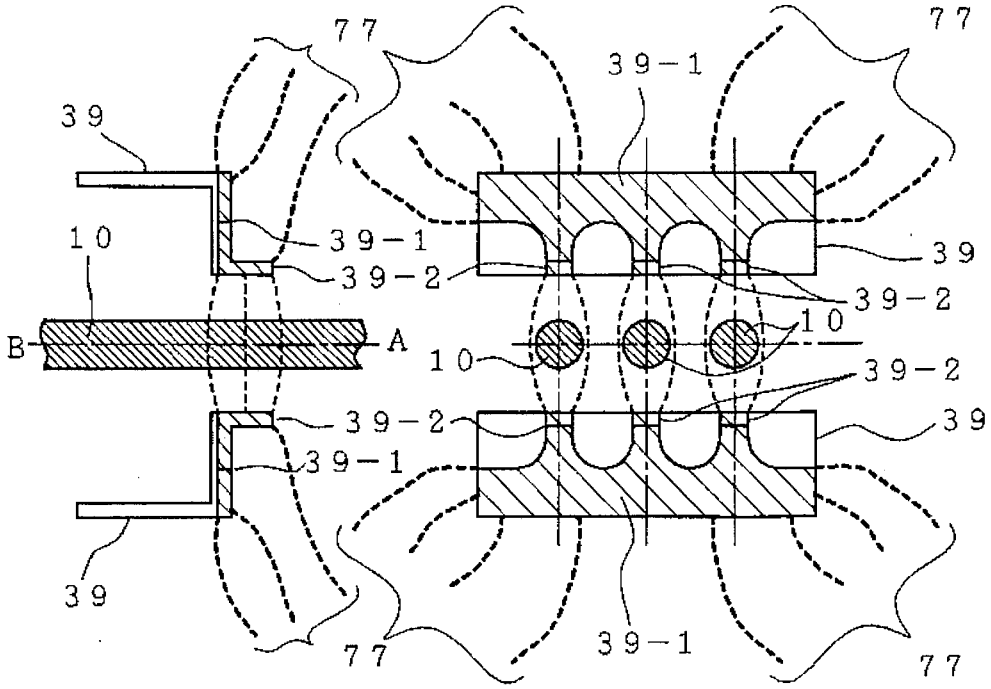
FIGS. 16A and 16B are diagrams showing an essential portion for explaining an example of the structure of a deflection aberration correcting electrode, in which the present invention is applied to a color cathode ray tube using three electron beams arranged in-line.

FIGS. 16A and 16B are diagrams showing an essential portion for explaining an example of the structure of a deflection aberration correcting electrode, in which the present invention is applied to a color cathode ray tube using three electron beams arranged in-line. FIG. 16A presents a transverse section, and FIG. 16B presents a front elevation.

In FIGS. 16A and 16B, reference numeral 77 designates lines of magnetic force for deflecting the electron beam 10 in the in-line array direction. By using the magnetic material 39-1 as a portion of the deflection aberration correcting electrode 39 for establishing a fixed inhomogeneous electric field in the deflecting magnetic field, the lines of magnetic force 77 are concentrated in the vicinity of the electron beam 10 to promote the deflecting action of the corresponding portion.

Figures 17A, 17B:
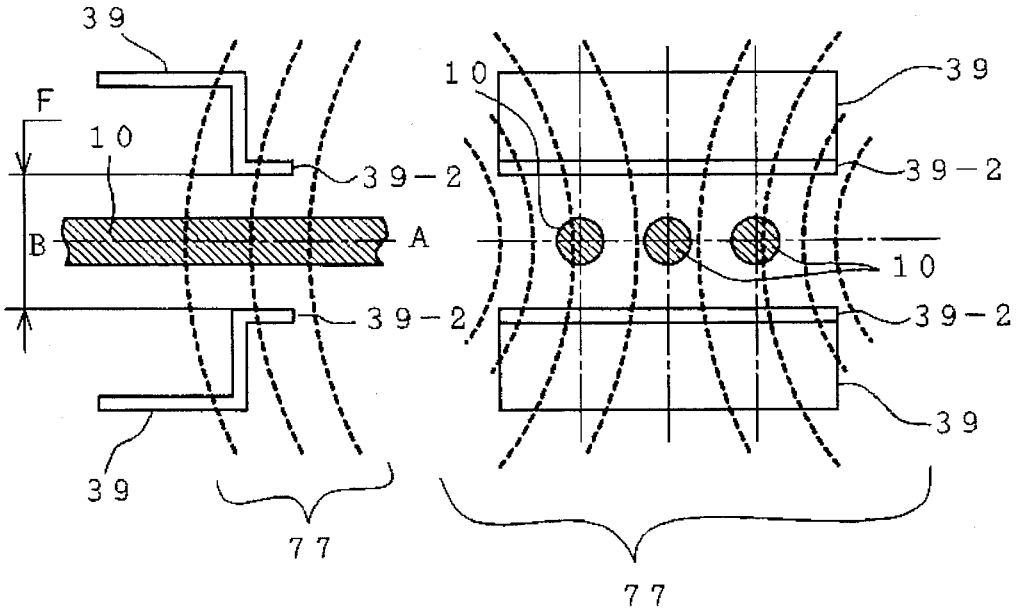
FIGS. 17A and 17B are diagrams showing an essential portion for explaining another example of the cathode ray tube of the present invention, in which the deflection aberration correcting electrode is applied to the color cathode ray tube using three electron beams arranged in-line.

FIGS. 17A and 17B are diagrams showing an essential portion for explaining another example of the structure of a cathode ray tube of the present invention, in which the deflection aberration correcting electrode is applied to a color cathode ray tube using three electron beams arranged in-line. FIG. 17A presents a transverse section, and FIG. 17B presents a front elevation.

In FIGS. 17A and 17B, no concentration of the lines of magnetic force occurs because the aforementioned magnetic material 39-1 is not disposed in the deflection aberration correcting electrode 39. The direction for promoting the deflection is not uniquely determined because it depends upon the structure of the cathode ray tube including the maximum deflection angle, the structure of a deflecting magnetic field generating unit to be combined, the electrode for establishing the inhomogeneous electric field, the electron gun structure excepting the inhomogeneous electric field establishing electrode, the driving conditions of the cathode ray tube, the application of the cathode ray tube and so on.

Figures 18A, 18B:
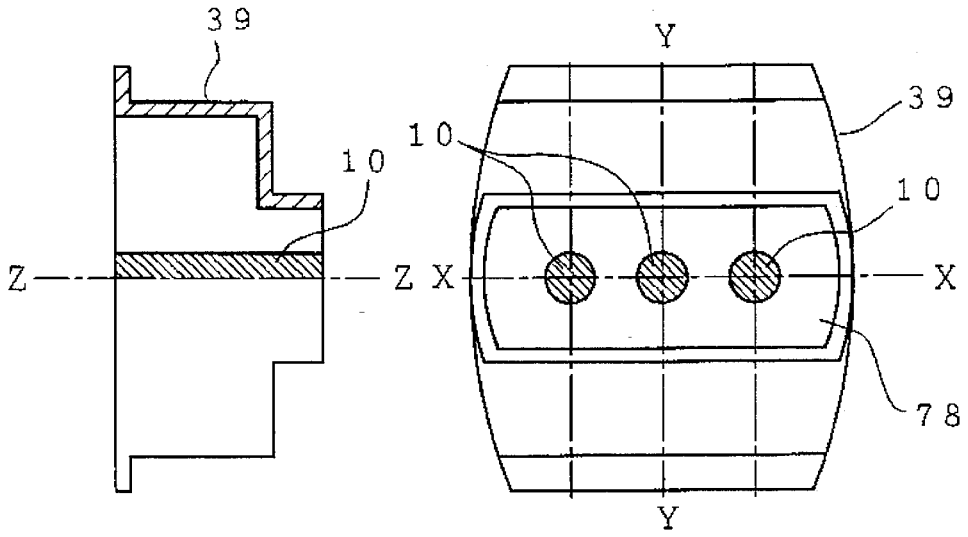
FIGS. 18A and 18B are diagrams showing an essential portion for explaining another example of the structure of a deflection aberration correcting electrode, in which the present invention is applied to a color cathode ray tube using three electron beams arranged in-line.

FIGS. 18A and 18B are diagrams showing an essential portion for explaining another example of the structure of a deflection aberration correcting electrode, in which the present invention is applied to a color cathode ray tube using three electron beams arranged in-line. FIG. 18A presents a transverse section, and FIG. 18B presents a front elevation.

In FIGS. 18A and 18B, the deflection aberration correcting electrode 39 has its aperture 78 shaped to envelope the electron beam 10. Generally speaking, the color cathode ray tube using the in-line arrayed three electron beams, as shown, has its scanning line direction in parallel with the in-line direction so that the aperture 78 of the deflection aberration correcting electrode 39 for establishing the fixed inhomogeneous electric field in the deflecting magnetic field, as shown, corresponds to the scanning line direction. The detailed conditions are not uniquely different because they depend upon the structure of the cathode ray tube including the maximum deflection angle, the structure of a deflecting magnetic field generating unit to be combined, the electrode for establishing the inhomogeneous electric field, the electron gun structure except the inhomogeneous electric field establishing electrode, the driving conditions of the cathode ray tube, the application of the cathode ray tube and so on.

Figures 19A, 19B:
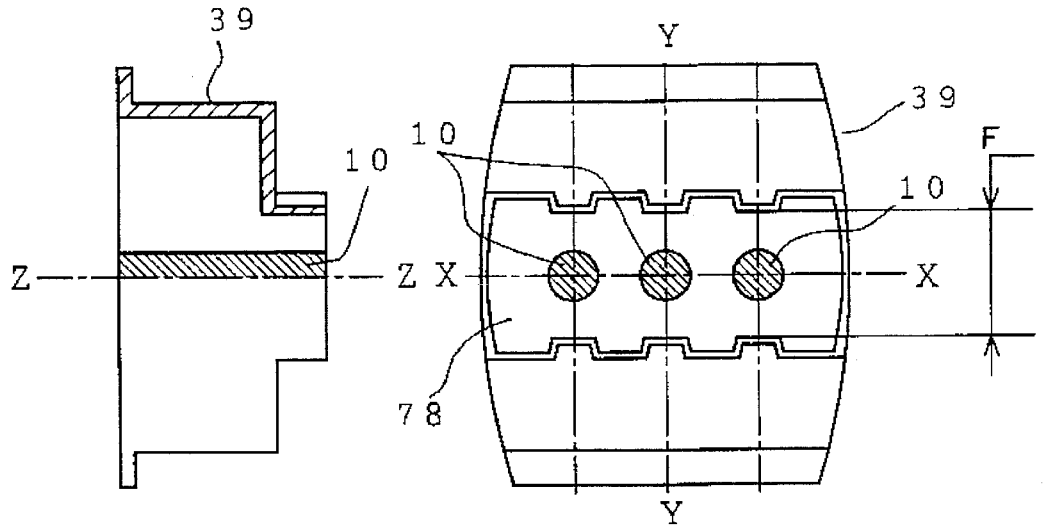
FIGS. 19A and 19B are diagrams similar to FIGS. 18A and 18B showing an essential portion for explaining still another example of the structure of a deflection aberration correcting electrode, in which the present invention is applied to a color cathode ray tube using three electron beams arranged in-line.

FIGS. 19A and 19B are diagrams similar to FIGS. 18A and 18B but show an essential portion for explaining still another example of the structure of a deflection aberration correcting electrode, in which the present invention is applied to a color cathode ray tube using three electron beams arranged in-line. FIG. 19A presents a transverse section, and FIG. 19B presents a front elevation.

Figure 20:
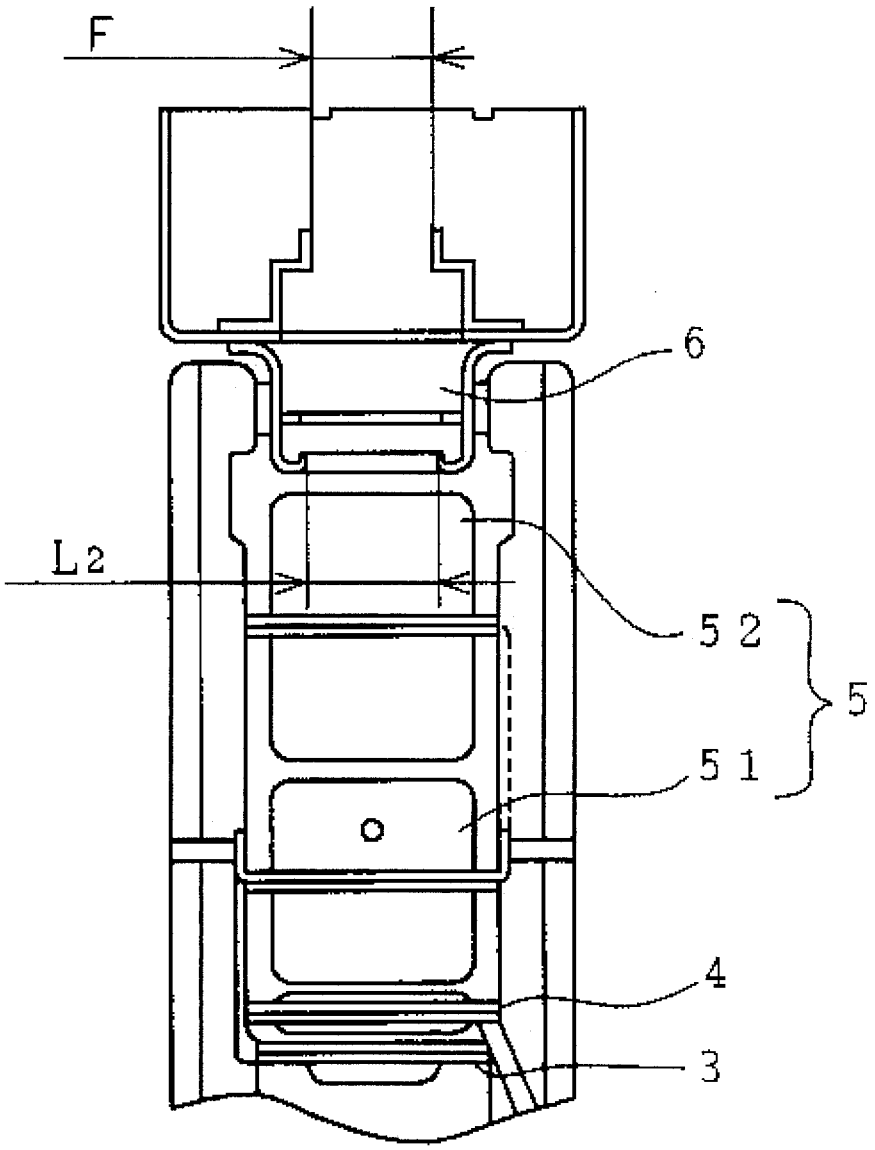
FIG. 20 is an explanatory diagram showing an example of the structure of an electron gun having the deflection aberration correcting electrode mounted thereon.

In FIGS. 19A and 19B, the deflection aberration correcting electrode 39 has its aperture 78 shaped to envelope the electron beam 10. Generally speaking, the color cathode ray tube using the in-line arrayed three electron beams, as shown, has its scanning line direction in parallel with the in-line direction so that the aperture 78 of the deflection aberration correcting electrode 39 for establishing the fixed inhomogeneous electric field in the deflecting magnetic field, as shown, corresponds to the scanning line direction. In FIGS. 19A and 19B, the aperture diameter of the aperture 78 is not uniform in the direction perpendicular to the scanning line and has the smallest size F located at the portion facing each electron beam. In this example, the deflection aberration correction is changed according to the deflection even in case the electron beam is deflected in the in-line direction. As a matter of fact, the size F is set to 3 mm, and the deflection aberration correcting electrode 39 is attached to the electron gun, as shown in FIG. 20. A satisfactory result is obtained by setting the aperture diameters, as taken in the scanning line direction and in the perpendicular direction, of the end of the electron gun anode facing the main lens to 8 mm. The detailed conditions are not uniquely determined because they depend upon the structure of the cathode ray tube including the maximum deflection angle, the structure of a deflecting magnetic field generating unit to be combined, the electrode for establishing the inhomogeneous electric field, the electron gun structure except the inhomogeneous electric field establishing electrode, the driving conditions of the cathode ray tube, the application of the cathode ray tube and so on. For example, in case the portion of the value F is located not to face the electron beam 10, the value F may be zero.

In FIGS. 16A, 16B, 17A, 17B, 18A and 18B, the two deflection aberration correcting electrodes 39 each for establishing the fixed inhomogeneous electric field in the deflecting magnetic field are arranged to face each other across the electron beam 10.

In FIGS. 16A and 16B, only the front end 39-2 of the portion facing the electron beam 10 protrudes toward the direction A. On the contrary, the same portion uniformly protrudes in FIGS. 17A and 17B. These protrusions are not dependent upon only the material of the deflection aberration correcting electrode 39 but can occur in the case of a non-magnetic material.

Generally speaking, the scanning line direction of the color cathode ray tube using the in-line arrayed three electron beams, as shown in the foregoing Figures, is in parallel with the in-line direction so that the opposing portion of the deflection aberration correcting electrode 39 for establishing the fixed inhomogeneous electric field in the deflecting magnetic field in the figures is in line with the scanning line direction.

FIG. 20 is an explanatory diagram showing an example of the structure of an electron gun having the deflection aberration correcting electrode mounted thereon. The deflection aberration correcting electrode 39 is attached to the electron gun, as shown in FIG. 20, by setting the distance F between the opposing front ends 39-2 in the direction perpendicular to the scanning lines to 3 mm. At this time, a satisfactory result is achieved by setting the aperture diameter, as taken in the direction perpendicular to the scanning line, of the electron gun anode facing the main lens to 8 mm. The detailed conditions are not uniquely determined because they depend upon the structure of the cathode ray tube including the maximum deflection angle, the structure of a deflecting magnetic field generating unit to be combined, the electrode for establishing the inhomogeneous electric field, the electron gun structure except the inhomogeneous electric field establishing electrode, the driving conditions of the cathode ray tube, the application of the cathode ray tube and so on.

Figure 21A:
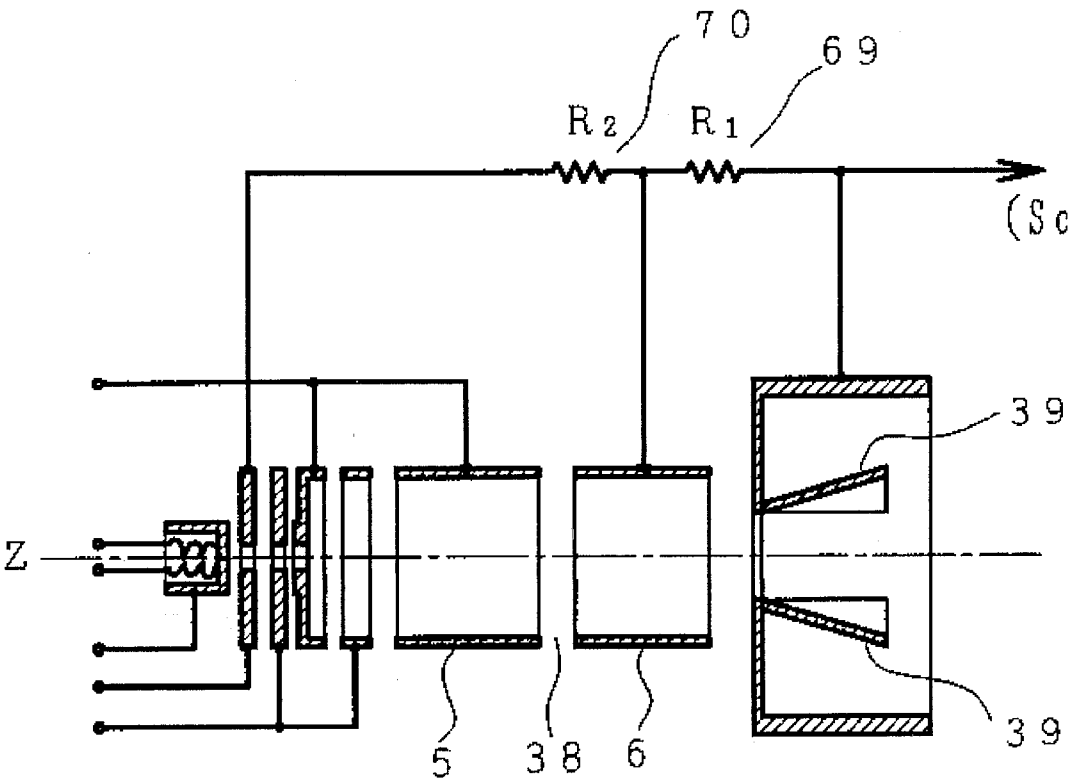
FIGS. 21A and 21B are explanatory diagrams showing another example of the structure of the deflection aberration correcting electrode in the electron gun used in the cathode ray tube of the present invention.
Figure 21B:
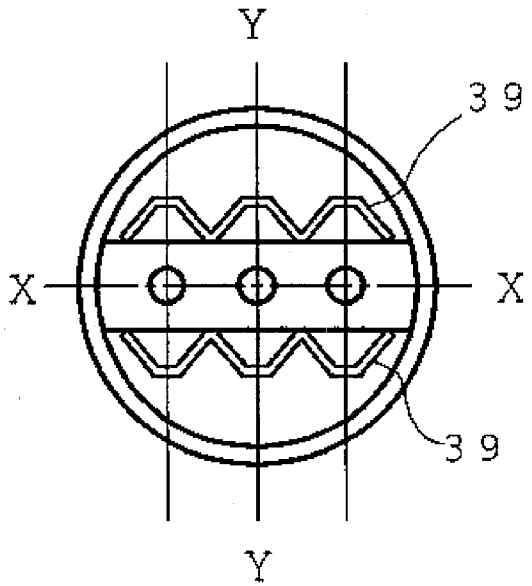

FIGS. 21A and 21B are explanatory diagrams showing another example of the structure of the deflection aberration correcting electrode in the electron gun used in the cathode ray tube of the present invention. In FIGS. 21A and 21B, the deflection aberration correcting electrode 39 for forming the fixed inhomogeneous electric field in the deflecting magnetic field is connected with the fluorescent face of the cathode ray tube so that it is fed with the same potential as the fluorescent face.

The potential of the anode 60 of the electron gun is obtained by dividing the potential of the fluorescent face by voltage dividing resistors 69 and 70 within the cathode ray tube. That terminal of the resistor 70 which is not connected with the anode 6 is led to the outside of the cathode ray tube and is directly grounded earth or connected with another power source.

Figure 22C:
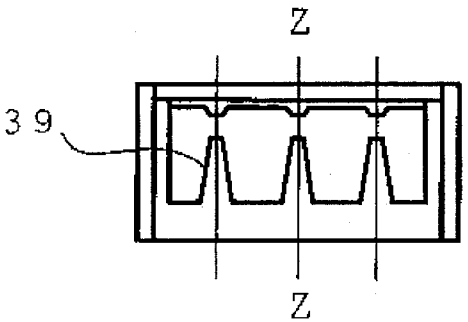
FIGS. 22A–22C are explanatory diagrams showing still another example of the structure of the deflection aberration correcting electrode in the electron gun used in the cathode ray tube of the present invention.
Figure 22B:
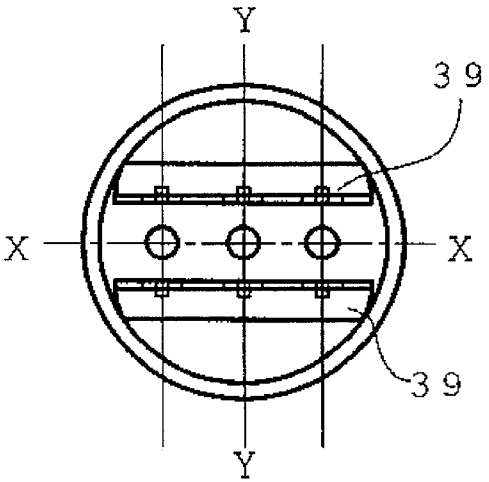
Figure 22A:
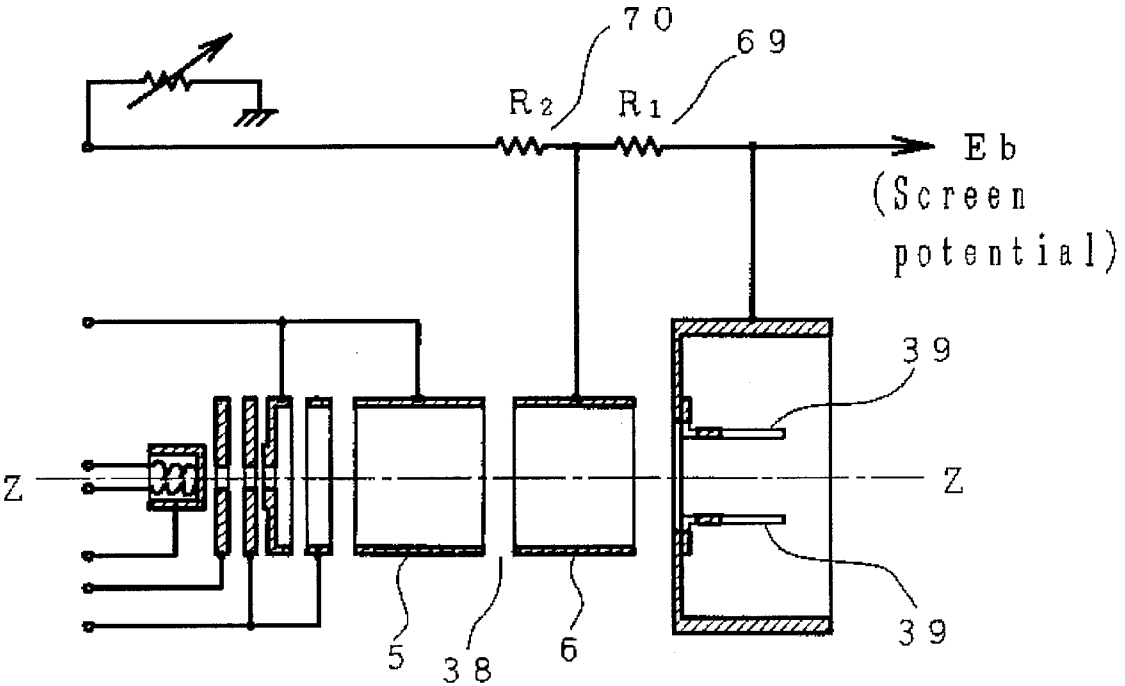

FIGS. 22A–22C are explanatory diagrams showing still another example of the structure of the deflection aberration correcting electrode in the electron gun used in the cathode ray tube of the present invention.

In this example of structure, the power feed of FIG. 77 is grounded through a variable resistor to adjust the anode voltage from the outside of the cathode ray tube.

However, the voltage applying methods of the foregoing Figures are not uniquely determined.

Figure 23C:
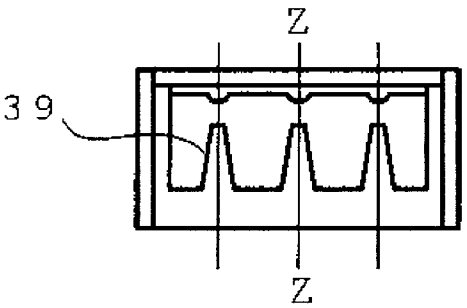
FIGS. 23A–23C are explanatory diagrams showing a further example of the structure of the deflection aberration correcting electrode in the electron gun used in the cathode ray tube of the present invention.
Figure 23B:
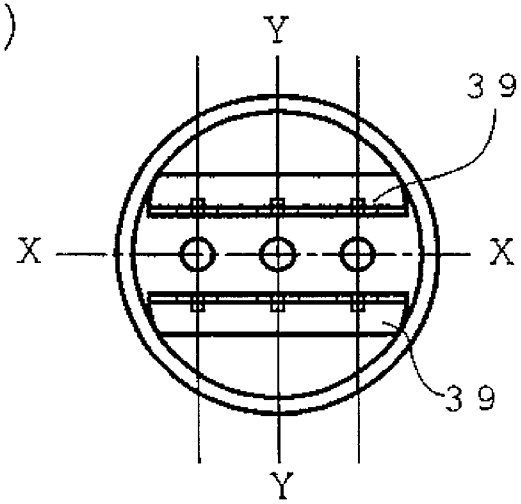
Figure 23A:
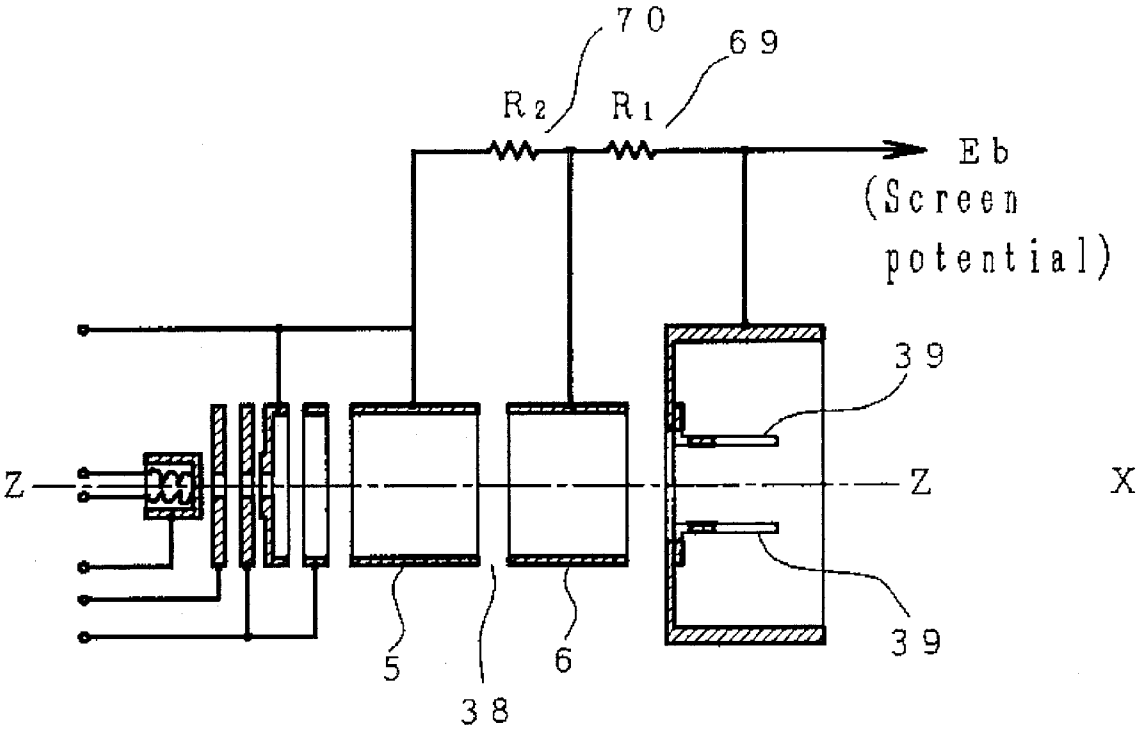

FIGS. 23A–23C are explanatory diagrams showing a further example of the structure of the deflection aberration correcting electrode in the electron gun used in the cathode ray tube of the present invention.

In FIGS. 23A–23C, the deflection aberration correcting electrode 39 for forming the fixed inhomogeneous electric field in the deflecting magnetic field s connected with the fluorescent face of the cathode ray tube and is fed with the same potential as that of the fluorescent face. The potential of the anode 6 of the electron gun is obtained by dividing the potential of the fluorescent face by the resistors 69 and 70 with the cathode ray tube, and the resistor 70 is connected with the focus electrode 5 within the cathode ray tube and can be adjusted together with the focus voltage when assembled in the image display device.

Figure 24B:
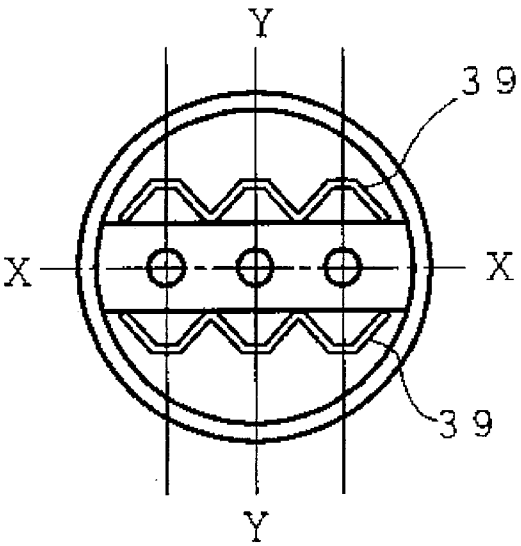
FIGS. 24A and 24B are explanatory diagrams showing a further example of the structure of the deflection aberration correcting electrode in the electron gun used in the cathode ray tube of the present invention.
Figure 24A:
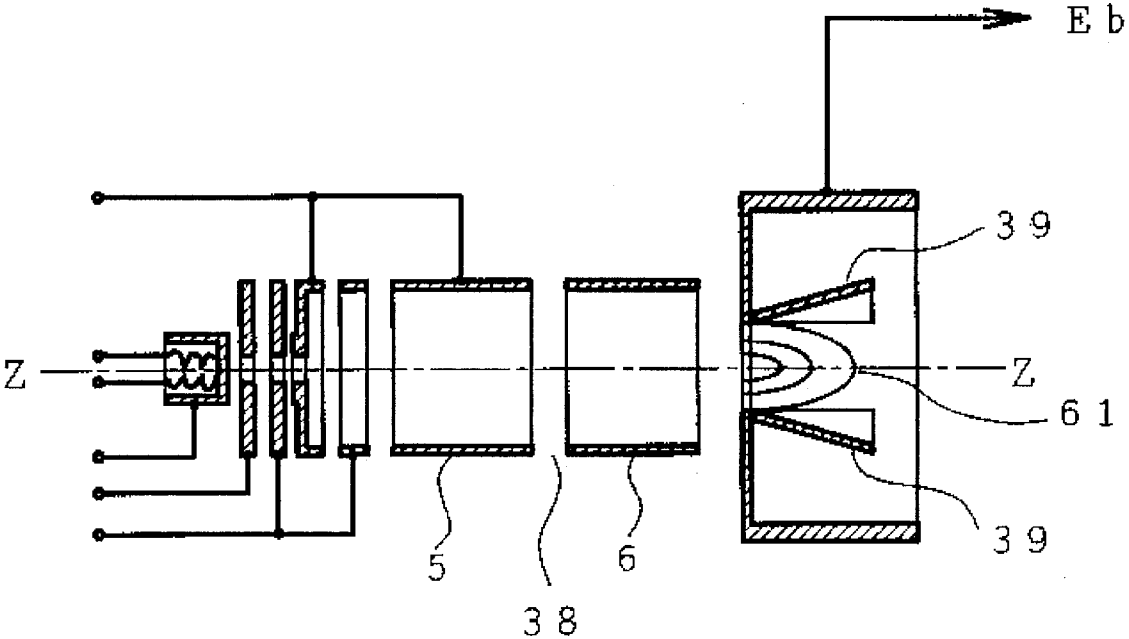

FIGS. 24A and 24B are explanatory diagrams showing a further example of the structure of the deflection aberration correcting electrode in the electron gun used in the cathode ray tube of the present invention.

In FIGS. 24A and 24B, the deflection aberration correcting electrode 39 for forming the fixed inhomogeneous electric field in the deflecting magnetic field is fed with the same potential as that of the anode 6 of the electron gun. Thanks to this connection, no special potential supply is necessary including that for the deflection aberration correcting electrode 39, and the considerations to be taken into the voltage withstanding characteristics of the individual electrodes can be minimized to simplify the assembly of the electron gun. Thus, it is possible to provide a cathode ray tube at a reasonable cost.

Figure 25C:
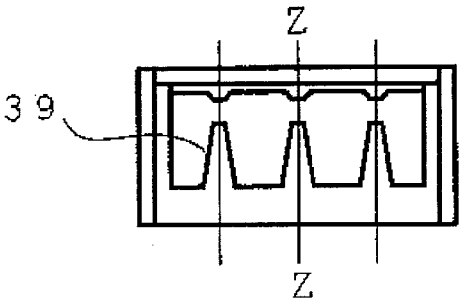
FIGS. 25A–25C are explanatory diagrams showing a further example of the structure of the deflection aberration correcting electrode in the electron gun used in the cathode ray tube of the present invention.
Figure 25B:
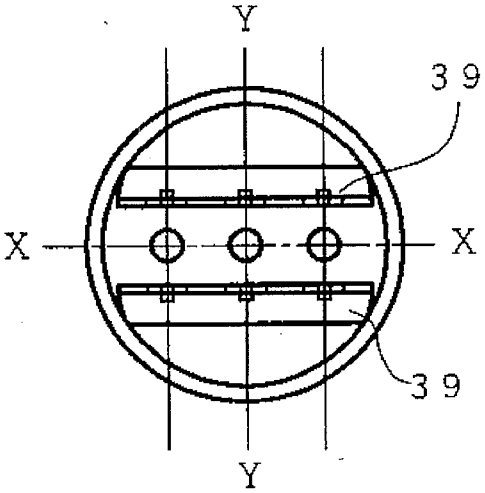
Figure 25A:
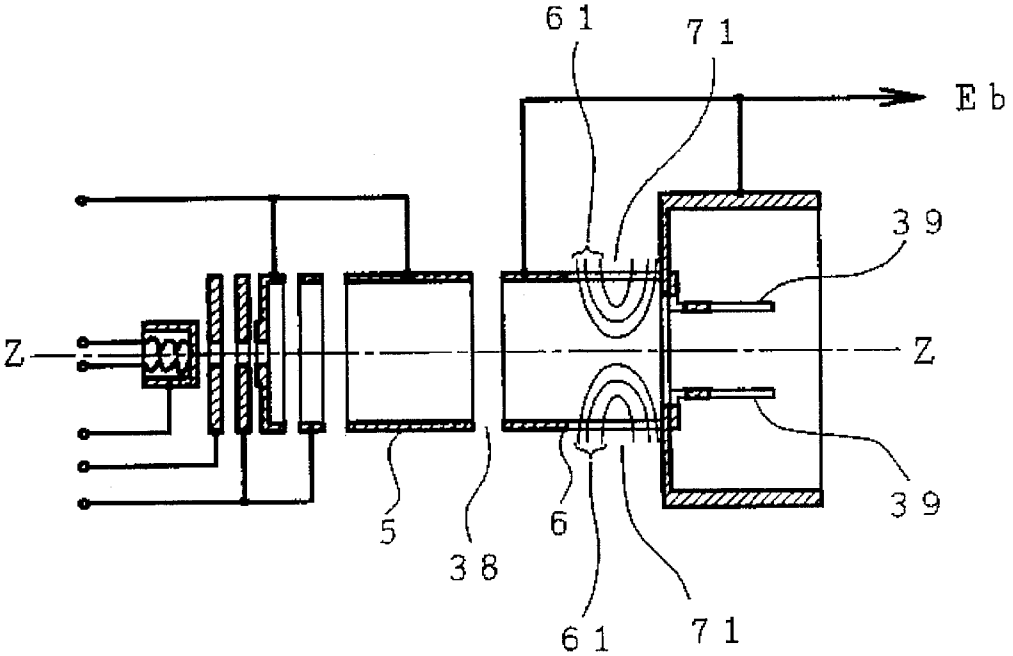

FIGS. 25A–25C are explanatory diagrams showing a further example of the structure of the deflection aberration correcting electrode in the electron gun used in the cathode ray tube of the present invention.

In FIGS. 25A–25C, the deflection aberration correcting electrode 39 for forming the fixed inhomogeneous electric field in the deflecting magnetic field is fed with the same potential as that of the anode 6 of the electron gun, but the anode 6 is formed with an aperture 71 in addition to the electron beam transmitting hole so that the electric field to be S established between the anode 6 and an electrode at a potential different from that of the anode 6 may penetrate through the aperture 71 into the vicinity of the deflection aberration correcting electrode 39 to control the aforementioned inhomogeneous electric field.

Thanks to this structure, no special potential supply is necessary including that for the deflection aberration correcting electrode 39, and the considerations to be taken into the voltage withstanding characteristics of the individual electrodes can be minimized to simplify the assembly of the electron gun. Thus, it is possible to provide a cathode ray tube at a reasonable cost.

Figure 26B:
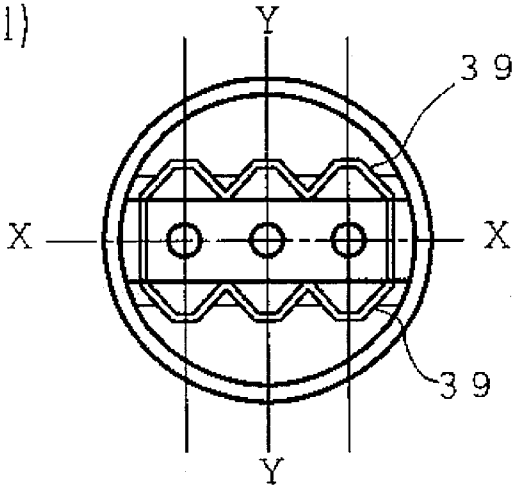
FIGS. 26A and 26B are explanatory diagrams showing a further example of the structure of the deflection aberration correcting electrode in the electron gun used in the cathode ray tube of the present invention.
Figure 26A:
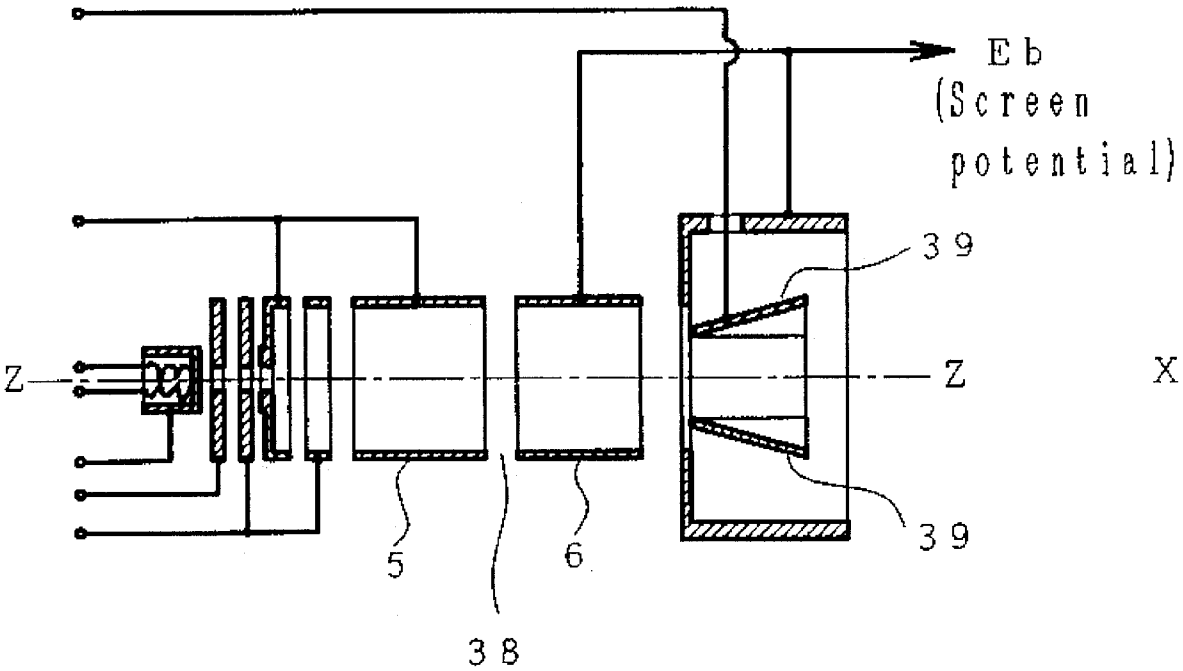

FIGS. 26A and 26B are explanatory diagrams showing a further example of the structure of the deflection aberration correcting electrode in the electron gun used in the cathode ray tube of the present invention. FIG. 26A presents a schematic diagram showing the construction of the electron gun, and FIG. 26B presents a front elevation of the deflection aberration correcting electrode.

In FIGS. 26A and 26B, the deflection aberration correcting electrode 39 for forming the fixed inhomogeneous electric field in the deflecting magnetic field is fed with a potential different from those of the anode 6 of the electron gun and the fluorescent face of the cathode ray tube. Thanks to this structure, the potential of the deflection aberration correcting electrode 39 can be freely set to provide a flexible electron gun having an increased freedom of design in the cathode ray tube to which the electron gun is applied.

Figure 27B:
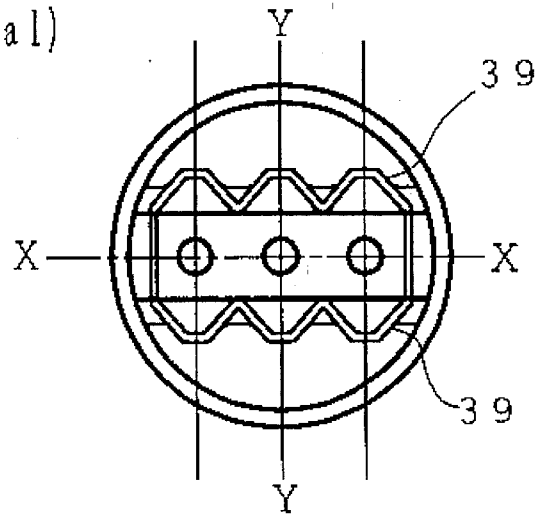
FIGS. 27A and 27B are explanatory diagrams showing a further example of the structure of the deflection aberration correcting electrode in the electron gun used in the cathode ray tube of the present invention.
Figure 27A:
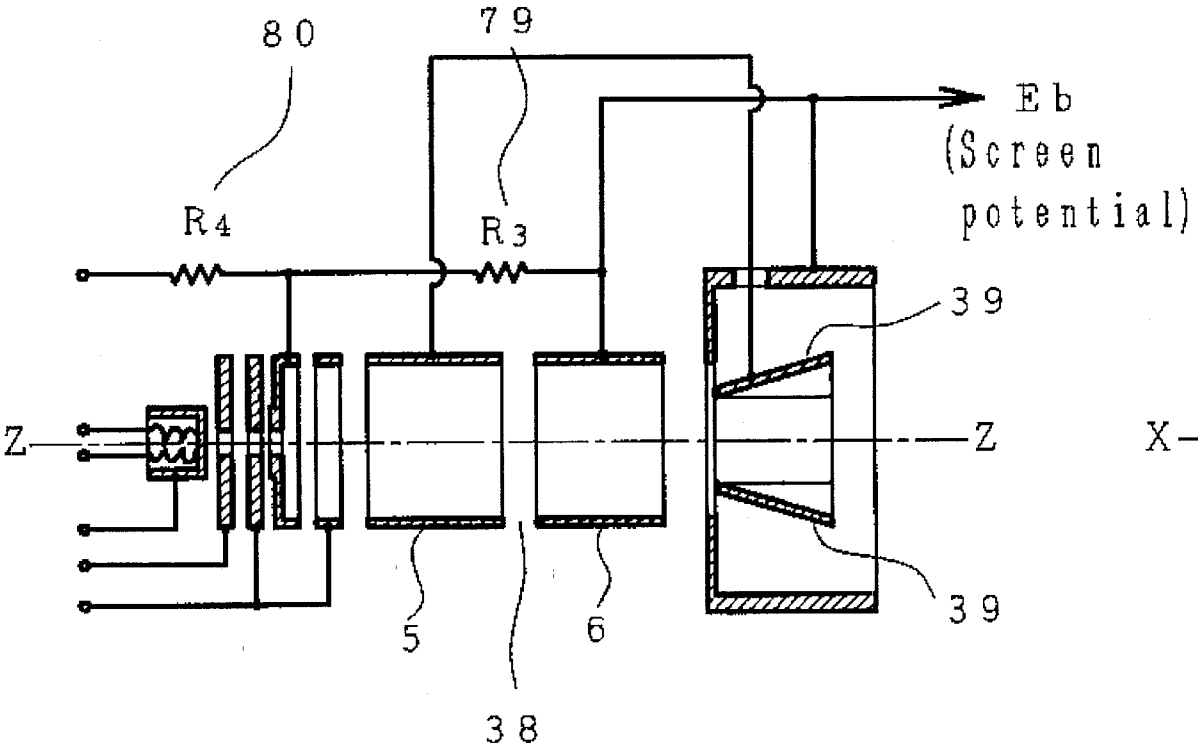

FIGS. 27A and 27B are explanatory diagrams showing a further example of the structure of the deflection aberration correcting electrode in the electron gun used in the cathode ray tube of the present invention. FIG. 27A presents a schematic diagram showing the construction of the electron gun, and FIG. 27B presents a front elevation of the deflection aberration correcting electrode.

In FIGS. 27A and 27B, the deflection aberration correcting electrode 39 for forming the fixed inhomogeneous electric field in the deflecting magnetic field is disposed in the anode 6 of the electron gun and is fed with a lower potential than that of the anode 6.

In FIGS. 27A and 27B, moreover, the lower potential is equal to that of the focus electrode 5.

In FIGS. 27A and 27B, still moreover, the potential of the focus electrode 5 is generated by dividing the potential to be fed to the anode 6 in the cathode ray tube by resistors 79 and 80.

In FIGS. 27A and 27B, furthermore, the potential of the deflection aberration correcting electrode 39 for forming the fixed inhomogeneous electric field in the deflecting magnetic field can be adjusted from the outside of the cathode ray tube by either connecting that terminal of the resistor 80 which is not connected with the focus electrode 5, with another power source outside of the cathode ray tube or grounding the same to the earth through a variable resistor. Thus, the power source for the focus voltage can be omitted, when the cathode ray tube is used in the image display device, to reduce the production cost.

Figure 28C:
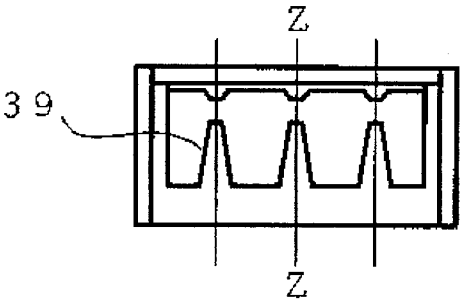
FIGS. 28A –28C are explanatory diagrams showing a further example-of the structure of the deflection aberration correcting electrode in the electron gun used in the cathode ray tube of the present invention.
Figure 28B:
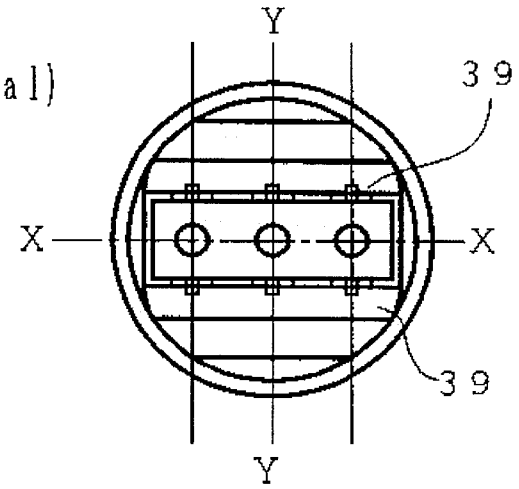
Figure 28A:
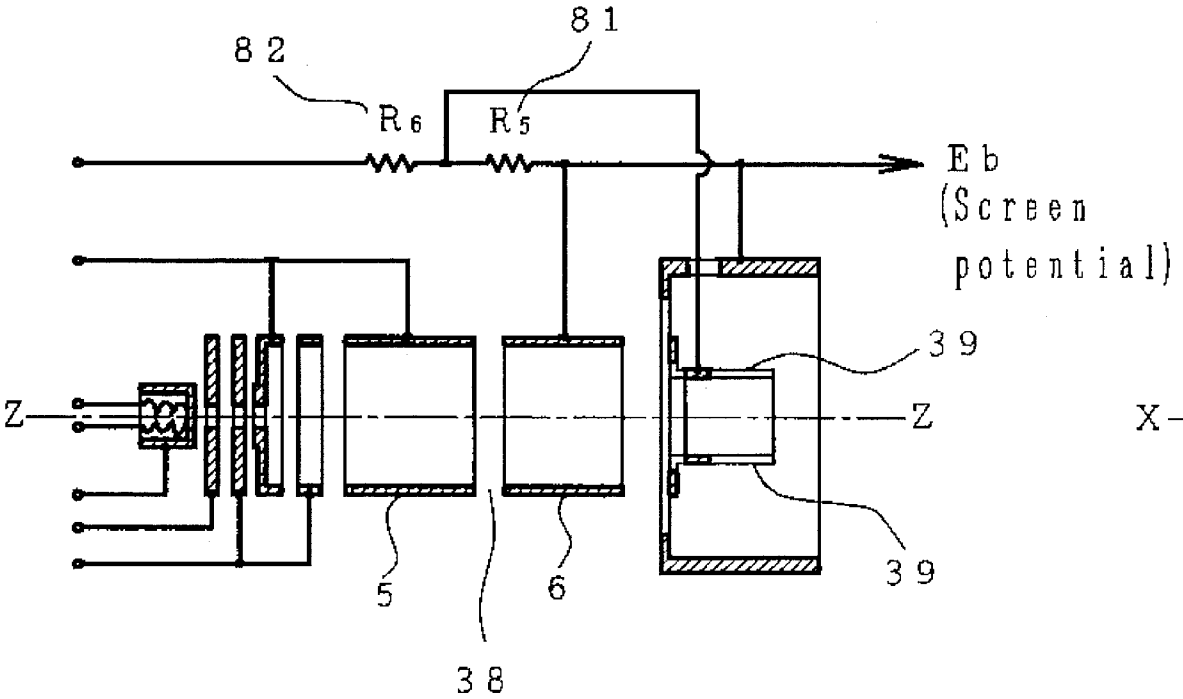

FIGS. 28A–28C are explanatory diagrams showing a further example of the structure of the deflection aberration correcting electrode in the electron gun used in the cathode ray tube of the present invention. FIG. 28A presents a schematic diagram showing the construction of the electron gun; FIG. 28B presents a front elevation of the deflection aberration correcting electrode; and FIG. 28C presents a top plan view of the deflection aberration correcting electrode.

In FIGS. 28A–28C, the deflection aberration correcting electrode 39 for forming the fixed inhomogeneous electric field in the deflecting magnetic field is disposed in the anode 6 of the electron gun and is fed with a potential lower than that of the anode 6.

Moreover, this lower potential is generated by dividing the potential to be fed to the anode in the cathode ray tube by resistors 81 and 82.

In FIGS. 28A–28C, furthermore, the potential of the deflection aberration correcting electrode 39 for forming the fixed inhomogeneous electric field in the deflecting magnetic field can be adjusted from the outside of the cathode ray tube by either connecting that terminal of the resistor 82 which is not connected with the deflection aberration correcting electrode 39 for forming the fixed inhomogeneous electric field in the deflecting magnetic field, with another power source outside of the cathode ray tube or grounding the same to the earth through a variable resistor. The potential of the deflection aberration correcting electrode 39 for forming the fixed inhomogeneous electric field in the deflecting magnetic field is especially conveniently set to a potential approximate to that of the anode 6.

Figure 29:
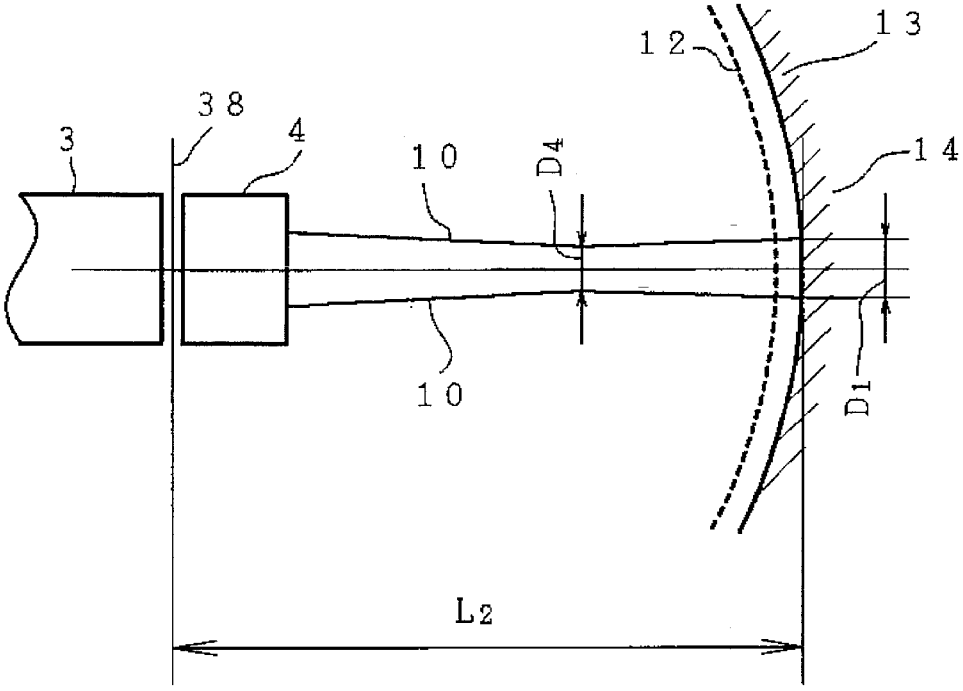
FIG. 29 PRIOR ART
FIG. 29 is an explanatory diagram showing the influences of repulsion of a space charge upon an electron beam between a main lens and a fluorescent film.

FIG. 29 is an explanatory diagram showing how the repulsion of a space charge influences upon the electron beam 10 between the main lens 38 and the fluorescent film 13. Reference letter $L_2$ indicates the distance between the main lens 38 and the fluorescent film 13.

In FIG. 29, as the electron beam 10 goes sufficiently far from the anode 4 (i.e., the fourth electrode), the space around the electron beam takes the anode potential so that the electric field substantially disappears. In this state, the electron beam 10 advancing under the converging action by the man lens 38 takes a minimum diameter $D_4$ before it reaches the fluorescent film 13, because the orbit changing action by the repulsion of the space charge increases, and the electron beam 10 then has its diameter increased, as it comes close to the fluorescent film 13, and it takes the diameter $D_1$ at the fluorescent film 13.

Figure 30:
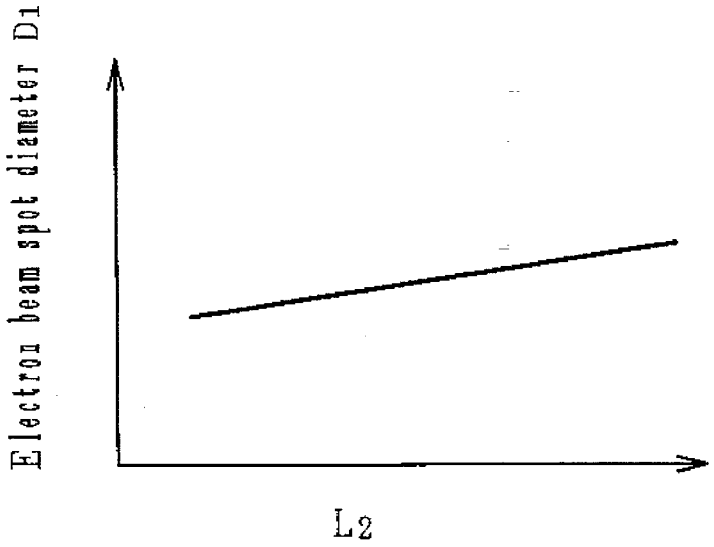
FIG. 30 is an explanatory diagram plotting the relation of the size of the electron beam spot on the fluorescent film to the distance between the main lens and the fluorescent lens.

FIG. 30 is an explanatory diagram plotting the relation of the size of the electron beam spot on the fluorescent film to the distance between the main lens and the fluorescent lens. The aforementioned action depends upon the distance $L_2$ between the main lens 38 and the fluorescent film 13 in case the cathode ray tube is driven under the same conditions, and the diameter $D_1$ increases with the increase of the distance $L_2$ as shown in FIG. 30.

If the cathode ray tube to be used in a color TV is taken as an example, the distance $L_2$ increases with the increase of the screen size of the cathode ray tube, once the maximum deflection angle is determined. As the screen size of the cathode ray tube increases, the diameter of the electron beam spot on the fluorescent film 13 increases so that the resolution will not increase so much irrespective of the increase of the screen size.

Figure 31:
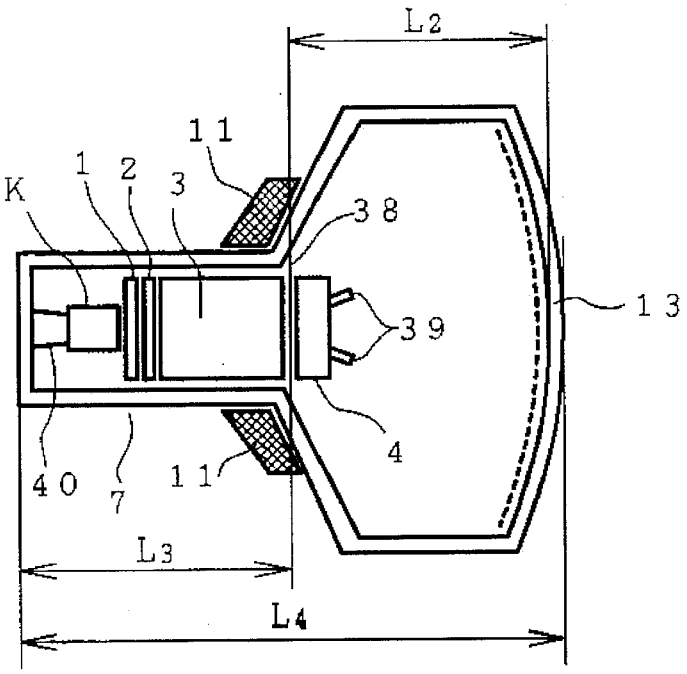
FIG. 31 is a schematic section for explaining an example of the size of one embodiment of the cathode ray tube according to the present invention.
Figure 32:
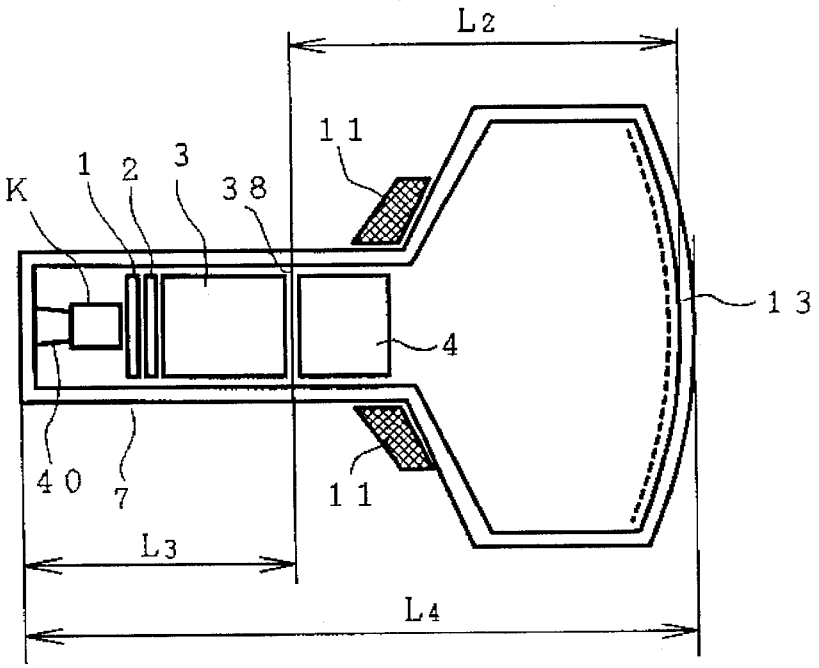
FIG. 32 PRIOR ART
FIG. 32 is a schematic section of a cathode ray tube according to the prior art to be compared with the example of the size of the embodiment of the cathode ray tube according to the present invention.

FIG. 31 is a schematic section for explaining an example of the size of one embodiment of the cathode ray tube according to the present invention, and FIG. 32 is a schematic section of a cathode ray tube according to the prior art to be compared with the example of the size of the embodiment of the cathode ray tube according to the present invention. The same reference numerals as those of FIG. 5 designate the same portions.

Both the cathode ray tubes of FIGS. 31 and 32 use electron guns having identical specifications. As a result, the distance $L_3$ from the bottom portion or stem portion of the cathode ray tube to the main lens 38 is common.

In the cathode ray tube according to the prior art shown in FIG. 32, however, the main lens 38 of the electron gun has to be spaced from the deflecting magnetic field region established by the deflection yoke 11 so as to prevent the electron beam passing through the main lens 38 from being disturbed by the deflecting magnetic field, so that the electron gun is disposed in a position retracted from the deflection yoke 11 toward the neck portion 7. As a result, the distance $L_2$ between the main lens 38 and the fluorescent film 13 cannot be made shorter than that between the deflection yoke 11 and the fluorescent film 13.

In order to improve the resolution at the center of the fluorescent film of the cathode ray tube, the enlargement of the aperture of the main lens has been pursued in the related industry. The effect of the increased aperture is exhibited by the enlarged diameter of the electron beam travelling in the main lens 38. Since the electron beam travelling in the main lens 38 is disturbed the more with increasing diameter of the electron beam by the deflecting magnetic field, the electron gun had to be spaced the more from the deflecting magnetic field for the main lens having the larger aperture.

In the example of the construction of the present invention shown in FIG. 31, on the contrary, thanks to the structure in which the deflection aberration correcting electrode 39 for forming the fixed inhomogeneous electric field in the deflecting magnetic field is provided considering that the electron beam passing through the main lens 38 is disturbed in the deflecting magnetic field, that distance $L_2$ can be made shorter than that between the deflection yoke 11 and the fluorescent film 13. According to the aforementioned embodiment of the present invention, therefore, the distance between the main lens of the cathode ray tube and the fluorescent film can be made shorter than that of the cathode ray tube of the prior art, and the influences of the repulsion of the space charge can be reduced thanks to the compatibility with the main lens having a larger aperture even if the screen size of the cathode ray tube increases, to reduce the diameter of the electron beam spot on the fluorescent film 13 thereby to provide a cathode ray tube having a high resolution.

Thus, since the electron gun has heretofore been difficult to shorten while suppressing the deterioration in its focusing characteristics, it has been restricted and difficult to shorten the total length $L_4$ of the cathode ray tube. In one embodiment of the present invention, on the contrary, the total length $L_4$ of the cathode ray tube can be remarkably shortened, as compared with the example of the prior art, without any change of the portion from the cathode of the electron gun to the main lens by shortening the distance between the main lens 38 and the fluorescent film 13, as shown in FIG. 31.

In one embodiment of the present invention, the parts described with reference to FIG. 12 are attached as the deflection aberration correcting electrode for forming the fixed inhomogeneous electric field in the deflecting magnetic field to the electron gun anode 6, as shown in FIG. 13, and the electron gun thus constructed is applied to the color cathode ray tube using in-line three electron beams, which has a external neck portion diameter of 29 mm, a maximum deflection angle of 108 degrees, a diagonal of the fluorescent film of 59 cam. The aperture diameter $L_2$, as taken in the perpendicular direction to the scanning line, of the end **6*a* of the electron gun anode 6 facing the main lens is 8 mm. A satisfactory result is achieved by combining the cathode ray tube with the deflecting magnetic field shown in FIG. 8, by setting the end 6*a* of the anode 6** facing the main lens to a position of 85 mm in the Z-axis of the same figure, and by driving the cathode ray tube with an anode voltage of 30 KV. The magnetic flux density of that portion is 0.017 millitesla per root of an anode voltage of 1 V, which is about 66% as high as the maximum magnetic flux density. That portion is located at about 20 mm from the end portion of the core of the coil for establishing the deflecting magnetic field remote from the fluorescent film. Similar confirmation using the prior art has revealed that the influences of the disturbance on the electron beam due to the deflecting magnetic field are observed at the position of about 100 mm or less in the Z-axis of the end of the anode facing the main lens, and that the resolution in the periphery of the fluorescent film is degraded.

In the embodiment of the present invention, the parts described with reference to FIG. 12 are attached as the deflection aberration correcting electrode for forming the fixed inhomogeneous electric field in the deflecting magnetic field to the electron gun anode 6, as shown in FIG. 13, and the electron gun thus constructed is applied to the color cathode ray tube using in-line three electron beams, which has a external neck portion diameter of 29 mm, a maximum deflection angle of 90 degrees, a diagonal of the fluorescent film of 48 cm. The aperture diameter $L_2$, as taken in the perpendicular direction to the scanning line, of the end 6*a* of the electron gun anode 6 facing the main lens is 8 mm. A satisfactory result is achieved by combining the cathode ray tube with the deflecting magnetic field shown in FIG. 8, by setting the end 6*a* of the anode 6 facing the main lens to a position of 70 mm in the z-axis of the same figure, and by driving the cathode ray tube with an anode voltage of 30KV. The magnetic flux density of that portion is 0.01 millitesla per root of an anode voltage of 1 V, which is about 55% as high as the maximum magnetic flux density. That portion is located at about 13 mm from the end portion of the core of the coil for establishing the deflecting magnetic field remote from the fluorescent film. Similar confirmation using the Prior art, as revealed that the influences on the disturbance of the electron beam due to the deflecting magnetic field are observed at the position of about 82 mm or less in the Z-axis of the end of the anode facing the main lens, and that the resolution in the periphery of the fluorescent film is degraded.

In the embodiment of the present invention, the parts of FIG. 12 are attached as the deflection aberration correcting electrode for forming the fixed inhomogeneous electric field in the deflecting magnetic field to the electron gun anode, as shown in FIG. 15. The cathode ray tube thus constructed has a projection tube having a maximum deflection of 75 degrees and uses the electromagnetically focus coil 74 in addition to the electron gun main lens. In the same figure, the anode voltage of the electron gun is generated by dividing the fluorescent face voltage by the resistive film 75 formed on the inner wall of the neck portion 7 and the resistor 76 mounted in the cathode ray tube. The distance from the end 4*a* of the anode 4 of the electron gun facing the main lens to the end portion of the electrode 39 on the side of the fluorescent film is 180 mm.

Figure 33:
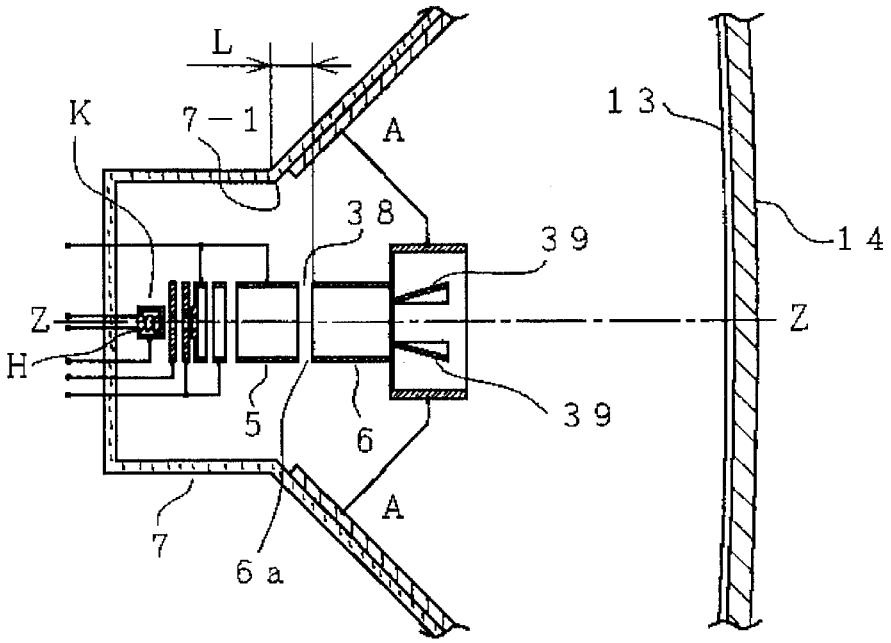
FIG. 33 is a schematic diagram showing an essential portion of one example of the cathode ray tube according to the present invention.

FIG. 33 is a schematic diagram showing an essential portion of one example of the cathode ray tube according to the present invention. By providing the deflection aberration correcting electrode 39 for forming the fixed inhomogeneous electric field in the deflecting magnetic field, the influences of the deflecting magnetic field can be suppressed to bring the main lens 38 closer to the fluorescent film 13, i.e., to the fluorescent face than the end portion 7-1 of the neck portion 7, as located on the side of the fluorescent film, from the end 6a of the anode 6 facing the main lens.

Since the electron gun of the cathode ray tube establishes a high electric field because a voltage is applied to the narrow electrode gap, a high-grade design technique is required for stabilizing the voltage withstanding characteristics, and a high-grade technique is also required for the quality control in the manufacture branch. The highest voltage is experienced in the vicinity of the main lens 38. The electric field in the vicinity of the main lens 38 is influenced by the charge of the inner wall of the neck portion and by the stick of such fine dust to the electron gun electrodes as will remain in the cathode ray tube. In the present embodiment, these drawbacks can be avoided because the main lens 38 does not face the neck portion 7.

By transferring the a position of electrical connection for applying a potential to the electron gun anode 6 from the inner wall of the neck portion 7 to the inner wall of the funnel portion 8, it is possible to prevent the deterioration of the voltage withstanding characteristics, which might otherwise be caused by the graphite film scraped off of the graphite film from the inner wall of the neck portion 7.

Figure 34:
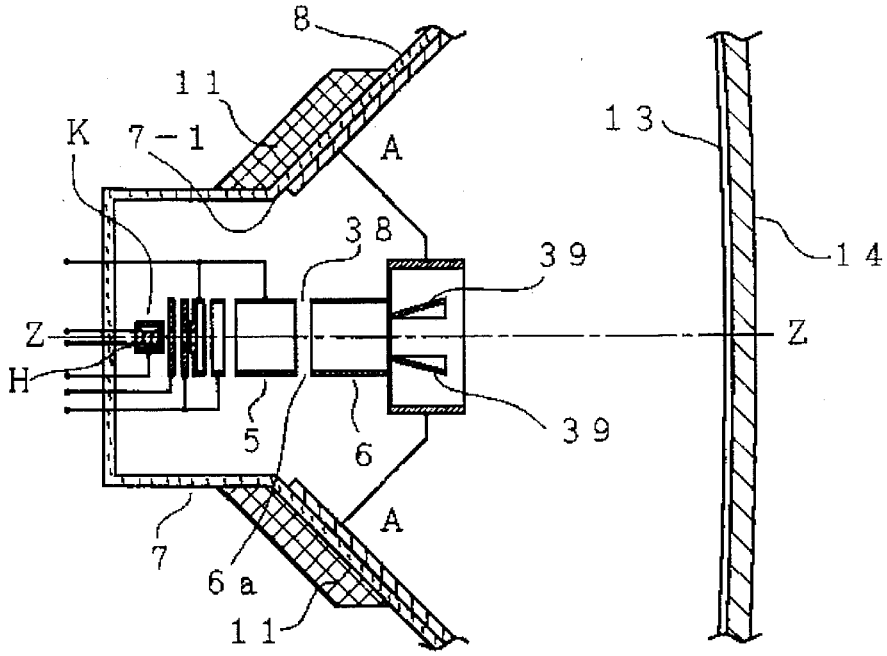
FIG. 34 is a schematic diagram showing an essential portion of another example of the cathode ray tube according to the present invention.

FIG. 34 is a schematic diagram showing an essential portion of one example of the cathode ray tube according to the present invention. By providing the deflection aberration correcting electrode 39 for forming the fixed inhomogeneous electric field in the deflecting magnetic field, the influences of the deflecting magnetic field can be suppressed to bring the main lens 38 closer to the fluorescent film 13, i.e., to the fluorescent face than the end portion 7-1 of the neck portion 7 on the side of the fluorescent film, from the end 6*a* of the anode 6 facing the main lens. As a result, a heater H for heating the cathode K of the electron gun has its heat transferred through the neck portion 7 to overheat the deflection yoke 11 together with the heat of the deflection yoke itself.

Figure 35:
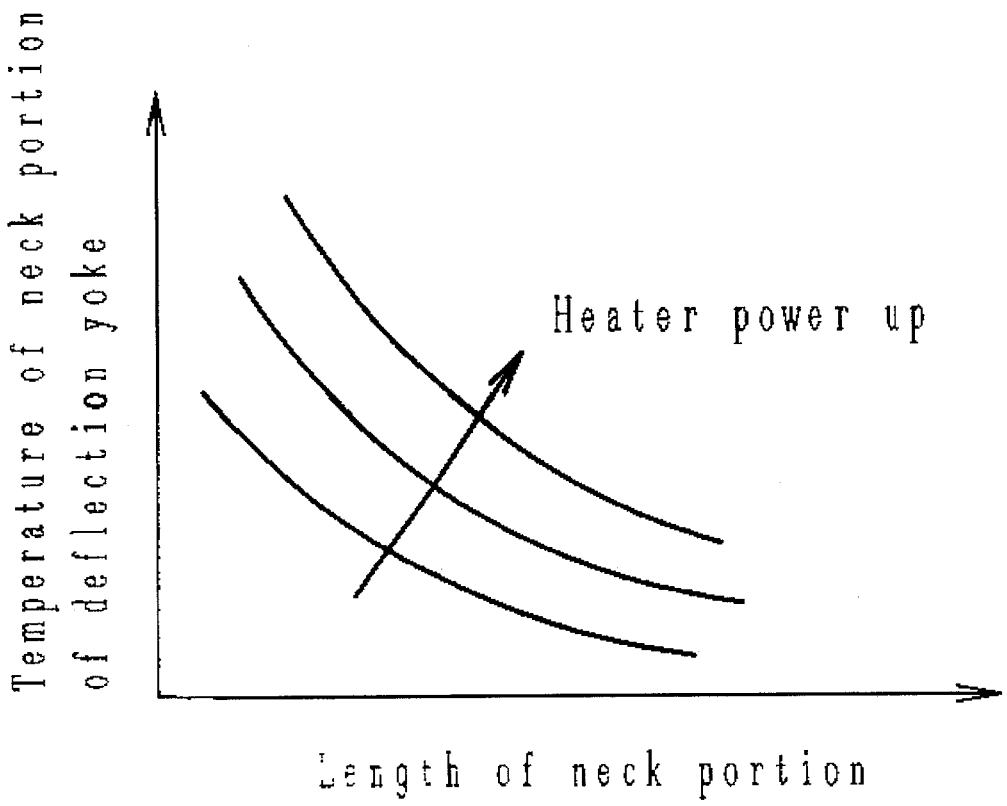
FIG. 35 is an explanatory diagram plotting the relations between the length L of a neck portion and the temperature T at the neck portion in the position of a deflection yoke.

FIG. 35 is an explanatory diagram plotting the relations between the length L of the neck portion and the temperature T at the neck portion mounting the deflection yoke. The temperature T drops with the increase in the length L. In the prior art, one cathode is operated with the heater power of 2 Watt. The temperature rise at the position of the deflection yoke is about 15° C. in case the neck portion is shortened by 40 mm from that in the prior art. The heater power required for returning that state near the original temperature level is 1.5 Watt or less for each cathode.

In the display device for a color TV set or a computer terminal, generally speaking, the depth of the cabinet depends upon the total length $L_4$ of the cathode ray tube. Especially in the color TV set of recent years, the cathode ray tube has a tendency to increase the screen size, and the depth of the cabinet cannot be ignored in case the TV set is installed in an ordinary house. Especially in case the TV set is juxtaposed to other furniture, the depth size of several tens millimeters may raise a problem. Thus, it can be said that the shortening of the depth size of the cabinet provides an remarkably great advantage in view of the installation efficiency and the usability.

According to the embodiments of the present invention thus far described, therefore, the total length of the cathode ray tube can be shortened to provide a color TV set which has its cabinet depth size made far shorter than those of the existing products without deteriorating the focusing characteristics. Thus, the TV set can enjoy an enhanced selling point.

Generally speaking, the color TV set, the completed cathode ray tube and their parts such as the funnel are far more bulky than the electronic parts such as semiconductor elements so that they take a far higher transportation cost per each item. This high cost cannot be ignored especially in case the product is shipped abroad a long way. According to the foregoing embodiments of the present invention, a color TV set having a shorter total length of the cathode ray tube and a shorter depth of the cabinet saves the transportation cost.

Here will be described more specifically the detail of the structure of the embodiments of the present invention.

Figure 36:
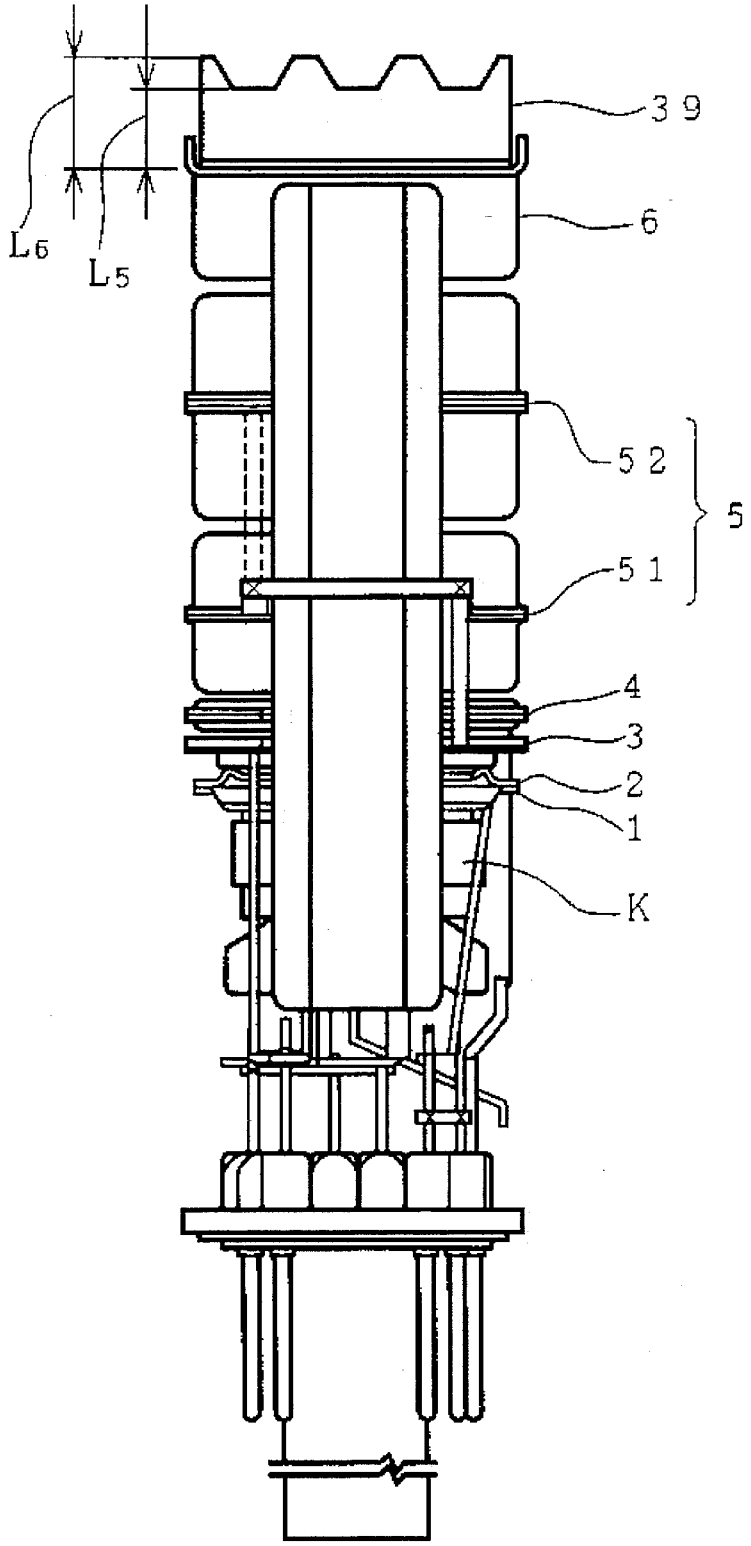
FIG. 36 is a side elevation for explaining an example of the detailed structure of the electron gun to be used in the cathode ray tube according to the present invention.
Figure 37:
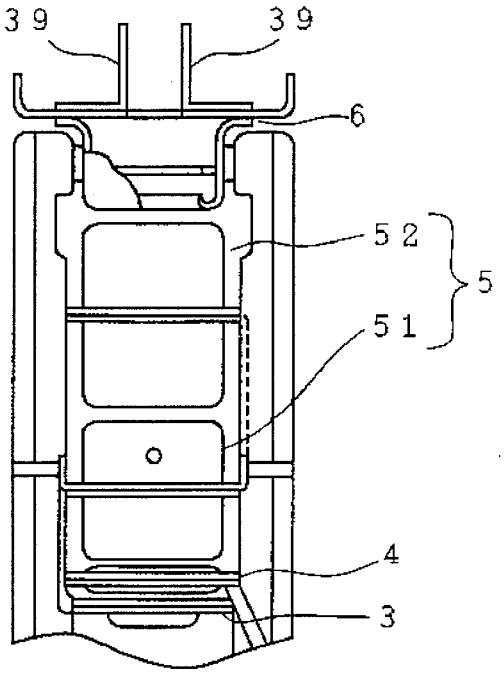
FIG. 37 is a partially broken side elevation showing an essential portion of the detailed structure of the electron gun to be used in the cathode ray tube according to the present invention.

FIG. 36 is a side elevation for explaining an example of the detailed structure of the electron gun to be used in the cathode ray tube according to the present invention, and FIG. 37 is a partially broken side elevation showing an essential portion of the same. The same reference numerals as those of FIGS. 83 and 84 designate the same portions.

In FIGS. 36 and 37, between the cathode K and the anode 6 (i.e., the sixth electrode), there are arranged the five electrodes, i.e., the first electrode 1, the second electrode 2, the third electrode 3, the fourth electrode 4 and the fifth electrode 5 (composed of electrodes 51 and 52), of which the third electrode 3 and the fifth electrode 5 are fed with the focusing potential whereas the second electrode 2 and the fourth electrode 4 are fed with the screen potential. Moreover, the firs electrode 1 is fed with the shielding potential and is frequently grounded to the earth.

Incidentally, FIG. 36 is a side elevation showing the in-line arrayed integral type three electron beam electron gun, as viewed in the direction perpendicular to the in-line, and FIG. 37 is a side elevation showing the main lens of FIG. 36 and its neighborhood, as viewed in the in-line direction.

In the cathode ray tube having the electron gun thus constructed, the deflection aberration correcting electrode 39 for establishing the fixed inhomogeneous electric field in the magnetic field of the deflection yoke 11 to correct the deflection aberration of the electron beam 10, when the electron beam 10 is to be deflected by the magnetic field of the deflection yoke 11, in accordance with the deflection angle is sized to have the following lengths. Specifically, the length L of the portion, which is passed by the three electron beams for no deflection in the in-line direction (i.e., the scanning line direction) and which extends toward the fluorescent face, is shorter than the length $L_6$ of the portion which is passed by the three electron beams deflected in the in-line direction and which extends toward the fluorescent face.

Moreover, the deflection aberration correcting electrode 39 is connected with and fixed to the anode 6. This structure can achieve the following operations.

The operations of the case, in which the electron gun is arranged in the cathode ray tube, as shown in FIG. 5, to deflect the electron beam 10 only in the direction perpendicular to the in-line direction, are similar to those described with reference to FIG. 6. In case, however, the deflection is simultaneously effected in the in-line direction, the electron beam 10 passes through the portion of the deflection aberration correcting electrode 39 having the larger length $L_6$ so that the operation of the deflection aberration correcting electrode 39, as has been described with reference to FIG. 6, is intensified. As a result, it is possible to effectively suppress the haloes in the beam spots 19 at the corner portions of the screen, for example, as shown in FIG. 73.

Figure 41D:
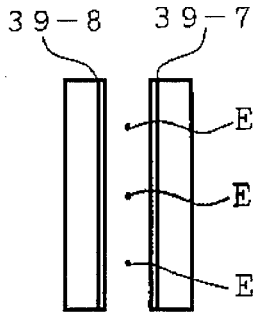
FIGS. 41A–41D are explanatory diagrams showing various examples of the specific structure of the deflection aberration correcting electrode positioned in the magnetic field of the deflection yoke for controlling the converging status of the electron beam in accordance with a deflection angle when the electron beam is to be deflected in the magnetic field of the deflection yoke.
Figure 41A:
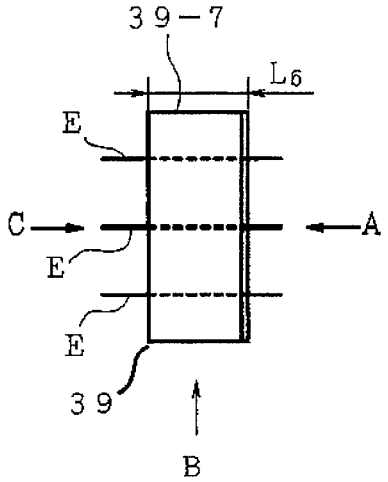
Figure 41B:
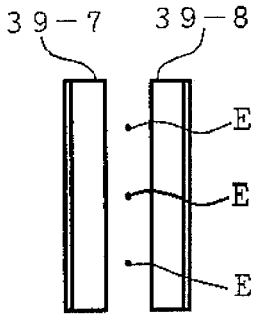
Figure 41C:
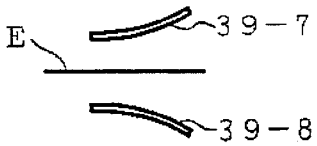
Figure 42D:
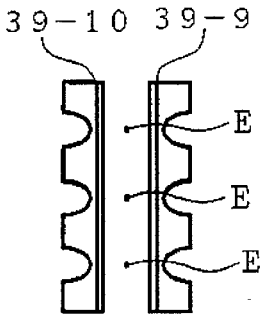
FIGS. 42A–42D are explanatory diagrams showing various examples of the specific structure of the deflection aberration correcting electrode positioned in the magnetic field of the deflection yoke for controlling the converging status of the electron beam in accordance with a deflection angle when the electron beam is to be deflected in the magnetic field of the deflection yoke.
Figure 42A:
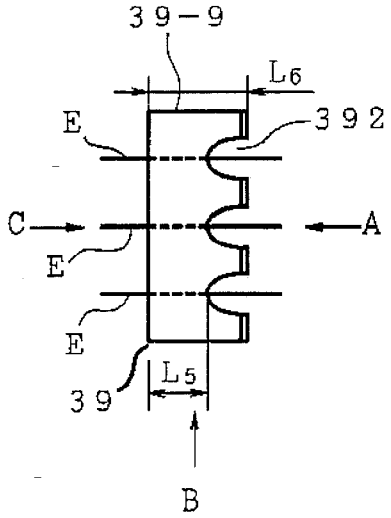
Figure 42B:
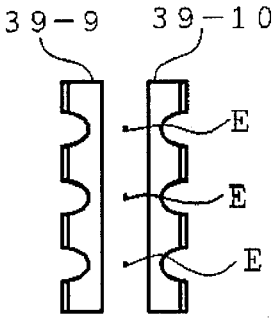
Figure 42C:
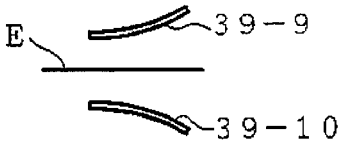

FIGS. 38A–38C, 39A–39C, 40A–40C, 41A–41D and 42A–42 present three plan diagrams (as of FIGS. 38A–38C, 39A–39C and 40A–40C) or four plan diagrams (as of FIGS. 41A–41D and 42A–42D) for explaining various examples of the specific structure of the deflection aberration correcting electrode positioned in the correcting magnetic field of the deflection yoke for correcting the deflection aberration of the electron beam in accordance with a deflection angle when the electron beam is to be deflected in the magnetic field of the deflection yoke, such as the deflection aberration correcting electrode 39 of FIGS. 36 and 37 for correcting the deflection aberration supplied with the anode potential. FIGS. 38A, 39A, 40A, 41A and 42A present top plan views, as taken in the perpendicular direction to the in-line direction; FIGS. 38B, 39B, 40B, 41B and 42B present front elevations, as taken in the direction of arrow A from FIGS. 38A, 39A, 40A, 41A and 42A, respectively; FIGS. 38C, 39C, 40C, 41C and 42C present side elevations, as taken in the direction of arrow B from 38A, 39A, 40A, 41A and 42A, respectively; and FIGS. 41D and 42D present back elevations, as taken in the direction of arrow C from FIGS. 41A and 42A). Incidentally, reference letter E appearing in these Figures indicates the electron beams receiving no deflection.

Figure 38A:
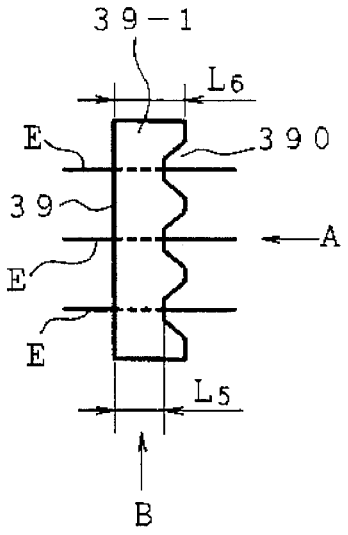
FIGS. 38A–38C are explanatory diagrams showing various examples of the specific structure of the deflection aberration correcting electrode positioned in the magnetic field of the deflection yoke for controlling the converging status of the electron beam in accordance with a deflection angle when the electron beam is to be deflected in the magnetic field of the deflection yoke.
Figure 38B:
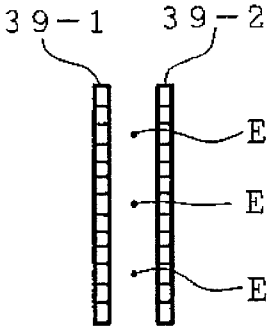
Figure 38C:
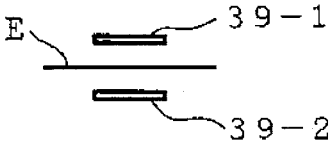

The deflection aberration correcting electrode 39 of FIGS. 38A–38C are composed of a first plate member 39-1 and a second plate member 39-2, which extend in parallel from the sixth electrode 6 toward the fluorescent film 13. These plate members 39-1 and 39-2 are individually formed with trapezoidal notches 390 at such positions for transmitting the three electron beams therethrough that the electron beams may pass through the central positions of the notches 390 when they are not deflected Moreover, the notch 390 has a length $L_5$ from its upper bottom, as taken toward the fluorescent film 13, and the plate member has a length $L_6$, as taken toward the fluorescent film 13.

Figure 39A:
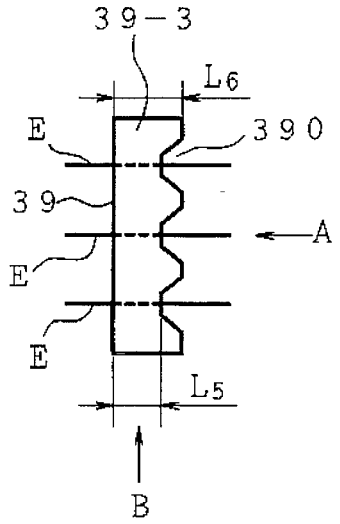
FIGS. 39A–39C are explanatory diagrams showing various examples of the specific structure of the deflection aberration correcting electrode positioned in the magnetic field of the deflection yoke for controlling the converging status of the electron beam in accordance with a deflection angle when the electron beam is to be deflected in the magnetic field of the deflection yoke.
Figure 39B:
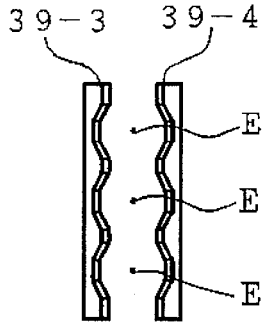
Figure 39C:
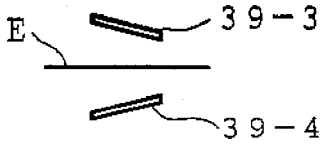

The deflection aberration correcting electrode 39 of FIGS. 39A–39C are composed of a first plate member 39-3 and a second plate member 39-4, which have shapes similar to those of FIGS. 38A–38C, but gradually converge toward the fluorescent film 13.

Figure 40A:
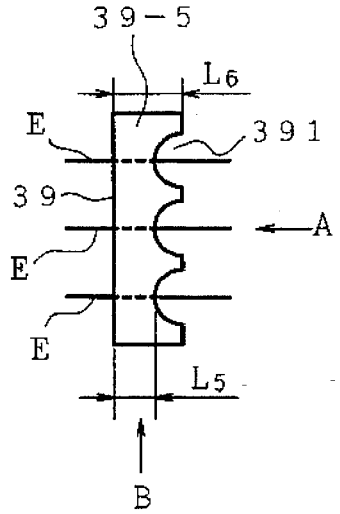
FIGS. 40A–40C are explanatory diagrams showing various examples of the specific structure of the deflection aberration correcting electrode positioned in the magnetic field of the deflection yoke for controlling the converging status of the electron beam in accordance with a deflection angle when the electron beam is to be deflected in the magnetic field of the deflection yoke.
Figure 40B:
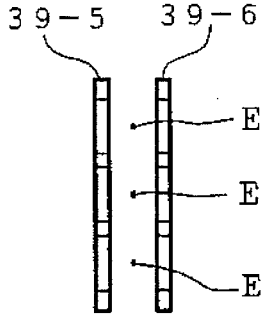
Figure 40C:
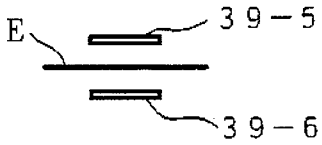

The deflection aberration correcting electrode 39 of FIGS. 40A–40C are composed of a first plate member 39-5 and a second plate member 39-6, which extend in parallel from the sixth electrode 6 toward the fluorescent film 13. These plate members 39-5 and 39-6 are individually formed with semicircular notches 391 at such positions for transmitting the three electron beams therethrough that the electron beams may pass through the central positions of the notches 391 when they are not deflected. Moreover, the notch 391 has a length $L_5$ from its central edge, as taken toward the fluorescent film 13, and the plate member has a length $L_6$, as taken toward the fluorescent film 13.

Specifically, the lengths $L_5$ of the notches 390 and 391 from the central edges toward the fluorescent film 13 are made shorter than the lengths $L_6$ of such portions extending toward the fluorescent face as are passed by the three electron beams when these are deflected in the in-line direction.

The deflection aberration correcting electrode 39 of FIGS. 41A–41D are composed of a first plate member 39-7 and a second plate member 39-8, which are curved to gradually spread toward the fluorescent film 13.

The deflection aberration correcting electrode 39 of FIGS. 42A–42D are composed of a first plate member 39-9 and a second plate member 39-10, which extend from the sixth electrode 6 toward the fluorescent film 13 and which are curved to gradually spread toward the fluorescent film 13. These plate members 39-9 and 39-10 are individually formed with semielliptical notches 392 at such positions for transmitting the three electron beams through the central positions thereof when they are not deflected. Moreover, the notch 392 has a length $L_5$ from its central edge, as taken toward the fluorescent film 13, and the plate member has a length $L_6$, as taken toward the fluorescent film 13; that is, the length such portions extending toward the fluorescent face as are passed by the three electron beams when these are deflected in the in-line direction.

Incidentally, the arrangement between the two plate members should not be limited to the aforementioned parallel and non-parallel ones, but the plate members can naturally be locally in non-parallel in the in-line direction.

FIGS. 43A–43C, 44A–44C, 45A–45C, 46A–46D, 47A–47D, 48A–48D, 49A–49D and 50A–50C present three plan diagrams (as of FIGS. 43A–43C, 44A–44C, 45A–45C and 50A–50C) or four plan diagrams (as of FIGS. 46A–46D, 47A–47D, 48A–48D and 49A–49D) for explaining examples of the structure in case the deflection aberration correcting electrode for establishing the fixed inhomogeneous electric field in the magnetic field of the deflection yoke and for correcting the deflection aberration of the electron beam in accordance with the deflection angle when the electron beam is to be deflected by the magnetic field of the deflection yoke is disposed in the position, as shown in FIGS. 36 and 37, but not connected with an anode but supplied with a lower potential than the anode potential.

In FIGS. 43A, 44A, 45A, 46A, 47A, 48A, 49A and 50A present top plan views, as taken in the perpendicular direction to the in-line direction; FIGS. 43B, 44B, 45B, 46B, 47B, 48B, 49B and 50B present front elevations, as taken in the direction of arrow A from FIGS. 43A, 44A, 45A, 46A, 47A, 48A, 49A and 50A; FIGS. 43C, 44C, 45C, 46C, 47C, 48C, 49C and 50C present side elevations, as taken in the direction of arrow B from FIGS. 43A, 44A, 45A, 46A, 47A, 48A, 49A and 50A; and FIGS. 46D, 47D, 48D and 49D present back elevations, as taken in the direction of arrow C from FIGS. 46A, 47A, 48A and 49A. Incidentally, reference letter E appearing in these Figures indicates the electron beams receiving no deflection.

A deflection aberration correcting electrode 39 of FIGS. 43A–43C are composed of two flat plates, i.e., a first plate member 39-11 and a second plate member 39-12, which extend in parallel from the sixth electrode 6 toward the fluorescent film 13. These plate members 39-11 and 39-12 are individually formed with projections 393 which are so positioned to transmit the three electron beams as to extend toward the fluorescent film 13, as shown, so that the electron beams E may transmit the central portions of the projections 393 when they receive no deflection. Moreover, the projection 393 is shaped to have a maximum projection length $L_5$ toward the fluorescent film 13 and to have its length gradually decreased in the in-line direction.

A deflection aberration correcting electrode 39' of FIGS. 44A–44C are composed of two flat plates, i.e., a first plate member 39-13 and a second plate member 39-14, which extend to gradually spread from the sixth electrode 6 toward the fluorescent film 13. These plate members 39-13 and 39-14 are individually formed with projections 393 like those of FIGS. 43A–43C, which are so positioned to transmit the three electron beams as to extend toward the fluorescent film 13, as shown, so that the electron beams E may transmit through the central portions of the projections 393 when they receive no deflection. Moreover, the projection 393 is shaped to have a maximum projection length $L_5$ toward the fluorescent film 13 and to have its length gradually decreased in the in-line direction.

Figure 45A:
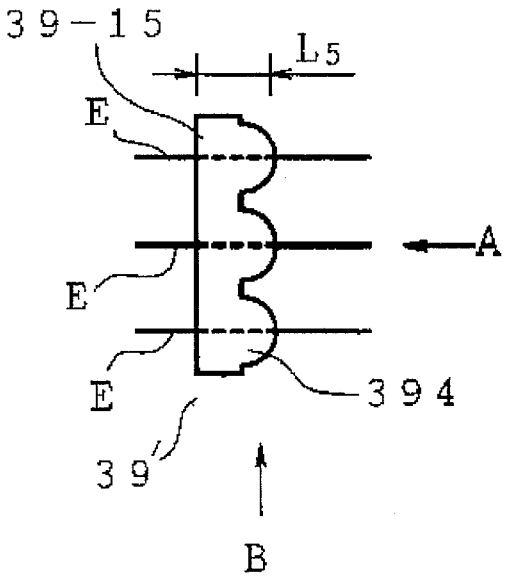
Figure 45B:
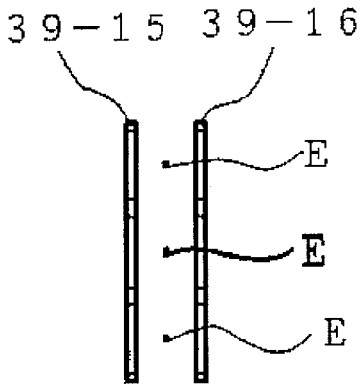
Figure 45C:
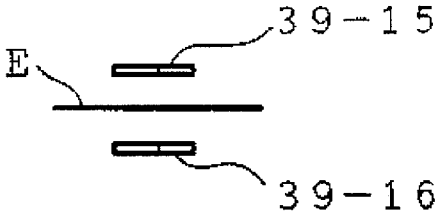
Figure 46D:
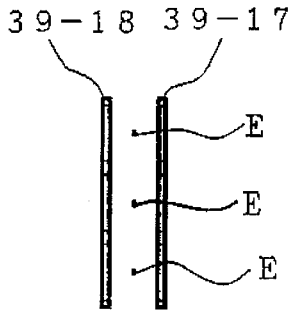
Figure 46A:
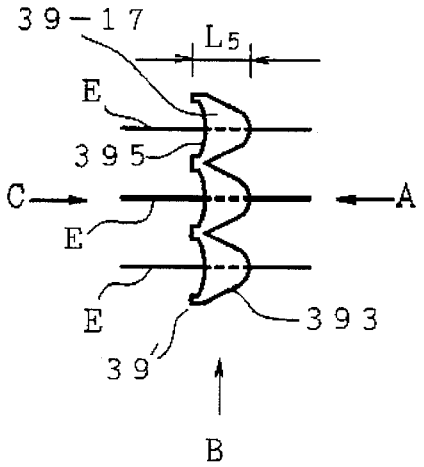
Figure 46B:
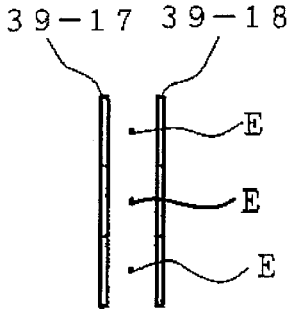
Figure 46C:
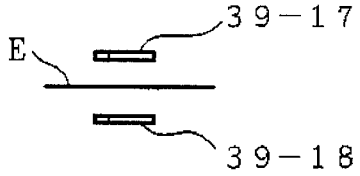
Figure 47D:
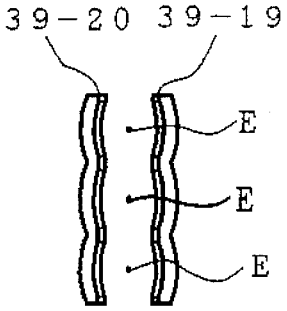
Figure 47A:
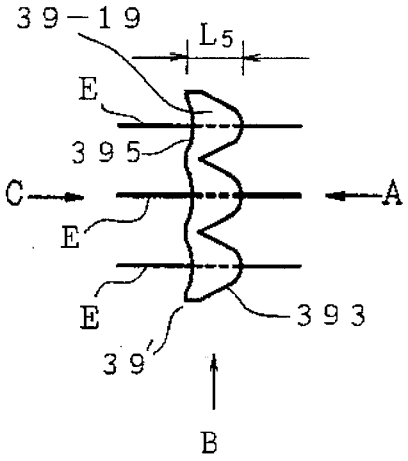
Figure 47B:
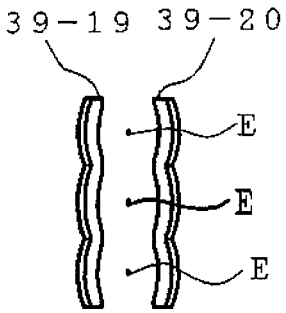
Figure 47C:
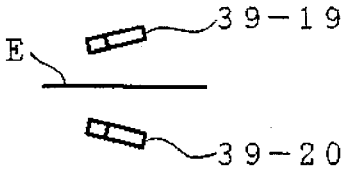
Figure 48D:
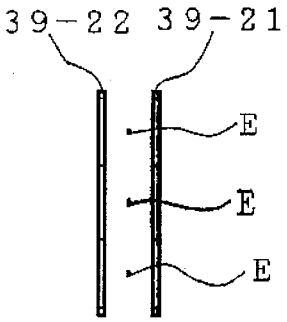
Figure 48A:
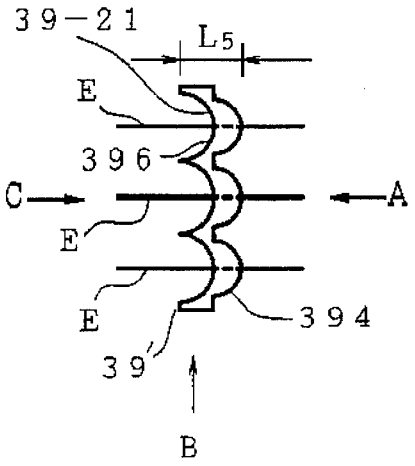
Figure 48B:
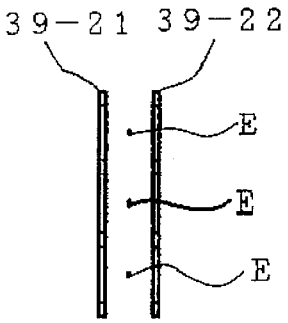
Figure 48C:
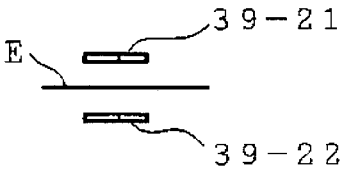

A deflection aberration correcting electrode 39' of FIGS. 45A–45C are composed of two flat plates, i.e., a first plate member 39-15 and a second plate member 39-16, which extend in parallel from the sixth electrode 6 toward the fluorescent film 13. These plate members 39-15 and 39-16 are individually formed with semicircular projections 394 which are so positioned to transmit the three electron beams as to extend toward the fluorescent film 13, as shown, so that the electron beams E may transmit between the central portions of the projections 394 when they receive no deflection. Moreover, the projection 394 is shaped to have a maximum projection length $L_5$ toward the fluorescent film 13.

A deflection aberration correcting electrode 39' of FIGS. 46A–46D are composed of two flat plates, i.e., a first plate member 39-17 and a second plate member 39-18, which extend in parallel from the sixth electrode 6 toward the fluorescent film 13. These plate members 39-17 and 39-18 are individually formed with both projections 393, which are so positioned to transmit the three electron beams as to extend toward the fluorescent film 13, as shown, and recesses 395, which are recessed at the side of the sixth electrode 6 toward the fluorescent film 13, so that the electron beams E may transmit through the central portions of the recesses 395 and the projections 393 when they receive no deflection. Moreover, the projection 393 is shaped to have a maximum projection length $L_5$ toward the fluorescent film 13 and to have its length gradually decreased in the in-line direction.

A deflection aberration correcting electrode 39' of FIGS. 47A–47D are composed of two flat plates, i.e., a first plate member 39-19 and a second plate member 39-20, which extend to gradually spread from the sixth electrode 6 toward the fluorescent film 13. These plate members 39-19 and 39-20 are individually formed with projections 393 like those of FIGS. 46A–46D, which are so positioned to transmit the three electron beams as to extend toward the fluorescent film 13, undulations, which are recessed to envelop the individual electron beams E in the in-line direction, and recesses 395, which are recessed on the side of the sixth electrode 6 toward the fluorescent film 13, so that the electron beams E may transmit through the central portions of the recesses 395 and the projections 396 when they receive no deflection. Moreover, the projection 393 is shaped to have a maximum projection length $L_5$ toward the fluorescent film 13 and to have its length gradually decreased in the in-line direction.

A deflection aberration correcting electrode 39' of FIGS. 48A–48D are composed of two flat plates, i.e., a first plate member 39-21 and a second plate member 39-22, which extend in parallel from the sixth electrode 6 toward the fluorescent film 13. These plate members 39-21 and 39-22 are individually formed with both projections 394, which are so positioned as in FIGS. 45A–45C to transmit the three electron beams as to extend toward the fluorescent film 13, as shown, and recesses 396, which are recessed on the side of the sixth electrode 6 toward the fluorescent film 13 and which are larger than the projections 394, so that the electron beams E may transmit through the central portions of the recesses 396 and the projections 394 when they receive no deflection. Moreover, the projection 394 is shaped to have a maximum projection length $L_5$ toward the fluorescent film 13.

A deflection aberration correcting electrode 39' of FIGS. 49A–49D are composed of two plates, i.e., a first plate member 39-23 and a second plate member 39-24, which extend in face-to-face relation from the sixth electrode 6 toward the fluorescent film 13. These plate members 39-23 an 39-24 are individually composed of both parallel plate portions 39-23-1 and 39-24-1, which are positioned to transmit the center electron beam, and two portions 39-23-2 and 39-24-2 which are so warped to diverge toward the fluorescent film 13 as to correspond to the transmitting positions of the side electron beams. On the side of the sixth electrode 6, the gap between the two plates is equalized at the portion corresponding to the transmitting position of the center electron beam and at the portions corresponding to the transmitting positions of the side electron beams.

Figure 50A:
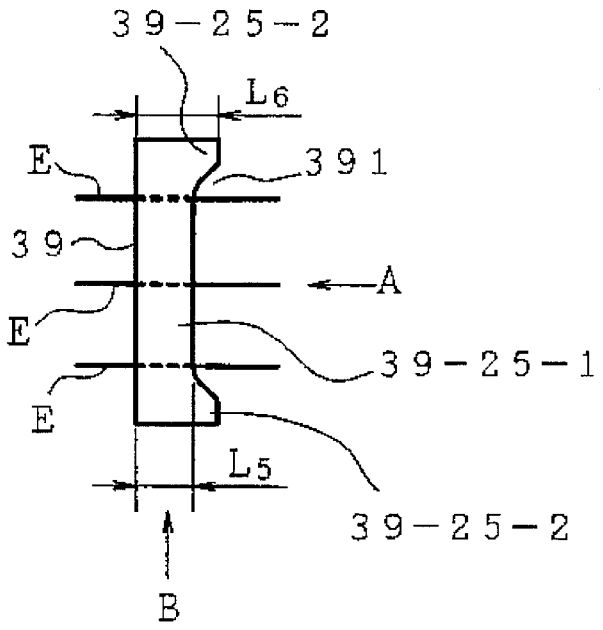
Figure 50B:
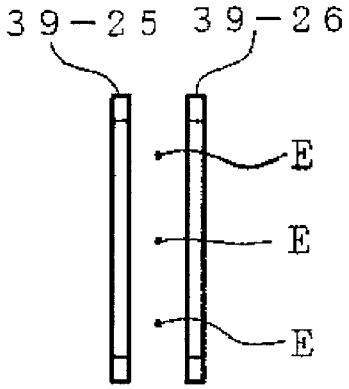
Figure 50C:
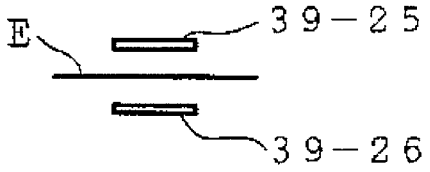

A deflection aberration correcting electrode 39' of FIGS. 50A–50C are composed of two plates, i.e., a first plate member 39-25 and a second plate member 39-26, which extend in parallel from the sixth electrode 6 toward the fluorescent film 13. These plate members 39-25 and 39-26 are individually composed of both portions 39-25-1 and 39-26-1, which are positioned to transmit the center electron beam and which have a length $L_5$ toward the fluorescent film 13, and portions 39-25-2 and 39-26-2 which so extend in a face-to-face relation toward the fluorescent film 13 as to correspond to the transmitting positions of the side electron beams with a length of $L_5$, as taken close to the center electron beam, and as to draw an arc toward the outer circumference with the maximum projection length $L_5$, as taken apart from the center electron beam.

When the electron beams are to be deflected in the in-line direction by using the electrode for correcting the deflection aberration, the deflection aberration of the side electron beams can be corrected by the coma aberration in accordance with the deflection angle.

As has been described in the individual embodiments of the deflection aberration correcting electrode, the length $L_5$ of the extension of the portions, as taken toward the fluorescent film, which are transmitted by the three electron beams E when these are not deflected in the in-line direction, is made larger than the length of the extension of the portions, as taken toward the fluorescent film, which are transmitted by the three electron beams E when these are deflected in the in-line direction.

Thanks to this construction, in case the electron beam E passing through the deflection aberration correcting electrode is deflected, its orbit is more deflected than that of the case, in which it receives no deflection, so that the expansion of the beam spot and the occurrence of haloes on the fluorescent face according to the change of the deflection angle can be suppressed.

The two plate members composing the deflection aberration correcting electrode, as shown in FIGS. 43A to 50C, can naturally be modified in various manners in addition to the above-specified gaps, as exemplified by the parallel arrangements, the non-parallel arrangements and the partially non-parallel arrangements.

Incidentally, as shown in FIGS. 43A to 50C, the means for establishing a lower potential than an anode potential to feed it, without connecting it with the anode, to the deflection aberration correcting electrode which is operative to establish a fixed inhomogeneous electric field in the magnetic field of the deflection yoke to correct the deflection aberration of the electron beam, when this beam is to be deflected by the magnetic field of the deflection yoke, in accordance with the deflection angle can be exemplified by feeding a desired voltage independently of the stem pins. However, this desired voltage can be fed while leaving the structure for feeding the power to the electron gun as it is in the prior art, if an electric resistor is disposed in the cathode ray tube and has its one terminal connected with the anode and its other terminal either connected with another electrode at a low potential or grounded to the earth so that a suitable voltage may be extracted from its intermediate portion.

FIGS. 51, 52, 53, 54, 55 and 56 present schematic sections for explaining examples of the basic structures of the electron guns of the various electrode constructions according to the present invention. In these figures, reference letter K designates a cathode; characters G1 a first electrode; characters G2 a second electrode; characters G3 a third electrode; characters G4 a fourth electrode; characters G5 a fifth electrode; characters G6 a sixth electrode; letters Vf a focusing voltage; and letters Eb an anode voltage.

Figure 55:
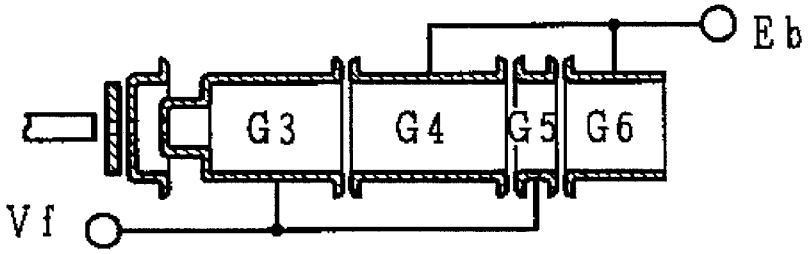
FIG. 55 PRIOR ART

Specifically, FIG. 51 shows the BPF type electron gun; FIG. 52 the UPF type electron gun; FIG. 53 an electron gun connected like the BPF type electron gun having a long focusing electrode; FIG. 54 an electron gun connected like the UPF type electron gun having a long focusing electrode; FIG. 55 an electron gun for feeding the focusing voltage to the electrodes G3 and G5 and the anode voltage to the electrodes G4 and G6; and FIG. 56 an electron gun for feeding a first focusing voltage to the electrodes G3 and G5, a second focusing voltage to the electrode G4 and the anode voltage to the electrode G6.

When the main lens electrode portions of the electron gins of those various types are disposed in the deflecting magnetic field established by the deflection yoke of the cathode ray tube so that the electron beam may be deflected by the magnetic field of the deflection yoke, the desired effects of the present invention can be achieved by providing the deflection aberration correcting electrode having the constructions, as described with reference to FIGS. 36 to 48D, for correcting the deflection aberration of the electron beam in accordance with the deflection angle.

Incidentally, the present invention can naturally be combined with any electron gun of the type other than the aforementioned types.

FIG. 57 is a schematic diagram for explaining the construction of another electron gun according to the present invention. In FIG. 57, the same reference numerals as those of the foregoing description designate the same portions. Numerals 1*a* and 1*b* designate the end of the first electrode 1 (G1) on the cathode (K) and the second electrode (G2), respectively; numerals 2*a* and 2*b* the ends of the second electrode (G2) on the first electrode (G1) and the third electrode (G3), respectively; numerals 3*a* and 3*b* the end of the third electrode (G3) on the second electrode (G2) and the fourth electrode (G4), respectively; numerals 4*a* and 4*b* the ends of the fourth electrode (G4) on the third electrode (G3) and the fifth electrode (G5), respectively; numerals 5*a* and 5*b* the ends of the fifth electrode (G5) on the fourth electrode (G4) and the sixth electrode (G6), respectively; and numeral 6*a* the end of the sixth electrode (G6) on the fifth electrode (G5), respectively. The suffix a indicates an entrance side for each electron beam and the suffix b indicates an exit side for each electron beam.

The electron gun, as shown, is constructed to have its first electrode (G1) grounded to the earth, its second electrode (G2) and fourth electrode (G4) fed with a suppression voltage $E_{C2}$, and its third electrode (G3) and fifth electrode (G5) fed with a focusing voltage Vf.

FIG. 58 is an explanatory diagram showing the detailed construction of the second electrode of FIG. 57. In FIG. 58, letter 2*c* designate an electron beam transmitting hole; letter 2*d* a slit which is so formed around the exit 2*b* of the electron beam transmitting hole 2*c* as to have a longer axis in parallel with the in-line direction (X—X); letters $W_1$ and $W_2$ the longer and shorter side sizes of the slit 2*d*; and letter D the depth of the slit 2*d*.

FIGS. 59A and 59B are explanatory diagrams showing the detailed construction of the third electrode of FIG. 57. FIG. 59A presents a perspective view showing the entrance side of the electron beam, and FIG. 59B presents a section taken along line A—A of FIG. 59A.

In FIGS. 59A and 59B, letter 3*c* designates electron beam transmitting holes, and letter 3*d* designate slits which are so formed around the individual electron beam transmitting holes of the third electrode 3 at the electron beam entrance side as to have longer axes perpendicular (Y—Y) to the in-line direction.

FIGS. 60A and 60B are explanatory diagrams showing the detailed construction of the fourth electrode of FIG. 57. In FIGS. 60A and 60B, letter 4*c* designates electron beam transmitting holes, and letter 4*d* designate slits which are so formed around the electron beam transmitting holes of the third electrode 3 at the electron beam exit side as to have longer axes perpendicular (Y—Y) to the in-line direction.

As described above, the electron beam of this type effects the astigmatism correction to improve the focusing characteristics by combining the electrode face, as hatched in FIG. 58, with the electrodes having the non-circular structures in the vicinity of the electron beam transmitting holes, as shown in FIGS. 58, 59A, 59B, 60A and 60B.

According to the cathode ray tube thus having such electron gun in the position of the neck portion of the prior art, the focusing homogeneity of the entire screen is drastically improved. If the astigmatism correction is added to increase the focusing homogeneity over the entire screen, the diameter of the electron beam spot at the center of the screen is increased to degrade the resolution. In this case, the focusing characteristics can be improved by positioning the main lens in the magnetic field of the deflection yoke, as in the present invention, and by providing the aforementioned deflection aberration correcting electrode to deflect the electron beam with the magnetic field of the deflection yoke.

FIG. 61 is a section showing an essential portion for explaining the structure of an electron gun for the color cathode ray tube using three electron beams arrayed in-line.

FIGS. 62A–62B and 63A–63C are diagrams showing the structures of electrodes composing the main lens of the electron gun, and FIGS. 62A and 63A present front elevations whereas FIGS. 62B and 63B present sectional side elevations showing essential portions.

The electron gun shown in FIG. 61 is presented in a section showing an essential portion for explaining the structure of an electron gun for the color cathode ray tube using three electron beams arrayed in-line, in which the main lens 38 is constructed by disposing the converging electrode of FIGS. 62A and 62B and the anode having the shape of FIGS. 63A–63C in a face-to-fare relation.

In the main lens constructed of the electrodes of the aforementioned shapes, the equipotential lines 61 penetrate into the aperture 6*a* of the anode and the aperture 5*b* of the focus electrode to establish a large electronic lens shared by the aforementioned three electron beams, as shown in FIG. 61. If the beam transmitting hole in the bottom face of a shield cup 81 has a sufficient aperture diameter, the electric field having penetrated to the aperture 6a of the anode will reaches the vicinity of an aperture 83 other than the aperture 82 of the shield cup.

FIGS. 64A and 64B are explanatory diagrams showing another example of the deflection aberration correcting electrode in the cathode ray tube of the present invention, and FIG. 64A presents a front elevation whereas FIG. 64B presents a transverse section showing a portion. FIGS. 64A and 64B show the color cathode ray tube using the three electron beams arrayed in-line, in case the electrode 39 for forming the fixed inhomogeneous electric field in the deflecting magnetic field to correct the deflection aberration in accordance with the deflection angle is disposed on the side closer to the fluorescent face than the bottom face of the shield cup 81.

The intensity of the electric field in the vicinity of the aforementioned deflection aberration correcting electrode 39 can be increased by sharing the beam transmitting hole formed in the bottom face of the shield cup 81 as a single beam transmitting hole among the three electron beams.

In one example of the electrode portion of the electron gun for the color cathode ray tube using the in-line arrayed three electron beams, as shown in FIG. 61, there are arrayed and arranged a plurality of electrodes which are individually formed with the electron beam transmitting holes for transmitting the individual electron beams at an interval L8 through the electron gun. The main lens of the electrodes of the electron gun is composed of the aforementioned electrodes shown in FIGS. 62A–62B and 63A–63C.

The main lens diameter has to be enlarged so as to improve the resolution on the fluorescent film but is limited by the aforementioned electron beam interval $L_8$. On the other hand, the penetration of the electric field to the bottom face of the shield cup 81 of FIGS. 64A and 64B can be promoted by enlarging the main lens aperture, especially, the aperture of the anode 6 facing the main lens, as taken in the scanning line direction. In the present embodiment, the penetration of the electric field into the bottom face of the shield cup of FIGS. 64A and 64B are promoted by using the aforementioned anode 6 having an aperture, as taken in the scanning line direction, of 0.5 times or more of the narrowest interval of the adjoining ones of the electron beam transmitting holes which are formed in the aforementioned plurality of electrodes.

In the embodiment of the present invention, there are used the combination of the deflection aberration correcting electrode having the shape shown in FIGS. 64A and 64B, and the disposition closer to the fluorescent face than the bottom face of the single-holed shield cup, the electrodes of FIG. 61 composing the main lens, and the parts in which the diameter of the aperture, as taken in the scanning line direction, of the anode 6 facing the main lens is 1.4 times or more as large as the value of the narrowest interval of the adjoining ones of the electron beam transmitting holes formed in the plurality of electrodes.

As has been described hereinbefore, according to the embodiments of the present invention, it is possible to provide a cathode ray tube equipped with an electron gun which is enabled to improve the focusing characteristics over the entire region of the screen and over the entire current range of the electron beam without feeding any dynamic focusing voltage thereby to achieve a satisfactory resolution and to reduce the Moire phenomena in a low current range.

Figure 65B:
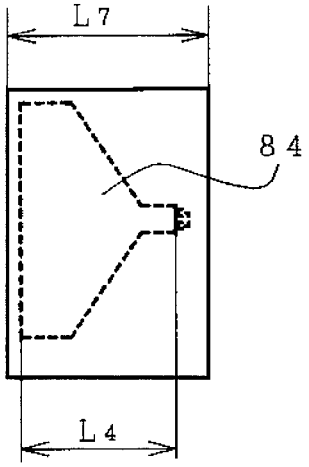
Figure 65C:
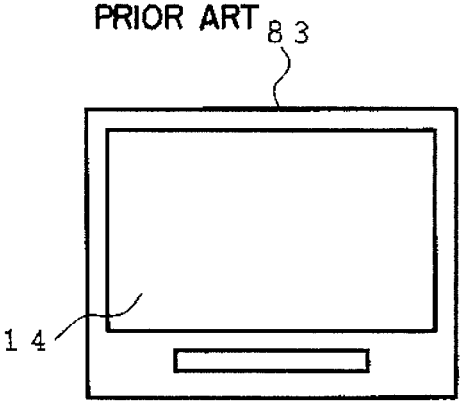
FIG. 65C PRIOR ART
Figure 65D:
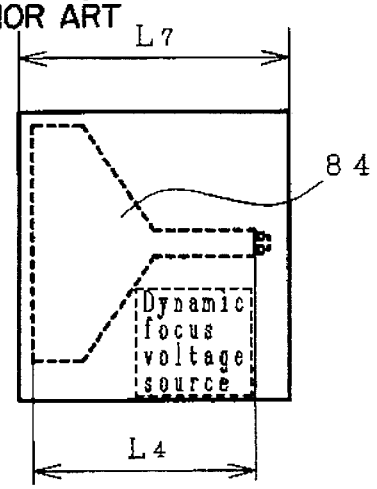
FIG. 65D PRIOR ART

FIGS. 65A–65D present explanatory diagrams for comparing the sizes of the example of the image display unit using the cathode ray tube according to the present invention and the image display unit using the cathode ray tube of the prior art. FIGS. 65A and 65B present a front elevation and a side elevation showing the image display unit using the cathode ray tube according to the present invention, and FIGS. 65C and 65D present a front elevation and a side elevation showing the image display unit using the cathode ray tube of the prior art.

In FIGS. 65A–65D, the depth $L_7$ of the cabinet 83 of the image display unit is shorter according to the present invention, as shown in FIG. 65B, than that of the prior art, as shown in FIG. 65D, so that the installation space can be spared.

The reason why the depth $L_7$ can be shortened is because the main lens of the electron gun of the cathode ray tube can be brought closer to the deflection yoke by establishing the fixed inhomogeneous electric field in the deflecting magnetic field to correct the deflection aberration corresponding to the deflection angle of the electron beam so that the length $L_4$ of the cathode ray tube 84 can be shortened.

As has been described hereinbefore, according to the embodiments of the present invention, it is possible to provide an image display unit having the construction which is enabled to improve the focusing characteristics over the entire region of the screen and over the entire current range of the electron beam without feeding any dynamic focusing voltage thereby to achieve a satisfactory resolution and to reduce the Moire phenomena in a low current range and which has a shortened cabinet depth.

As has been described hereinbefore, according to the present invention, it is possible to provide a cathode ray tube which is enabled to achieve a proper electron beam converging action over the entire region of a fluorescent film (or screen) and over the entire current range of the electron beam and to improve the resolution drastically over the entire screen region by establishing a fixed inhomogeneous electric field in a deflecting magnetic field to correct the deflection aberration of the electron beam, when this beam is deflected to have its orbit changed, in accordance with the deflection angle.

Specifically, by establishing the fixed inhomogeneous electric field which has its electron beam deflection aberration correcting action changed according to the deflection angle, the deflection aberration can be corrected by the electron beam having its orbit changed in the electric field by the deflection, to establish a proper electron beam converging action even at a position apart from the center of the fluorescent face.

On the other hand, the voltage to be applied to a portion of the inhomogeneous electric field establishing electrode (i.e., the deflection aberration correcting electrode) having its electron beam deflection aberration correcting action changed with the deflection angle may be at the same potential or different voltage as that of another electrode of the cathode ray tube. In the case of different voltage, for example, there can be disposed in the cathode ray tube an electric resistor of high resistance, which has its one terminal connected with the fluorescent film and its other terminal connected to the potential of the earth, for example, to extract a desired voltage from a suitable intermediate portion thereof.

Moreover, the portion having the maximum diameter of the electron beam in the electron gun is located in the vicinity of the main focus lens, and the electron beam deflecting magnetic field is generally inhomogeneous or convenience of adjusting the convergence in the in-line type color picture tube or a color display tube. In this case, the main converging lens is better apart as much as possible from the deflecting magnetic field establishing unit so as to suppress the distortion of the electron beam due to the deflecting magnetic field, and the deflecting magnetic field establishing unit is usually disposed in a position closer to the fluorescent face than the main converging lens of the electron gun. On the other hand, the length between the cathode and the main converging lens of the electron gun may be the longer for the smaller diameter of the beam spot on the fluorescent face, which is effected by reducing the image magnification of the electron gun. As a result, the cathode ray tube having an excellent resolution while coping with those two actions necessary has its axial length increased. According to the present invention, however, the position of the main converging lens can be brought closer to the fluorescent face while leaving unchanged the length between the cathode of the electron gun and the main converging lens, so that the image magnification of the electron gun can be further reduced to reduce the diameter of the electron beam spot on the fluorescent face and to shorten the axial length of the tube.

Thanks to this shortened axial length, the position of the main lens is brought closer to the fluorescent film to shorten the time period for which the repulsion of the space charge influences the electron beam, so that the diameter of the beam spot on the fluorescent face can be further reduced. In this state, the electron beam in the main focus lens is brought close to or into the deflecting magnetic field establishing unit so that it becomes liable to be distorted by the deflecting magnetic field. Despite this liability, however, the distortion is suppressed by the deflection aberration correcting action according to the aforementioned deflection angle.

In order to further reduce the diameter of the beam spot at the center of the fluorescent face, endeavors are steadily devoted in the related industry to enlarge the aperture of the main focus lens. This enlarged aperture exhibits its effect in enlargement of the electron beam diameter at time of passing through the main focus lens. In this state, the electron beam in the main focus lens grows the more susceptible to the influences of the deflecting magnetic field, and the main focus lens has to be spaced the more from the deflecting magnetic field so that the cathode ray tube has its axis elongated the more. In this case, too, according to the present invention, the axial length can be shortened by the aforementioned deflection aberration correcting action according to the deflection so that the main converging lens having the enlarged aperture can exhibit its features sufficiently.

Moreover, the electron beam spot will not receive, when it is located at the center of the screen, the influences of the deflecting magnetic field. Thus, no counter-measure is required for the distortion due to the deflecting magnetic field so that the lens action of the electron gun can be established by the rotationally symmetric converging system to reduce the electron beam spot diameter the more on the screen.

If, on the other hand, a dynamic focusing voltage is applied to the converging electrode of the electron gun, the proper electron beam converging action can be achieved the more all over the screen so that a resolution of satisfactory characteristics can be achieved all over the screen. However, the dynamic focusing voltage required can be dropped in combination of the fixed inhomogeneous electron field according to the present invention, in which the deflection aberration correction of the electron beam is changed according to the deflection angle when the electron beam is deflected to have its orbit changed.

According to the present invention, moreover, the fixed inhomogeneous electric field is established in the deflecting magnetic field to correct the deflection aberration. In addition, at least one of the electric fields to be established by a plurality of electrostatic lenses composed of a plurality of electrodes constituting the electron gun is made of the rotationally asymmetric electric field, to form: an electrostatic lens for shaping the electron beam spot in a high current region at the central portion of the screen of the fluorescent face into a generally circular or rectangular form and for having such focusing characteristics that the proper focusing voltage acting in the electron beam scanning direction is higher than the proper focusing voltage acting in the direction perpendicular to the scanning direction; and an electrostatic lens for fitting the scanning direction diameter and the perpendicular diameter of the electron beam spot in the low current region at the central portion of the fluorescent face to the shadow mask pitch and the scanning line density in the scanning direction and in the perpendicular direction and for having such focusing characteristics that the proper focusing voltage acting in the scanning direction is higher than the proper focusing voltage acting in the perpendicular direction. The lens by those rotationally asymmetric electric field can provide a cathode ray tube of the satisfactory focusing characteristics having no Moire in the electron beam for the entire region on the screen of the fluorescent face and for the entire current range.

According to the present invention, furthermore, the axial length of the cathode ray tube can be shortened to reduce the depth of the cabinet of the image display unit so that the space for installing the unit can be spared. The shortening of the depth of the cabinet is seriously difficult in the prior art and can be expected as a attractive selling point. Moreover, the cabinet having the shortened depth has a high transportation efficiency so that the transportation cost for the image display unit can be accordingly spared.

According to the present invention, furthermore, the shortening of the axial length of the cathode ray tube can improve the transportation efficiency of the same to spare the transportation cost.

What is claimed is:

1. A method of correcting the deflection aberration of a cathode ray tube including an electron gun having a plurality of electrodes, deflecting means and a fluorescent face, wherein the improvement resides in that a fixed inhomogeneous electric field is established downstream of a cathode side end of an anode of said electron gun in a deflecting magnetic field to correct a deflection aberration of an electron beam by disposing a pair of electrodes extending toward said fluorescent face on opposite sides of a path of the electron beam.

2. A method of correcting the deflection aberration of a cathode ray tube including an electron gun having a plurality of electrodes, deflecting means and a fluorescent face, wherein the improvement resides in that a fixed inhomogeneous electric field is established downstream of a cathode-side end of an anode of said electron gun in a deflecting magnetic field to correct a deflection aberration according to a deflection of an electron beam by disposing a pair of electrodes extending toward said fluorescent face on opposite sides of a path of the electron beam.

3. A method of correcting the deflection aberration of a cathode ray tube including an electron gun having a plurality of electrodes, deflecting means and a fluorescent face, wherein the improvement resides in that a fixed inhomogeneous electric field is established downstream of a cathode-side end of an anode of said electron gun in a deflecting magnetic field, said fixed inhomogeneous electric field having an astigmatism to correct a deflection aberration according to a deflection of an electron beam by disposing a pair of electrodes extending toward said fluorescent face on opposite sides of a path of the electron beam.

4. A cathode ray tube deflection aberration correcting method according to claim 3, wherein said fixed inhomogeneous electric field has such an astigmatism as will diverge said electron beam.

5. A cathode ray tube deflection aberration correcting method according to claim 3, wherein said fixed inhomogeneous electric field has such an astigmatism as will diverge said electron beam, to correct the deflection aberration according to the deflection in a direction perpendicular to the scanning line of said electron beam.

6. A cathode ray tube deflection aberration correcting method according to claim 3, wherein said fixed inhomogeneous electric field has such an astigmatism as will diverge said electron beam, to correct the deflection aberration according to the deflection in a scanning line direction of said electron beam.

7. A cathode ray tube deflection aberration correcting method according to claim 3, wherein said fixed inhomogeneous electric field has such an astigmatism as will converge said electron beam.

8. A cathode ray tube deflection aberration correcting method according to claim 3, wherein said fixed inhomogeneous electric field has such an astigmatism as will converge said electron beam, to correct the deflection aberration according to the deflection in a direction perpendicular to the scanning line of said electron beam.

9. A cathode ray tube deflection aberration correcting method according to claim 3, wherein said fixed inhomogeneous electric field has such an astigmatism as will converge said electron beam, to correct the deflection aberration according to the deflection in a scanning line direction of said electron beam.

10. A method of correcting the deflection aberration of a cathode ray tube including an electron gun having a plurality of electrodes, deflecting means and a fluorescent face, wherein the improvement resides in that a fixed inhomogeneous electric field is established downstream of a cathode-side end of an anode of said electron gun in a deflecting magnetic field, said fixed inhomogeneous electric field having a coma aberration to correct a deflection aberration according to a deflection of an electron beam by disposing a pair of electrodes extending toward said fluorescent face on opposite sides of a path of the electron beam.

11. A cathode ray tube deflection aberration correcting method according to claim 10, wherein said fixed inhomogeneous electric field has such a coma aberration as will diverge said electron beam.

12. A cathode ray tube deflection aberration correcting method according to claim 10, wherein said fixed inhomogeneous electric field has such a coma aberration as will diverge said electron beam, to correct the deflection aberration according to the deflection in a direction perpendicular to the scanning line of said electron beam.

13. A cathode ray tube deflection aberration correcting method according to claim 10, wherein said fixed inhomogeneous electric field has such a coma aberration as will diverge said electron beam, to correct the deflection aberration according to the deflection in a scanning line direction of said electron beam.

14. A cathode ray tube deflection aberration correcting method according to claim 10, wherein said fixed inhomogeneous electric field has such a coma aberration as will converge said electron beam.

15. A cathode ray tube deflection aberration correcting method according to claim 10, wherein said fixed inhomogeneous electric field has such a coma aberration as will converge said electron beam, to correct the deflection aberration according to the deflection in a direction perpendicular to the scanning line of said electron beam.

16. A cathode ray tube deflection aberration correcting method according to claim 10, wherein said fixed inhomogeneous electric field has such a coma aberration as will converge said electron beam, to correct the deflection aberration according to the deflection in a scanning line direction of said electron beam.

17. A cathode ray tube comprising: an electron gun having a plurality of electrodes; deflecting means for establishing a deflecting magnetic field; and a fluorescent face;

wherein the improvement comprises a deflection aberration correcting electrode means for establishing a fixed inhomogeneous electric field downstream of a cathode-side end of an anode of said electron gun for correcting a deflecting aberration, in said deflecting magnetic field and including a pair of electrodes disposed so as to extend toward said fluorescent face on opposite sides of a path of an electron beam.

18. A cathode ray tube comprising: an electron gun having a plurality of electrodes; deflecting means for establishing a deflecting magnetic field; and a fluorescent face;

wherein the improvement comprises a deflection aberration correcting electrode means for establishing a fixed inhomogeneous electric field downstream of a cathode-side end of an anode of said electron gun for correcting a deflecting aberration according to a deflection of an electron beam, in said deflecting magnetic field and including a pair of electrodes disposed so as to extend toward said fluorescent face on opposite sides of a path of an electron beam.

19. A cathode ray tube according to claim 18, wherein said deflection aberration correcting electrode means has an astigmatism according to the deflection of said electron beam.

20. A cathode ray tube according to claim 18, wherein said deflection aberration correcting electrode means has such an astigmatism as will diverge said electron beam in accordance with the deflection of said electron beam.

21. A cathode ray tube according to claim 18, wherein said deflection aberration correcting electrode means has such an astigmatism as will diverge said electron beam in accordance with deflection in a direction perpendicular to the scanning line of said electron beam.

22. A cathode ray tube according to claim 18, wherein said deflection aberration correcting electrode means has such an astigmatism as will diverge said electron beam in accordance with deflection in a scanning line direction of said electron beam.

23. A cathode ray tube according to claim 18, wherein said deflection aberration correcting electrode means has such an astigmatism as will converge said electron beam in accordance with the deflection of said electron beam.

24. A cathode ray tube according to claim 18, wherein said deflection aberration correcting electrode means has such an astigmatism as will converge said electron beam in accordance with deflection in a direction perpendicular to the scanning line of said electron beam.

25. A cathode ray tube according to claim 18, wherein said deflection aberration correcting electrode means has such an astigmatism as will converge said electron beam in accordance with deflection in a scanning line direction of said electron beam.

26. A cathode ray tube according to claim 18, wherein said deflection aberration correcting electrode means has a coma aberration according to the deflection of said electron beam.

27. A cathode ray tube according to claim 18, wherein said deflection aberration correcting electrode means has such a coma aberration as will diverge said electron beam in accordance with the deflection of said electron beam.

28. A cathode ray tube according to claim 18, wherein said deflection aberration correcting electrode means has such a coma aberration as will diverge said electron beam in accordance with deflection in a direction perpendicular to the scanning line of said electron beam.

29. A cathode ray tube according to claim 18, wherein said deflection aberration correcting electrode means has such a coma aberration as will diverge said electron beam in accordance with deflection in a scanning line direction of said electron beam.

30. A cathode ray tube according to claim 18, wherein said deflection aberration correcting electrode means has such a coma aberration as will converge said electron beam in accordance with the deflection of said electron beam.

31. A cathode ray tube according to claim 18, wherein said deflection aberration correcting electrode means has such a coma aberration as will converge said electron beam in accordance with deflection in a direction perpendicular to the scanning line of said electron beam.

32. A cathode ray tube according to claim 18, wherein said deflection aberration correcting electrode means has such a coma aberration as will converge said electron beam in accordance with deflection in a scanning line direction of said electron beam.

33. An image display device comprising: a cathode ray tube provided with an electron gun having a plurality of electrodes; deflecting means for establishing a deflecting magnetic field; and a fluorescent face;

wherein the improvement comprises a deflection aberration correcting electrode means for establishing a fixed inhomogeneous electric field downstream of a cathode-side end of an anode of said electron gun for correcting a deflection aberration, in said deflecting magnetic field and including a pair of electrodes disposed so as to extend toward said fluorescent face on opposite sides of a path of an electron beam.

34. An image display device comprising: a cathode ray tube provided with an electron gun having a plurality of electrodes; deflecting means for establishing a deflecting magnetic field; and a fluorescent face;

wherein the improvement comprises a deflection aberration correcting electrode means for establishing a fixed inhomogeneous electric field downstream of a cathode-side end of an anode of said electron gun for correcting a deflection aberration according to a deflection of an electron beam, in said deflecting magnetic field and including a pair of electrodes disposed so as to extend toward said fluorescent face on opposite sides of a path of an electron beam.

35. An image display device according to claim 34, wherein said deflection aberration correcting electrode means has an astigmatism according to the deflection of said electron beam.

36. An image display device according to claim 34, wherein said deflection aberration correcting electrode means has a coma aberration according to the deflection of said electron beam.

* * * * *